US010059404B2

(12) United States Patent
Clover et al.

(10) Patent No.: US 10,059,404 B2
(45) Date of Patent: Aug. 28, 2018

(54) WAKE DIVERTER

(71) Applicant: Mission LLC, Minnetonka, MN (US)

(72) Inventors: Kristopher William Clover, Minnetonka, MN (US); Mark Raymond Bohlig, Minnetonka, MN (US); Luke Raymond Bohlig, Minnetonka, MN (US)

(73) Assignee: MISSION LLC, Minnetonka, MN (US)

( * ) Notice: Subject to any disclaimer, the term of this patent is extended or adjusted under 35 U.S.C. 154(b) by 0 days.

(21) Appl. No.: 15/467,954

(22) Filed: Mar. 23, 2017

(65) Prior Publication Data

US 2017/0233038 A1 Aug. 17, 2017

Related U.S. Application Data

(60) Provisional application No. 62/312,848, filed on Mar. 24, 2016.

(51) Int. Cl.

| | |
|---|---|
| ***B63B 1/32*** | (2006.01) |
| ***B63B 1/22*** | (2006.01) |
| ***B63B 35/85*** | (2006.01) |

(52) U.S. Cl.

CPC ..... *B63B 1/22* (2013.01); *B63B 35/85* (2013.01); *B63B 2035/855* (2013.01)

(58) Field of Classification Search

CPC .. B63B 1/32; B63B 1/22; B63B 35/85; B63B 2035/855

USPC ..... 114/285

See application file for complete search history.

(56) References Cited

U.S. PATENT DOCUMENTS

| | | | | |
|---|---|---|---|---|
| 2,127,154 | A | † | 8/1938 | Burk |
| 3,159,134 | A | | 12/1964 | Winnen |
| 3,769,927 | A | | 11/1973 | Carney |
| 3,918,666 | A | | 11/1975 | Florian |
| 4,043,531 | A | | 8/1977 | Green |
| 5,184,858 | A | | 2/1993 | Arai |
| 5,224,436 | A | | 7/1993 | Stricker |
| 5,549,071 | A | | 8/1996 | Pigeon et al. |
| 5,611,295 | A | | 3/1997 | Stables |
| 5,860,384 | A | | 1/1999 | Castillo |
| 5,860,766 | A | | 1/1999 | Lochtefeld et al. |

(Continued)

FOREIGN PATENT DOCUMENTS

WO 2013071148 A1 5/2013

OTHER PUBLICATIONS

"Vacuum Systems for Successful Robot Implementation" Josef Karbassi, Oct. 15, 2013, Robotics Tomorrow https://www.roboticstomorrow.com/article/2013/10/vacuum-systems-for-successful-robot-implementation/206.*

(Continued)

*Primary Examiner* — Anthony D Wiest

(74) *Attorney, Agent, or Firm* — Faegre Baker Daniels LLP

(57) ABSTRACT

In various embodiments, a wake diversion system operates to manipulate the characteristics of the stern waves produced by a watercraft as it passes through water. In one embodiment, the wake diversion system includes a wake diverter that is comprised of a body, a panel, and a plurality of boat attachment mechanisms. The wake diverter is removably attachable to the side of the hull of a watercraft such that it obstructs the natural flow of water around the hull of the watercraft on side of the watercraft to which it is attached.

18 Claims, 38 Drawing Sheets

(56) References Cited

U.S. PATENT DOCUMENTS

| | | | | |
|---|---|---|---|---|
| 6,006,689 | A | 12/1999 | Olofsson | |
| 6,012,408 | A | 1/2000 | Castillo | |
| 6,105,527 | A | 8/2000 | Lochtefeld et al. | |
| 6,154,929 | A | 12/2000 | Dwyer | |
| 6,167,830 | B1 | 1/2001 | Pilger | |
| 6,520,104 | B1 | 2/2003 | Svensson | |
| 6,712,016 | B1 | 3/2004 | Morisch et al. | |
| 6,874,441 | B2 | 4/2005 | Pigeon | |
| 6,941,884 | B2 | 9/2005 | Moore | |
| 7,063,031 | B2 | 6/2006 | Earl et al. | |
| 7,140,318 | B1 | 11/2006 | Gasper | |
| 7,174,843 | B1 | 2/2007 | Tossavainen | |
| 7,182,037 | B2 | 2/2007 | Otobe et al. | |
| 7,189,127 | B2 | 3/2007 | Otobe et al. | |
| 7,201,111 | B1 | 4/2007 | Burkett | |
| 7,229,059 | B1 * | 6/2007 | Hood | B60R 11/00 248/205.8 |
| 7,252,047 | B1 | 8/2007 | Baucom et al. | |
| 7,434,531 | B1 | 10/2008 | Zsido et al. | |
| 7,475,652 | B2 | 1/2009 | Dvorak | |
| 7,617,026 | B2 | 11/2009 | Gee et al. | |
| 7,665,706 | B2 * | 2/2010 | Chien | A47K 3/003 248/206.3 |
| 7,707,956 | B2 | 5/2010 | Moore | |
| 8,336,447 | B2 | 12/2012 | Jarisch et al. | |
| 8,387,932 | B2 | 3/2013 | Takahashi et al. | |
| 8,453,591 | B2 | 6/2013 | Mannerfelt et al. | |
| 8,534,214 | B1 | 9/2013 | Gasper | |
| 8,539,897 | B1 | 9/2013 | Gasper et al. | |
| 8,573,873 | B2 | 11/2013 | Kalush | |
| 8,578,837 | B1 | 11/2013 | Burhoe | |
| 8,667,917 | B2 | 3/2014 | Brewer | |
| 8,833,286 | B1 | 9/2014 | Sheedy et al. | |
| 9,032,897 | B2 | 5/2015 | Argo | |
| 9,296,447 | B1 † | 3/2016 | Morgan | |
| 9,334,022 | B2 † | 5/2016 | Gasper | |
| 9,422,028 | B2 † | 8/2016 | Wilhelm | |
| 9,493,213 | B2 † | 11/2016 | Thomas | |
| 9,540,074 | B1 † | 1/2017 | Pigeon | |
| 9,834,280 | B1 * | 12/2017 | Wilmoth, III | B63B 1/32 |
| 2007/0216154 | A1 | 9/2007 | Casagrande | |
| 2007/0257167 | A1 * | 11/2007 | Richter | F16B 47/00 248/205.8 |
| 2008/0190348 | A1 | 8/2008 | Baker | |
| 2013/0213293 | A1 | 8/2013 | Gasper et al. | |
| 2013/0228113 | A1 | 9/2013 | Gasper et al. | |
| 2013/0228115 | A1 | 9/2013 | Gasper et al. | |
| 2014/0137786 | A1 | 5/2014 | Gasper et al. | |
| 2014/0137787 | A1 | 5/2014 | Gasper et al. | |
| 2014/0261135 | A1 | 9/2014 | Gasper et al. | |
| 2016/0009342 | A1 | 1/2016 | Thomas | |
| 2016/0340948 | A1 | 11/2016 | McCullough | |

OTHER PUBLICATIONS

Online Community Forum "DIY Wake Surf Shaper" MasterCraft Team Talk, Oct. 11, 2015 to May 6, 2016, forum pp. 1 to 16, 94 pages. Printed from http://www.mastercraft.com/teamtalk/showthread.php?t=70442 on May 1, 2018.

Mission LLC, Newsletter: "Spring is Here, Mission Delta Wakesurf, A new name for a new era." Mission Boat Gear, Mar. 20, 2016, 7 pages. Printed from https://us12.campaign-archive.com/?u=a9fdbcd03d7fe907c44539a29&id=ae592f163c on Apr. 25, 2018.

Mission LLC, Newsletter: "Delta Wakesurfing made simple." Mission Boat Gear, Apr. 28, 2016, 4 pages. Printed from https://us12.campaign-archive.com/?u=a9fdbcd03d7fe907c44539a29&id=eeb301246c on Apr. 25, 2018.

Instagram Social Media Post: "Delta Wakesurfing made simple" Mission Boat Gear, Apr. 28, 2016, 1 page. Printed from https://www.instagram.com/p/BEvtcIIFZ4i/?hl=en&taken-by=missionboatgear on Apr. 25, 2018.

Mission LLC, Newsletter: "Meet Delta." Mission Boat Gear, May 5, 2016, 3 pages. Printed from https://us12.campaign-archive.com/?u=a9fdbcd03d7fe907c44539a29&id=092fa57578 on Apr. 25, 2018.

Instagram Social Media Post: "Delta Wakesurfing made simple" Mission Boat Gear, May 5, 2016, 1 page. Printed from https://www.instagram.com/p/BFBdm5VFZxS/?hl=en&taken-by=missionboatgear on Apr. 25, 2018.

Product description "Wakesurf Shaper the 138 Concave Blade | Ronix," 3 pages. Printed from https://www.ronixwake.com/Product/wakesurf-shaper-the-138-concave-blade/ on Apr. 25, 2018.

Product description "Eight.3 Ronix Blade 138 Wakesurf Shaper, Newest Suction Cup Device," 5 pages. Printed from https://www.wakemakers.com/resources/eight3-blade-wakesurf-shaper-debut/ on Apr. 25, 2018.

Product description "Eight.3 Debuts Blade Wakesurf Shaper | Wake Makers," 8 pages. Printed from https://www.wakemakers.com/eight3-blade-wakesurf-shaper.html on Apr. 25, 2018.

"Welcome Aboard-Suction Cleat", pp. 1-2, Nov. 29, 2010, Welcome Aboard Catalog, , <http://www.welcome-aboard.com/prodinfo.asp?number=SC1001>, retrieved from Internet Archive Wayback Machine, <http://www.wayback.archive.org/web> on Dec. 7, 2017.†

* cited by examiner
† cited by third party

WAKE DIVERTER

CROSS-REFERENCE TO RELATED APPLICATION

This application claims priority to Provisional Application No. 62/312,848, filed Mar. 24, 2016, entitled WAKE DIVERTER, which is herein incorporated by reference in its entirety.

TECHNICAL FIELD

Embodiments of this disclosure relate generally to the manipulation of watercraft wakes, and particularly to the disruption of the natural movement of water displaced by a watercraft as the watercraft travels through the water.

BACKGROUND

Wake surfing has emerged as one of the most popular water sporting activities of the modern era. Boat manufacturers and surf enthusiasts alike continue to seek out the largest and most desirable surf wake possible.

The natural combination of a boats' endless wave (as long as the boat continues to move through the water) and the desire to surf have within the last two decades brought this sport from relative obscurity to mainstream.

The height from trough to crest, pitch or steepness, length, and crest shape of a wave are elements of a wave for wakesurfing. One or more of these factors can be manipulated by way of hull design, weight distribution, speed, and/or other factors to create a wave for a particular rider's skills and/or preference. The use of ballast tanks (temporary and permanent) has been one approach for manipulating the wave shape and size. The use of these tanks, however, has drawbacks. As a result, some boat manufactures that produce boats specifically tailored for wakesurfing related activities have invested considerable financial amounts, effort and time into developing hull designs for producing ideal wake shapes and sizes. But, bigger wakes and smoother shapes are not always desired by the boat owner, and the hull design of a boat and its associated wave shape are generally permanent. Thus, while hull design has had some success in helping boat manufacturers market and sell boats, some consumers are interested in boats that offer flexibility in terms of wake shape and size (e.g., smaller wake for skiing).

SUMMARY

According to some aspects of the disclosure, an apparatus configured to be coupled to a hull of a watercraft that has a first side and a second side, the apparatus comprising a body, a differential pressure attachment assembly coupled to the body and operable to couple the body to the hull of the watercraft, the assembly including a cup having a hull attachment surface, at least a portion of the hull attachment surface being configured to contact a portion of the hull of the watercraft, and an actuator transitionable between a disengaged state and an engaged state, the actuator coupled to the cup such that as the actuator transitions from the disengaged state to the engaged state, a force is exerted on the cup that causes a portion of the hull attachment surface of the cup to move away from the hull of the watercraft such that a volume defined between the hull attachment surface of the cup and the hull of the watercraft changes from a first volume to a second volume, the second volume being larger than the first volume, and a pressure of the second volume being less than an atmospheric pressure, and a panel extending from the body such that when the apparatus is coupled to the first side of the hull of the watercraft the panel extends away from the first side of the hull of the watercraft, and such that a first wake is produced by the watercraft as the watercraft travels through a body of water at a first speed and in a first direction with the apparatus coupled to the first side of the hull of the watercraft, the first wake being different than a second wake that is produced by the watercraft as the watercraft travels through the body of water at the first speed and in the first direction without the apparatus coupled to the first side of the hull of the watercraft.

In some examples, the differential pressure attachment assembly does not require the use of a pump to evacuate a fluid trapped within the volume defined between the hull attachment surface of the cup and the hull of the watercraft to cause the volume to change from the first volume to the second volume.

In some examples, the actuator is a mechanical lever having a fulcrum and the mechanical lever is transitionable between the disengaged state and the engaged state by rotating the lever about the fulcrum, wherein rotating the mechanical lever about the fulcrum causes the fulcrum to translate from a first position to a second position.

In some examples, the assembly further includes a post extending from an upper surface of the cup and mechanically coupling the cup to the lever, the lever being rotatably coupled to the post such that as the fulcrum translates from the first position to the second position the post translates with the fulcrum, the translation of the post resulting in the force that is exerted on the cup that causes the portion of the hull attachment surface of the cup to move away from the hull of the watercraft.

In some examples, a resilient member is positioned between the cup and the body, the resilient member exerting a force on the body and the cup that influences the body and the cup to move away from one another.

In some examples, the portion of the hull attachment surface of the cup that contacts the hull of the watercraft is an annular portion of the hull attachment surface of the cup, and wherein the portion of the hull attachment surface of the cup that moves away from the hull of the watercraft as the actuator transitions from the disengaged state to the engaged state is a central portion of the hull attachment surface of the cup that is enveloped by the annular portion.

In some examples, as the actuator transitions from the disengaged state to the engaged state, at least a portion of the annular portion of the hull attachment surface of the cup maintains contact with the hull of the watercraft while the central portion moves away from the hull of the watercraft.

In some examples, the apparatus is removably coupleable to the hull of the watercraft while the watercraft is floating in the body of water and functional when attached when the watercraft is floating in the body of water, wherein the hull includes a starboard side, a port side and stern side.

In some examples, the apparatus is coupleable while the assembly is at least partially below a waterline of the body of water.

In some examples, the apparatus is configured to be coupleable to the first side or the second side, wherein each of the first side and the second side is a side between a bow and a stern of the watercraft.

In some examples, in a first configuration the panel is angled relative to the body at a first angle and wherein in a second configuration the panel is angled relative to the body at a second angle different from the first angle.

In some examples, the body has a forward end and an aft end opposite the forward end, and wherein the panel includes a forward side and an aft side, the panel being removably coupleable to the body such that in a first configuration the panel is coupled to the body such that the aft side of the panel is more proximate the forward end of the body, and such that in a second configuration the panel is coupled to the body such that the forward side of the panel is more proximate the forward end of the body.

In some examples, the first side of the hull of the watercraft is the port side of the hull of the watercraft and wherein the second side of the hull of the watercraft is the starboard side of the hull of the watercraft, and wherein a convergence point of the first wake is skewed to a port side of the first wake, a convergence point of the third wake is skewed to a starboard side of the third wake, and wherein a convergence point of the second wake is not skewed to either a port or a starboard side of the third wake.

In some examples, the hull attachment surface of the cup has a loft such that in an undeformed stated, a first portion of the hull attachment surface lies in a first plane and a second portion of the hull attachment surface lies in a second plane, the first and second planes not being coplanar.

According to some aspects of the disclosure, a water obstruction apparatus for use in a water environment and configured couple to a hull of a watercraft, the water obstruction apparatus including a body having a forward end, an aft end, a first lateral side extending between the forward end and the aft end, a second lateral side extending between the forward end and the aft end, a top side, and a bottom side, the body having a length extending between the forward and aft ends of the body such that a first longitudinal plane extends along the length of the body and such that a second longitudinal plane orthogonal to the first longitudinal plane extends along the length of the body, the first longitudinal plane being positioned between the top and bottom sides of the body such that the first longitudinal plane intersects the first and second lateral sides of the body, the second longitudinal plane being positioned between the first and second lateral sides of the body such that the second longitudinal plane intersects the top and bottom sides of the body, a panel coupled to the body, the panel having a forward side, an aft side, a first lateral side extending between the forward and aft sides of the panel, a second lateral side extending between the forward and aft sides of the panel, a top side, and a bottom side, the panel having a height extending between the top and bottom sides of the panel such that a transverse plane extends along the height of the panel, the transverse plane being positioned between the forward and aft sides of the panel such that the transverse plane intersects the first and second lateral sides of the panel and such that the transverse plane intersects each of the first and second longitudinal planes.

In some examples, the water obstruction apparatus further includes a plurality of differential pressure attachment assemblies coupled to the body, each assembly a cup having a hull attachment surface and an upper surface, at least a portion of the hull attachment surface being configured to contact a portion of the hull of the watercraft, and an actuator coupled to the cup such that the body is positioned between the actuator and the upper surface of the cup, the actuator transitionable between a disengaged state and an engaged state such that as the actuator transitions from the disengaged state to the engaged state, a force is exerted on the cup that causes a portion of the hull attachment surface of the cup to move away from the hull of the watercraft such that a pressure of a volume defined between the hull attachment surface of the cup and the hull of the watercraft is less than an atmospheric pressure, wherein a first wake is produced by the watercraft as the watercraft travels through a body of water at a first speed and in a first direction with the water obstruction apparatus coupled to the first side of the hull of the watercraft, the first wake being different than a second wake that is produced by the watercraft as the watercraft travels through the body of water at the first speed and in the first direction without the water obstruction apparatus coupled to the first side of the hull of the watercraft.

In some examples, the cup assembly does not require the use of a pump to evacuate a fluid trapped within the volume defined between the hull attachment surface of the cup and the hull of the watercraft to cause the volume to change from the first volume to the second volume.

In some examples, the cup assembly further comprising a commissure post extending from the upper surface of the suction cup, the actuator being a mechanical lever having a fulcrum and being rotatably coupled to the commissure post such that the mechanical lever is transitionable between the disengaged state and the engaged state by rotating the lever about the fulcrum relative to the commissure post, wherein rotating the mechanical lever about the fulcrum causes the fulcrum to translate from a first position to a second position such that as the fulcrum translates from the first position to the second position the commissure post translates with the fulcrum, the translation of the commissure post resulting in the force that is exerted on the cup that causes the portion of the hull attachment surface of the cup to move away from the hull of the watercraft.

In some examples, the portion of the hull to which water obstruction the apparatus is coupled is below a waterline of the body of water such that the water obstruction apparatus is at least partially submerged in the body of water as the water obstruction apparatus is coupled to the portion of the hull of the watercraft.

In some examples, the water obstruction apparatus is coupled to the hull of the watercraft such that the water obstruction apparatus is at least partially submerged in the body of water while the watercraft is traveling at the first speed and in the first direction, and wherein the apparatus is configured to be coupleable to the first side or the second side, wherein each of the first side and the second side is a side between a bow and a stern of the watercraft.

In some examples, the hull attachment surface of the cup has a loft such that in an undeformed stated, a first portion of the hull attachment surface lies in a first plane and a second portion of the hull attachment surface lies in a second plane, the first and second planes not being coplanar.

Some aspects of the disclosure relate to a method of coupling a water obstruction apparatus for use in a water environment to a hull of a watercraft. In some embodiments, the water obstruction apparatus includes a body, a panel coupled to the body, and a first suction cup assembly coupled to the body. In some embodiments, the method includes, positioning the water obstruction apparatus on a first side of the hull of the watercraft such that a first hull attachment surface of a first suction cup of the first suction cup assembly contacts a first portion of the first side of the hull of the watercraft and such that a second hull attachment surface of a second suction cup of the second suction cup assembly contacts a second portion of the first side of the hull of the watercraft. In some embodiments, the first suction cup assembly includes a first actuator coupled to the first suction cup, wherein the first actuator is transitionable between a first disengaged state and a first engaged state.

In some embodiments, the method further includes transitioning the first actuator from the first disengaged state to the first engaged state by rotating the first actuator of the first suction cup assembly about a first fulcrum of the first actuator. In some embodiments, the rotation of the first actuator about the first fulcrum causes the first fulcrum to translate away from the first side of the hull of the watercraft such that a first force is exerted on the first suction cup that causes a portion of the first hull attachment surface of the first suction cup to move away from the first side of the hull of the watercraft such that a volume defined between the first hull attachment surface of the first suction cup and the first side of the hull of the watercraft changes from a first volume to a second volume, wherein the second volume is larger than the first volume, and a pressure of the second volume is less than an atmospheric pressure.

In some embodiments, the water obstruction apparatus further includes a second suction cup assembly coupled to the body. In some such embodiments, the method further includes positioning the water obstruction apparatus on the first side of the hull of the watercraft such that in addition to the first hull attachment surface of the first suction cup of the first suction cup assembly contacting the first portion of the first side of the hull of the watercraft, a second hull attachment surface of a second suction cup of the second suction cup assembly contacts a second portion of the first side of the hull of the watercraft.

In some embodiments, the second suction cup assembly includes a second rotatable actuator coupled to the second suction cup. In some embodiments, the second actuator is transitionable between a second disengaged state and a second engaged state.

In some embodiments, the method further includes transitioning the second actuator from the second disengaged state to the second engaged state by rotating the second actuator of the second suction cup assembly about a second fulcrum of the second actuator. In some embodiments, the rotation of the second actuator about the second fulcrum causes the second fulcrum to translate away from the first side of the hull of the watercraft such that a second force is exerted on the second suction cup that causes a portion of the second hull attachment surface of the second suction cup to move away from the first side of the hull of the watercraft such that a volume defined between the second hull attachment surface of the second suction cup and the first side of the hull of the watercraft changes from a third volume to a fourth volume, wherein the fourth volume is larger than the third volume, and a pressure of the fourth volume is less than the atmospheric pressure.

BRIEF DESCRIPTION OF THE DRAWINGS

FIGS. 28A-281 illustrate various views of an activation mechanism of a WAKE DIVERTER according to certain embodiments.

Figure 1:
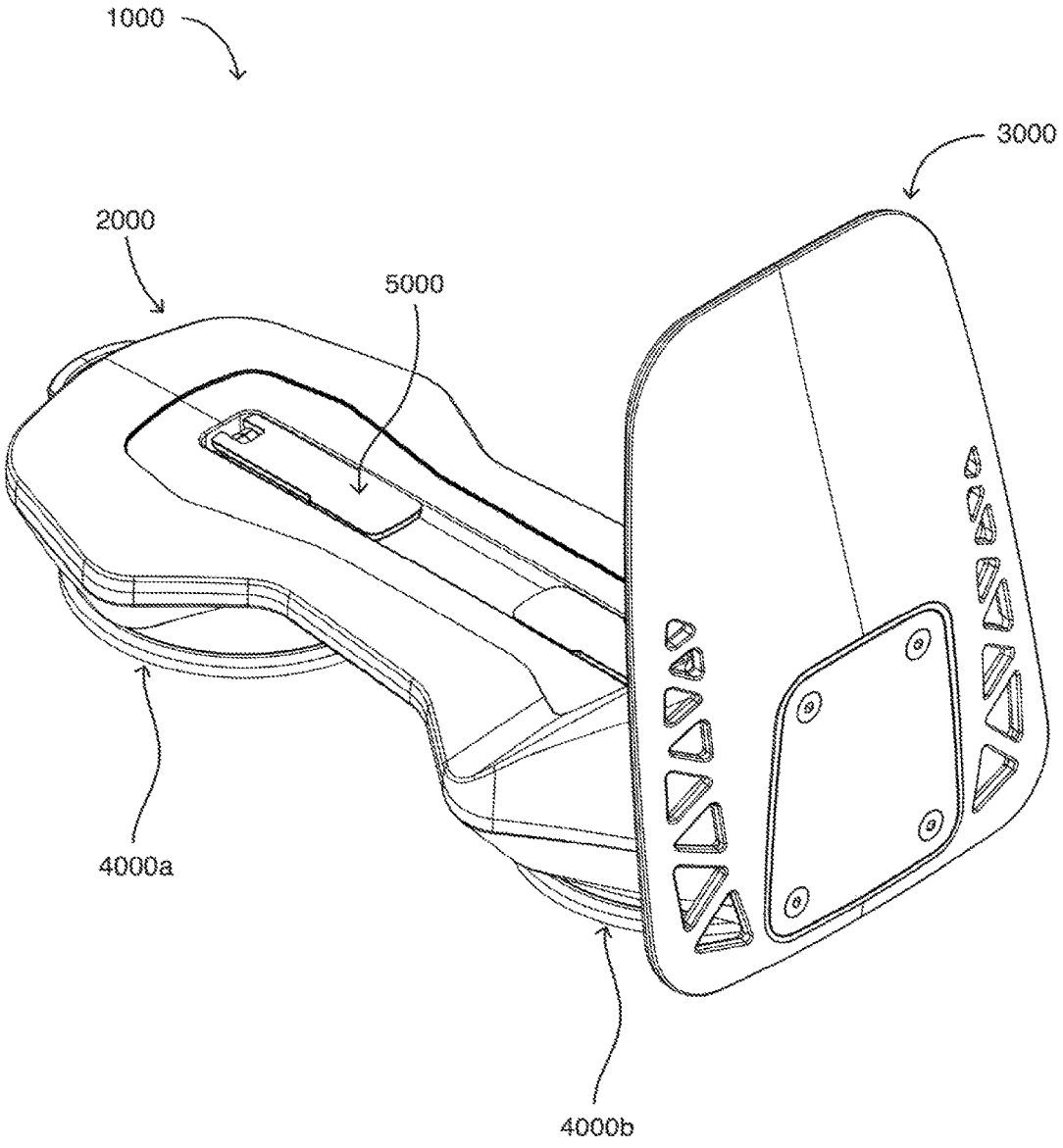
FIG. 1 illustrates a front perspective view of a WAKE DIVERTER according to certain embodiments.
Figure 2:
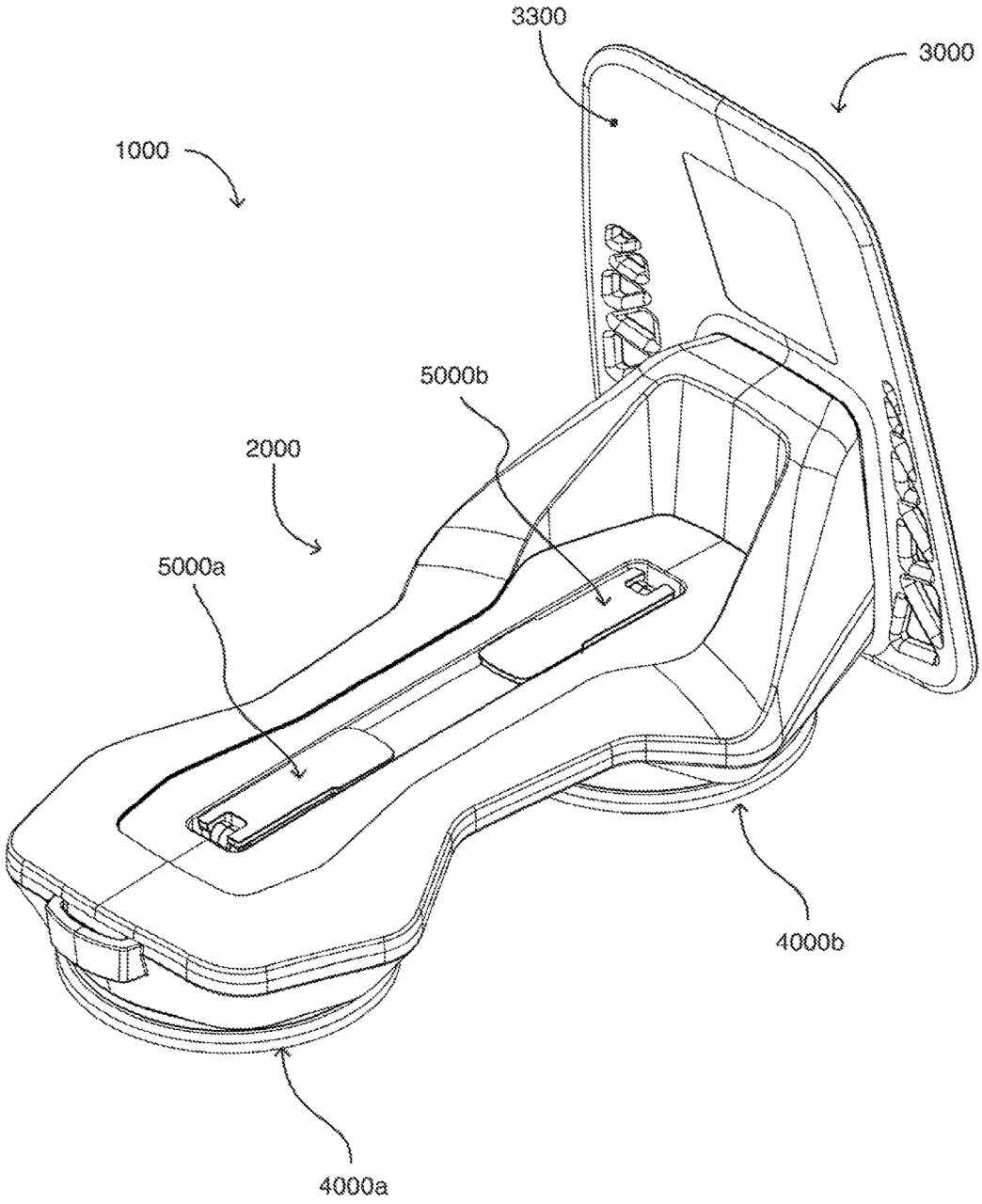
FIG. 2 illustrates a back perspective view of a WAKE DIVERTER according to certain embodiments.
Figure 3:
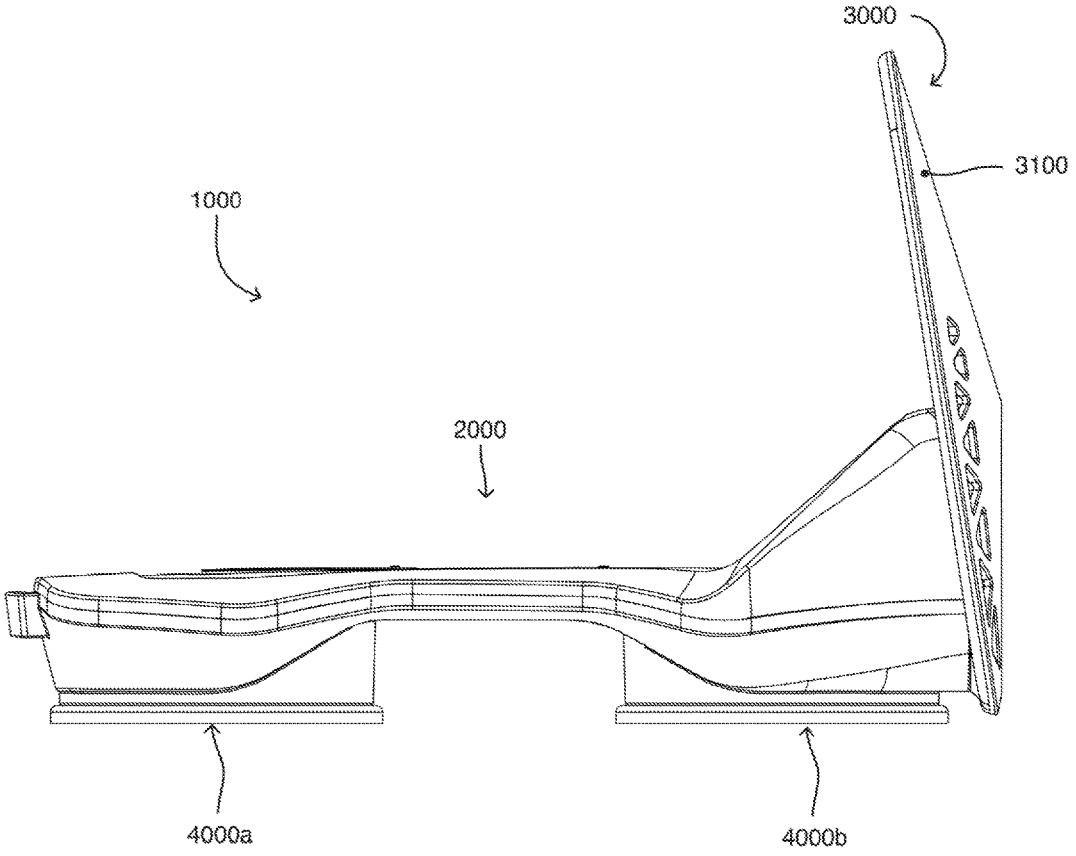
FIG. 3 illustrates a side view of a WAKE DIVERTER according to certain embodiments.
Figure 4:
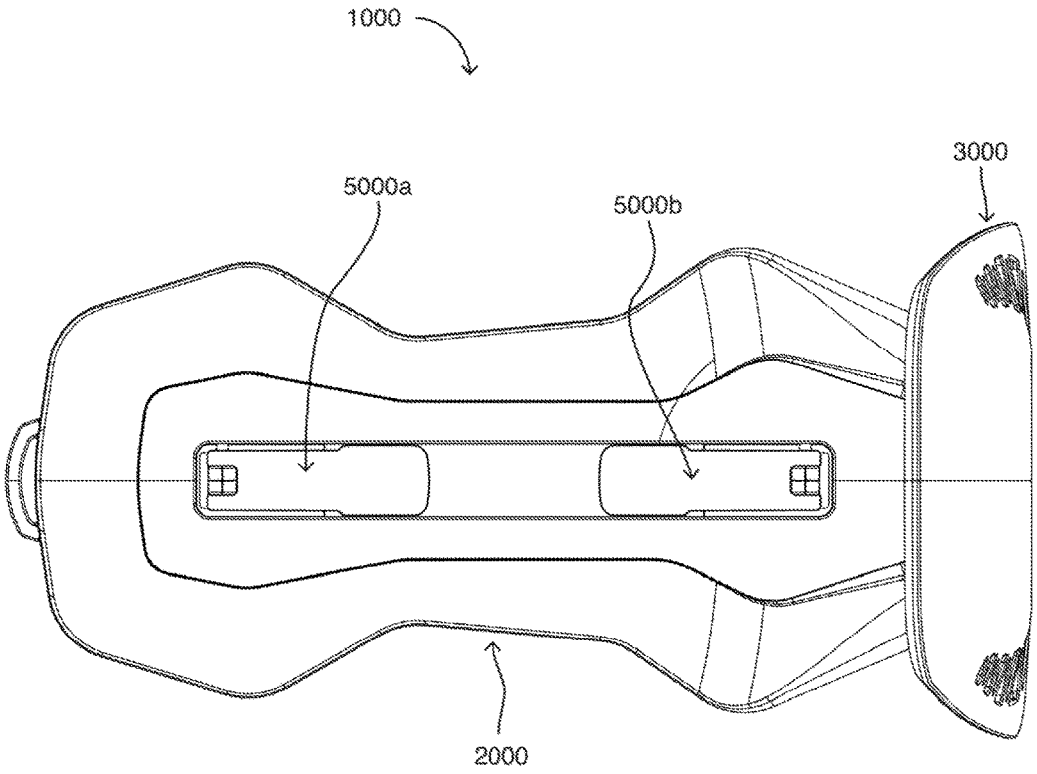
FIG. 4 illustrates a top view of a WAKE DIVERTER according to certain embodiments.
Figure 5:
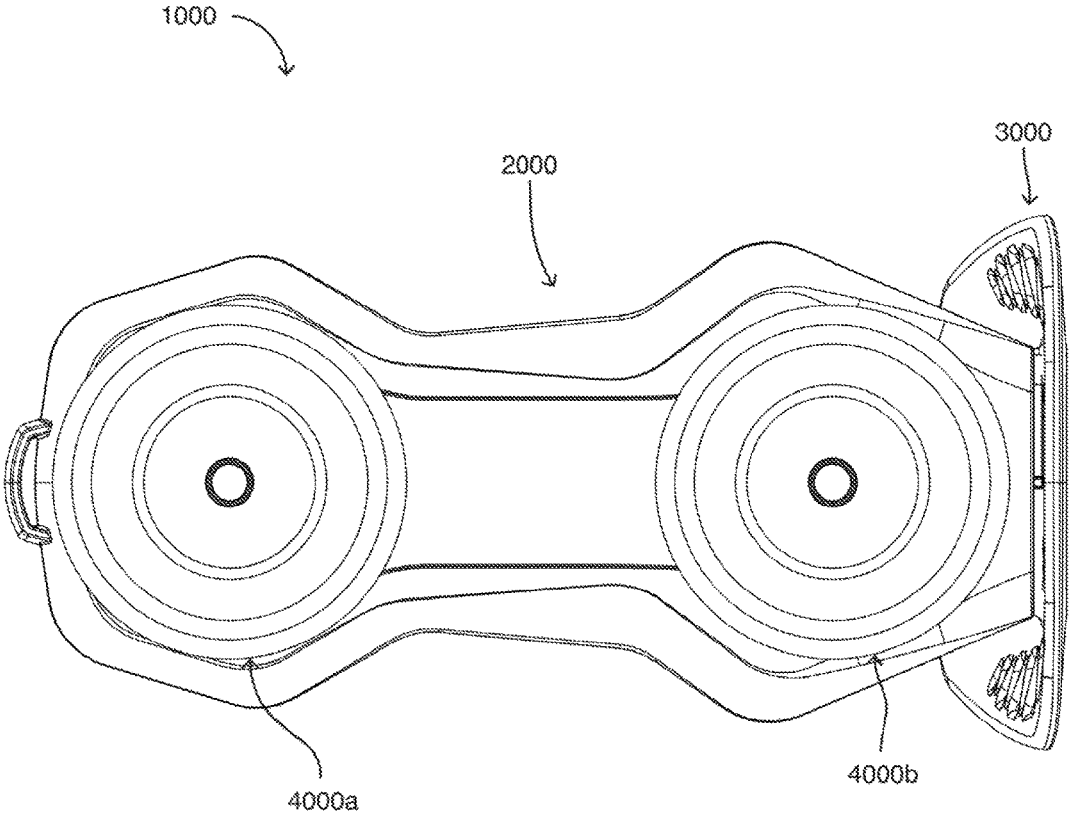
FIG. 5 illustrates a bottom view of a WAKE DIVERTER according to certain embodiments.
Figure 6:
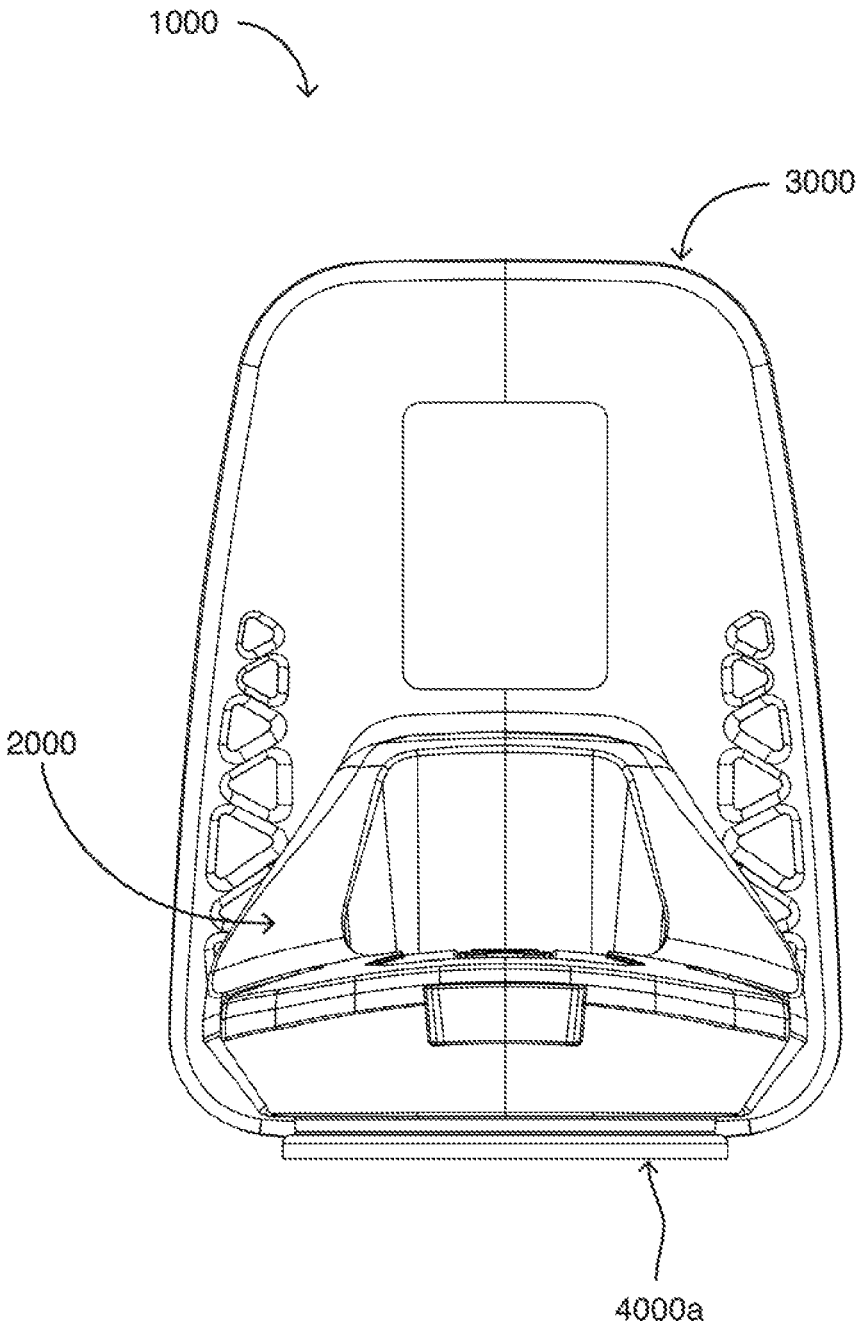
FIG. 6 illustrates a back view of a WAKE DIVERTER according to certain embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments disclosed herein relate generally to a wake system that operates to modify the characteristics of the stern waves or wake created by a watercraft as the watercraft passes through the water. In addition to structural embodiments, certain embodiments relate to the manufacture and use of structural embodiments.

Referring to the drawings, FIGS. 1-6 illustrate a wake diverter 1000 comprised of a body 2000, a panel 3000, and one or more attachments 4000, such as differential pressure attachments 4000*a* and 4000*b* (e.g., negative relative pressure attachments or vacuum attachments as described below). In various embodiments, the wake diverter is attachable to the hull of a watercraft (see FIG. 7), such as to a side portion of the hull of a watercraft.

Figure 7:
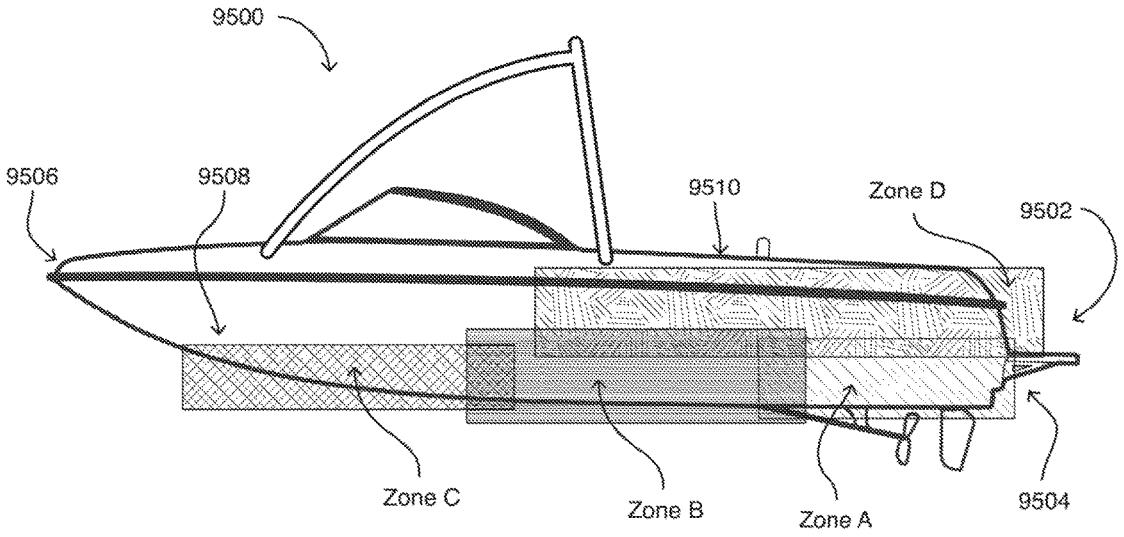
FIG. 7 illustrate a variety of wake WAKE DIVERTER attachment zone according to certain embodiments.

In one embodiment, the wake diverter 1000 is attachable to the hull of a watercraft at an aft or stern section of the watercraft. For example, as illustrated in FIG. 7, Zone A is an area of a watercraft 9500 located at the stern 9502 of the watercraft proximate the transom 9504. As illustrated in FIG. 7, Zone A is rectangular in shape and constitutes approximately the aft thirty percent of the port side of watercraft 1000. Additionally, as illustrated in FIG. 7, Zone A extends at least partially below a waterline of the boat. It should be appreciated that a boat's waterline refers to the waterline of the boat when operating under a condition suitable for producing surfable stern waves (e.g., between five and fifteen miles per hour). It should be appreciated that Zone A may extend only below the waterline, or alternatively only above the waterline, or may extend both above and below the waterline.

In other embodiments, the wake diverter 1000 is attachable to the hull of a watercraft at a forward or bow section of the watercraft. For example, as illustrated in FIG. 7, Zone C is an area of watercraft 9500 located at a forward section of watercraft 9500 proximate the bow 9506. As illustrated in FIG. 7, Zone C is similar in size and shape to Zone A, but is located forward of Zone A. Additionally, as illustrated in FIG. 7, Zone C extends at least partially below the waterline. It should be appreciated that Zone C may extend only below the waterline, or alternatively only above the waterline, or may extend both above and below the waterline.

Figure 35:
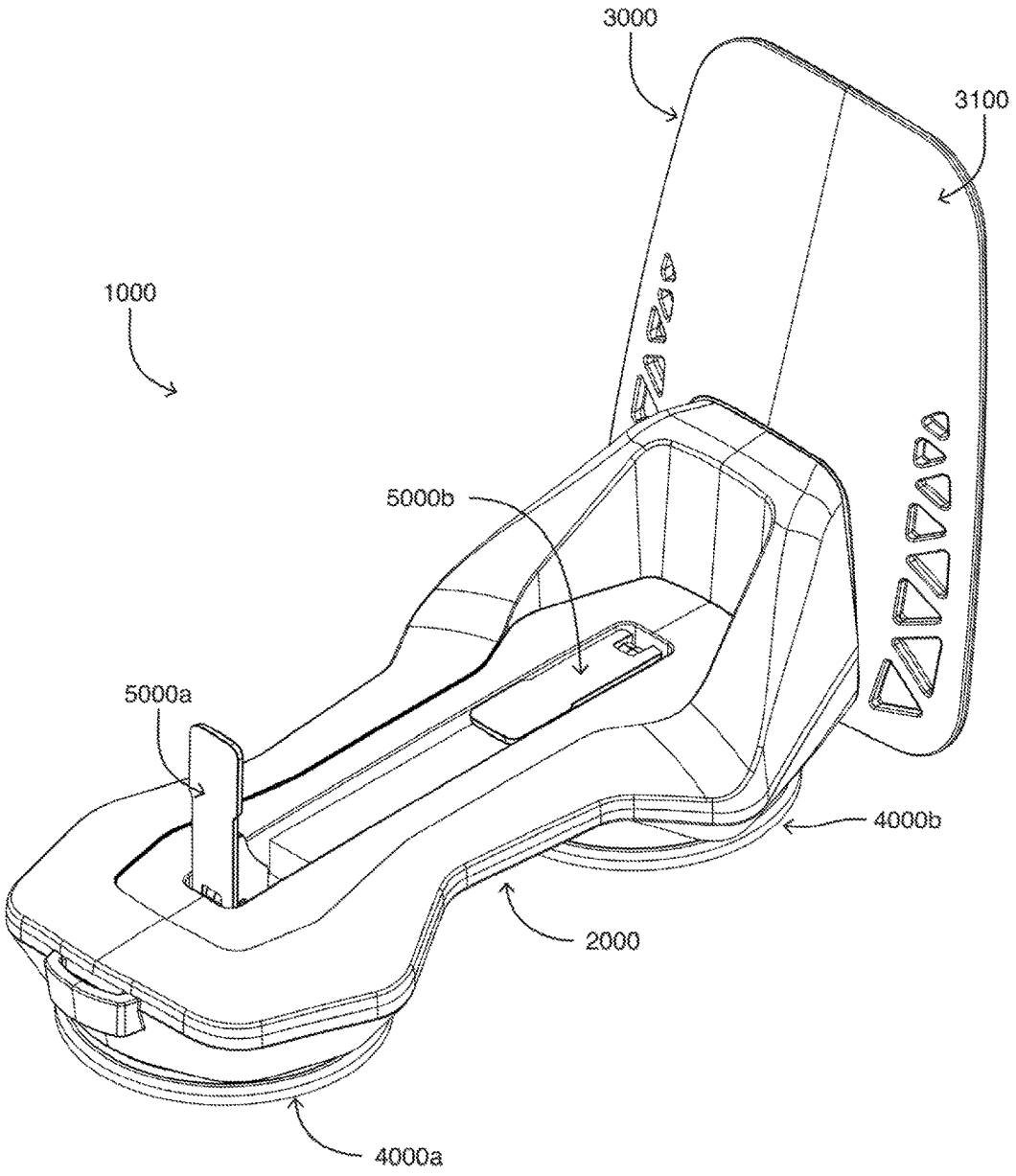
FIG. 35 illustrates a rear perspective view of a WAKE DIVERTER according to certain embodiments.

In yet another embodiment, the wake diverter 1000 is attachable to the hull of a watercraft at an intermediate portion of the hull located between the bow and the stern of a watercraft. For example, as illustrated in FIG. 35, Zone B is an area of watercraft 9500 situated between the bow 9506 and the stern 9502 of the watercraft 9500. As illustrated in FIG. 7, Zone B is similar in size and shape to Zones A and C, and is located forward of Zone A and aft of Zone C. Though Zone B is illustrated as being slightly larger than each of Zones A and C, it should be appreciated that Zone B may be of any suitable size and shape. Additionally, as illustrated in FIG. 7, Zone B extends at least partially below the waterline. It should be appreciated that Zone B may extend only below the waterline, or alternatively only above the waterline, or may extend both above and below the waterline.

In one embodiment, the wake diverter 1000 may be attached to the hull of a watercraft at an intermediate location that is more proximate the stern 9502 of the watercraft than the bow 9506 of the watercraft. For example, as illustrated in FIG. 7, Zone A partially overlaps with Zone B to form Zone AB, which is a zone located more proximate the stern 9502 of the watercraft 9500. Likewise, as illustrated in FIG. 7, Zone C partially overlaps with Zone B to form Zone BC, which is a zone located more proximate the bow 9506 of the watercraft 9500.

In an embodiment the wake diverter 1000 may be attached to the side of the hull of the watercraft in a location proximate the chine 9508 of the watercraft 9500. That is, regardless of whether the wake diverter 1000 is positioned within Zones A, B, C, AB, or BC, the wake diverter 1000 is positionable proximate the chine. In another embodiment, the wake diverter 1000 may be attached to the side of the hull of the watercraft in a location more proximate the gunnel or gunwale 9510 of the watercraft 9500. For example, referring again to FIG. 7, Zone D is an area of watercraft 9500 situated between the bow 9506 and stern 9502 of watercraft 9500 more proximate the stern 9502. As illustrated, Zone D extends from approximately the chine 9508 to just below the gunnel 9510.

It should be appreciated that wake diverter 1000 is operable to be positioned within one or more of Zones A, B, C, AB, AD, ABD, or BC. That is, the versatility of the wake diverter 1000 provides that it may be attached, for example at Zone A, and then subsequently easily and quickly detached from Zone A and reattached at any of Zones B, C, AB, AD, ABD, or BC (or at any other desired location different from Zones A, B, C, AB, AD, ABD, or BC) based on a user's preference and the desired stern wake shape characteristics.

The positioning of wake diverter 1000 at any of the above-mentioned zones (and further within any of the above-mentioned zones) is based on the preferences of the user in producing a wake with one or more wave characteristics (e.g., steepness, crest height, distance to break, etc.). That is, positioning wake diverter 1000 at different locations along the hull of the watercraft (e.g., within different zones) can result in the production of stern waves exhibiting different wave characteristics. For example, positioning the wake diverter 1000 below the waterline within Zone C can generate stern waves with a first set of wave characteristics, while positioning the wake diverter 1000 below the waterline within Zone A can generate stern waves with a second set of wave characteristics. In this example, one or more the wave characteristics of the second set of wave characteristics differ from the wave characteristics of the first set of wave characteristics.

Likewise, positioning wake diverter 1000 at different locations within a zone can result in the production of stern waves exhibiting different wave characteristics. For example, positioning the wake diverter 1000 completely below the waterline within Zone A can generate stern waves with a first set of wave characteristics, while positioning the wake diverter 1000 only partially below the waterline within Zone A can generate stern waves with a second set of wave characteristics. In this example, one or more the wave characteristics of the second set of wave characteristics differ from the wave characteristics of the first set of wave characteristics.

While exemplary Zones A, B, C, AB, AD, ABD, or BC are illustrated on the port side of watercraft 9500, it should be appreciated that similarly situated zones exist on the starboard side of watercraft 9500. Accordingly, the wake diverter 1000 is likewise positionable at any location along the starboard side of the hull of the watercraft 9500 in a same or similar manner and by the same or similar means that it is positionable on the port side of watercraft 9500.

It will thus be appreciated by one of ordinary skill that the wake diverter 1000 can be placed at virtually any position along the hull of a watercraft. Likewise, it will be appreciated that different wake surfers can place the wake diverter 1000 in different locations in an effort to produce what they consider to be stern waves with desired wave characteristics for their style of wakesurfing. As mentioned above, this type of versatility in accessory wake systems is unprecedented. In various embodiments, the wake diverter 1000 is generally positioned along the hull of the watercraft such that the wake diverter 1000 is forward of the transom or terminating stern surface of the watercraft, as discussed in greater detail below. In various embodiments, no portion of the wake diverter 1000 is aft the transom or terminating stern surface.

Referring back now to embodiments shown in FIGS. 1-6, the general shape of the wake diverter 1000 is that of a body 2000 used to support a panel 3000 and one or more differential pressure attachments 4000 as a means of attaching the wake diverter 1000 to a watercraft. Panel 3000 is the primary obstruction member or portion to the natural flow of water around the hull of the watercraft. In general, the wake diverter 1000 operates to disrupt the natural flow of water around the hull of a watercraft as the watercraft passes through the water. Specifically, the wake diverter 1000 operates to disrupt the natural flow of water around the side of the boat on which it is installed. For example, if the wake diverter is installed on the port side of the watercraft, the wake diverter 1000 operates to help disrupt the natural flow of water around the port side of the hull of the watercraft, which in turn operates to help alter the convergence point of the stern waves behind the watercraft. A disruption of the natural flow of water along the port side of a watercraft operates to help produce a diverging starboard wave that is suited for wakesurfing. Likewise, a disruption of the natural flow of water along the starboard side of a watercraft (by positioning the wake diverter 1000 along the starboard side of the hull of the watercraft) operates to help produce a diverging port wave that is tailored to a wake surfer's preference (e.g., one of more of height of crest, pitch, smoothness, angle to boat, etc.). In other words, by altering the convergence point of the stern waves behind the watercraft, the wake diverter 1000 operates to help modify the natural stern wake characteristics of the stern wakes behind the watercraft.

Still with reference to FIGS. 1-6, as mentioned above, the wake diverter 1000 includes one or more differential pressure attachments 4000. In various examples, the differential pressure attachments operate to create a differential pressure relative to atmosphere (e.g., changing chamber volume), as discussed below. In various embodiments, the wake diverter 1000 additionally includes one or more activation mechanisms 5000, such as levers 5000*a* and 5000*b* or other forms of activation mechanisms like knobs or buttons. In such embodiments, the activation mechanisms 5000 operate to activate the differential pressure attachments 4000, which when engaged facilitate attachment of the wake diverter 1000 to the side of the hull of a watercraft. In various embodiments, activation mechanisms 5000 operate in a single action to activate differential pressure attachments 4000. That is, as discussed in greater detail below, activation mechanisms are designed to transition from a disengaged state (see e.g., FIG. 29) to an engaged state (see e.g., FIG. 30) in a single action without the need for repetitious movements or action. The ability to activate the differential pressure attachments 4000 in a single action provides for ease and quickness in attachment and removal of the wake diverter 1000.

The attachment and removal of the wake diverter 1000 to and from the side of the hull of a watercraft via differential pressure attachments 4000 also reduces or eliminates any marring of the hull of the watercraft as well as the need to modify, or otherwise physically alter of the hull to enable the attachment and removal of the wake diverter 1000. The wake diverter 1000 with its differential pressure attachment (s) 4000 does not require one or more components that remain permanently or semi-permanently affixed to the watercraft's hull such as the hook structure for a hook and loop attachment or the loop structure. Further, the wake diverter 1000 with its differential pressure attachment(s) 4000 is not cumbersome and does not cover a significant area or zone of the side of the hull. In addition, the wake diverter 1000 with its differential pressure attachment(s) 4000 does not require repetitious action (or an otherwise multi-staged installation process) or precise placement. In addition, the wake diverter 1000 with its differential pressure attachment(s) 4000 is universally or near universally applicable (e.g., not boat and/or boat model specific and/or hull design and/or hull position specific) due to its design and size. Still further, the apparatus does not require other structure than the differential pressure attachment(s) to hold the apparatus to the watercraft when the watercraft has a speed sufficient to create a wake large enough for a person to wake surf on.

Figure 8:
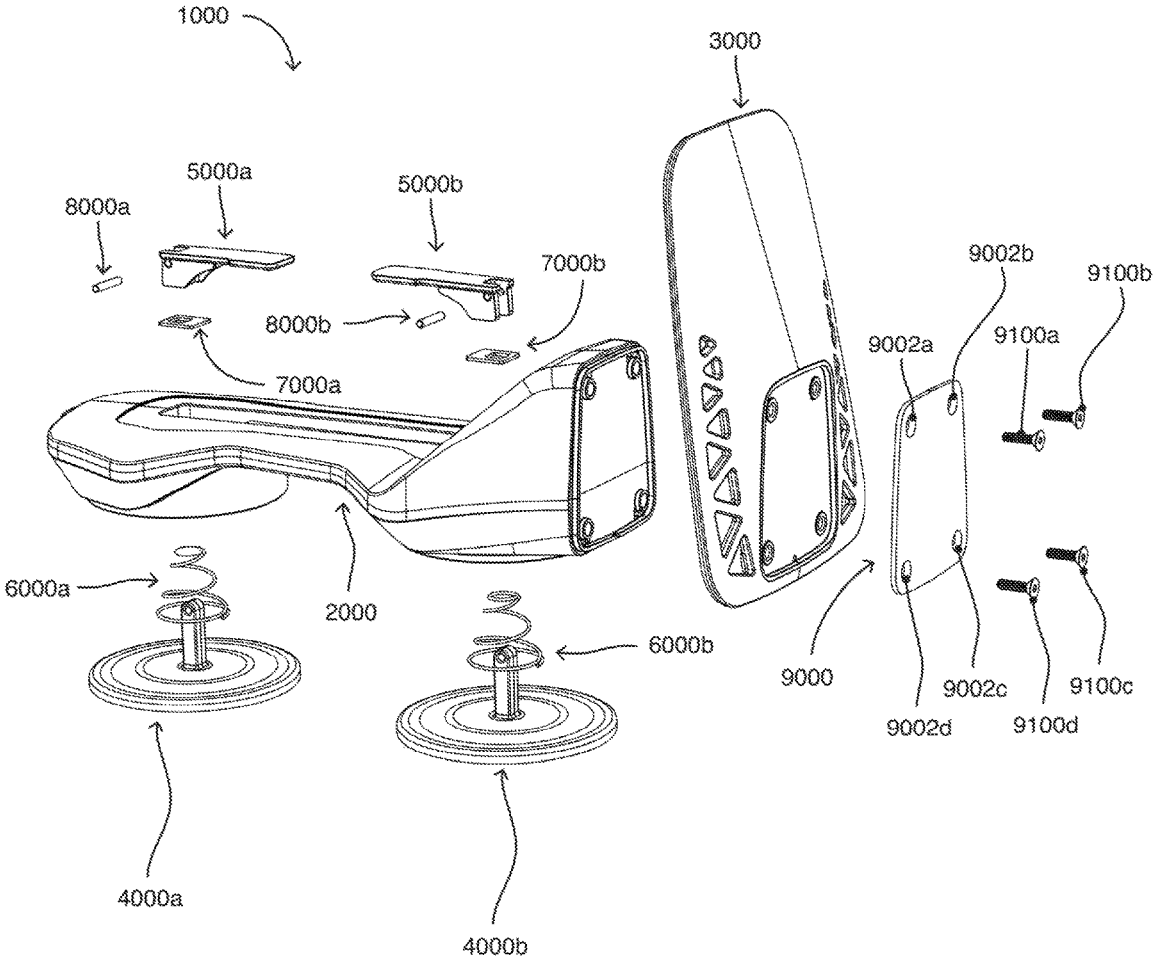
FIG. 8 illustrates an exploded view of a WAKE DIVERTER according to certain embodiments.
Figure 9:
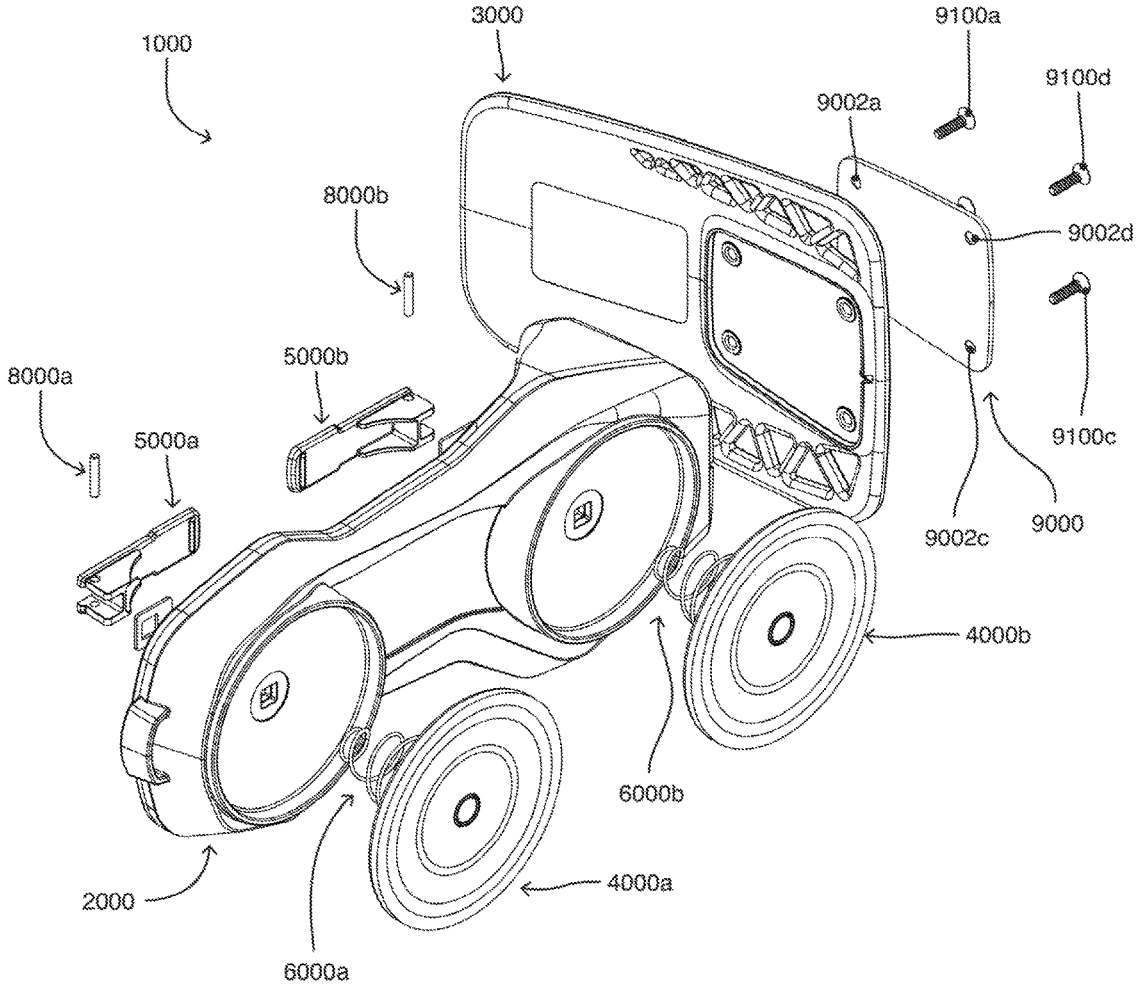
FIG. 9 illustrates an exploded view of a WAKE DIVERTER according to certain embodiments.
Figure 10:
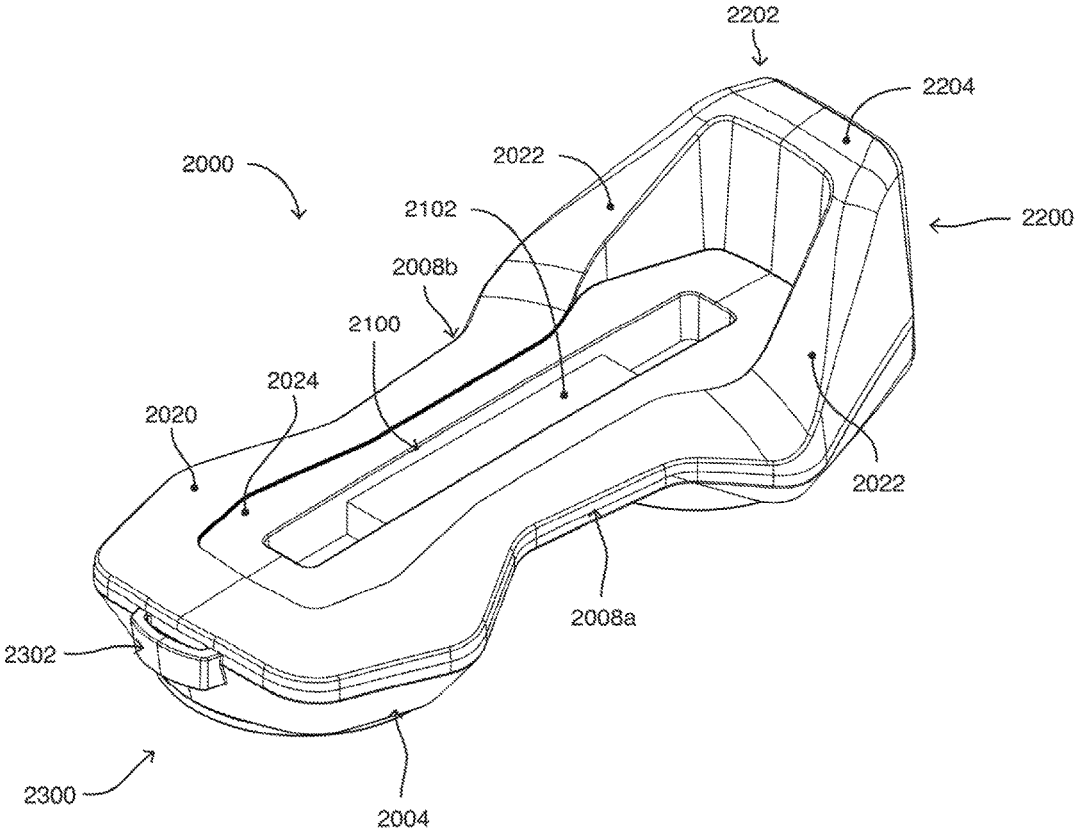
FIG. 10 illustrates a top perspective view of a body of a WAKE DIVERTER according to certain embodiments.

Referring now to FIGS. 8 and 9, exploded views of one embodiment of the wake diverter 1000 are illustrated. As illustrated, wake diverter 1000 includes a body 2000 to which a plurality of other components attach.

Referring now to FIGS. 10-18, the body 2000 of the wake diverter 1000 is illustrated. In one embodiment, body 2000 has an upper portion 2002, a side portion 2004, and a lower portion 2006. In various embodiments, upper portion 2002 includes a plurality of features including upper surfaces 2020, 2022 and 2024. In some embodiments, upper surface 2024 is bordered at least by upper surfaces 2020 and 2022. In one embodiment, a smooth transition exists between upper surfaces 2020 and 2024. In another embodiment, upper surface 2024 is recessed relative to upper surface 2020.

In some embodiments, upper portion 2002 additionally includes an activation mechanism recess 2100. In some embodiments, activation mechanism recess 2100 is formed in upper surface 2024. In one such embodiment, the activation mechanism recess 2100 is formed as a rectangularly-shaped depression in upper surface 2024 that is configured to accommodate one or more differential pressure attachment activation mechanisms 5000 (as discussed in greater detail below). For example, referring specifically to FIG. 14, activation mechanism recess 2100 includes a surface 2102, a first end 2104, and a second end 2106. In one embodiment, a recess is formed proximate each end of the activation mechanism housing 2100. For example, a first end recess 2110 is formed proximate a depression or recess in first end 2104. Similarly, a second end recess 2112 is formed proximate a depression or recess in second end 2106. As discussed in greater detail below, each of these end recesses 2110 and 2112 is configured to accommodate the one or more differential pressure attachment activation mechanisms 5000.

In various embodiments, body 2000 includes a first end 2200 and a second end 2300 situated longitudinally opposite first end 2200. In certain embodiments, body 2000 is longitudinally asymmetric, but laterally symmetric. For example, as illustrated, first end 2200 is dissimilar to second end 2200. In one embodiment, first end 2200 is partially defined by a protrusion 2202 that extends above upper surfaces 2020 and 2024 generally perpendicular to a longitudinal axis of body 2000. In one embodiment, upper surface 2022 extends between a top surface 2204 of protrusion 2202 and upper surface 2020. In one embodiment, upper surface 2022 is angled relative to upper surface 2020. In one embodiment upper surface 2022 is angled approximately forty-five degrees relative to upper surface 2020. In another embodiment, upper surface 2022 is angled as little as thirty degrees or as high as sixty degrees relative to upper surface 2020. In various embodiments, a smooth transition exists between upper surface 2020 and 2022. Likewise, in various embodiments, a smooth transition exists between upper surface 2022 and top surface 2204.

Figure 11:
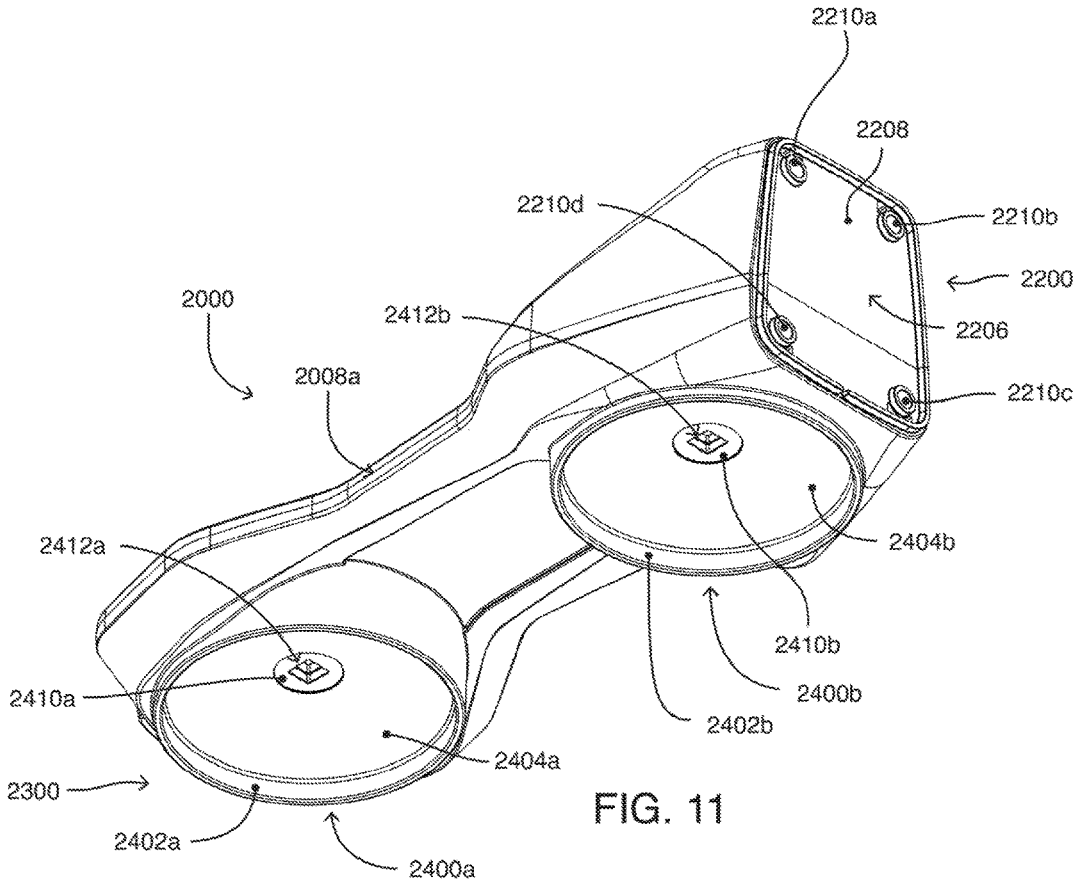
FIG. 11 illustrates a bottom perspective view of a body of a WAKE DIVERTER according to certain embodiments.
Figure 12:
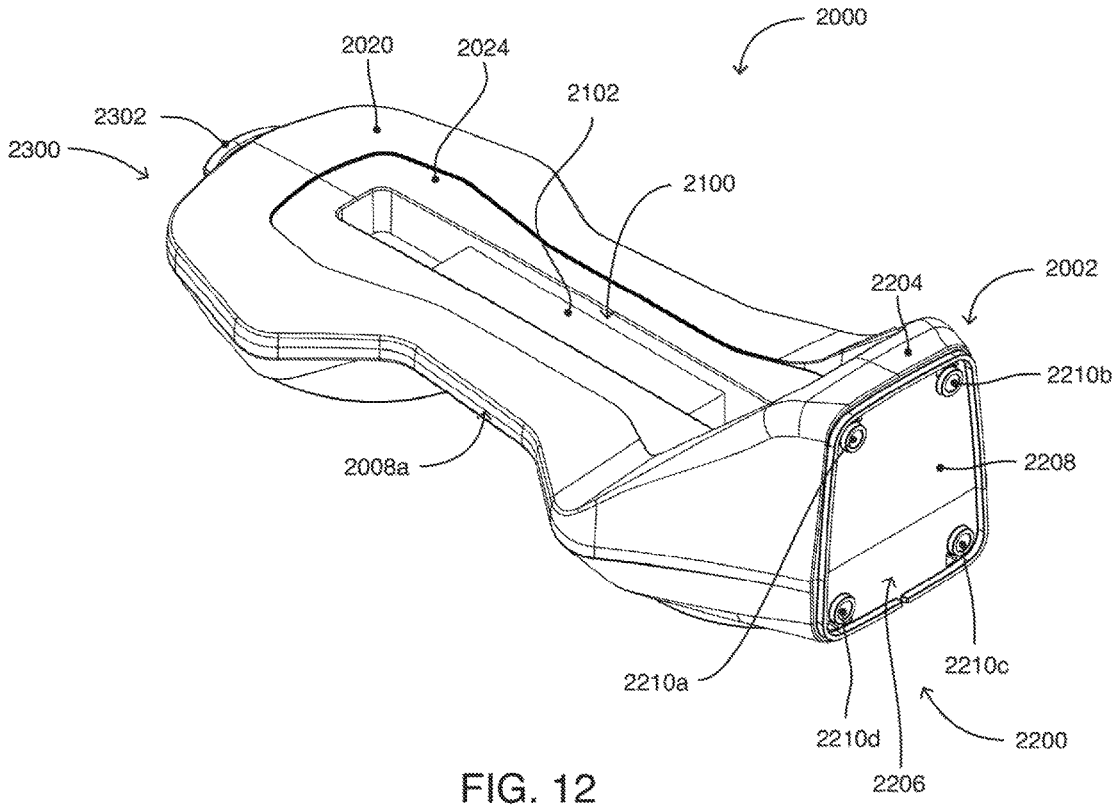
FIG. 12 illustrates a top perspective view of a body of a WAKE DIVERTER according to certain embodiments.
Figure 13:
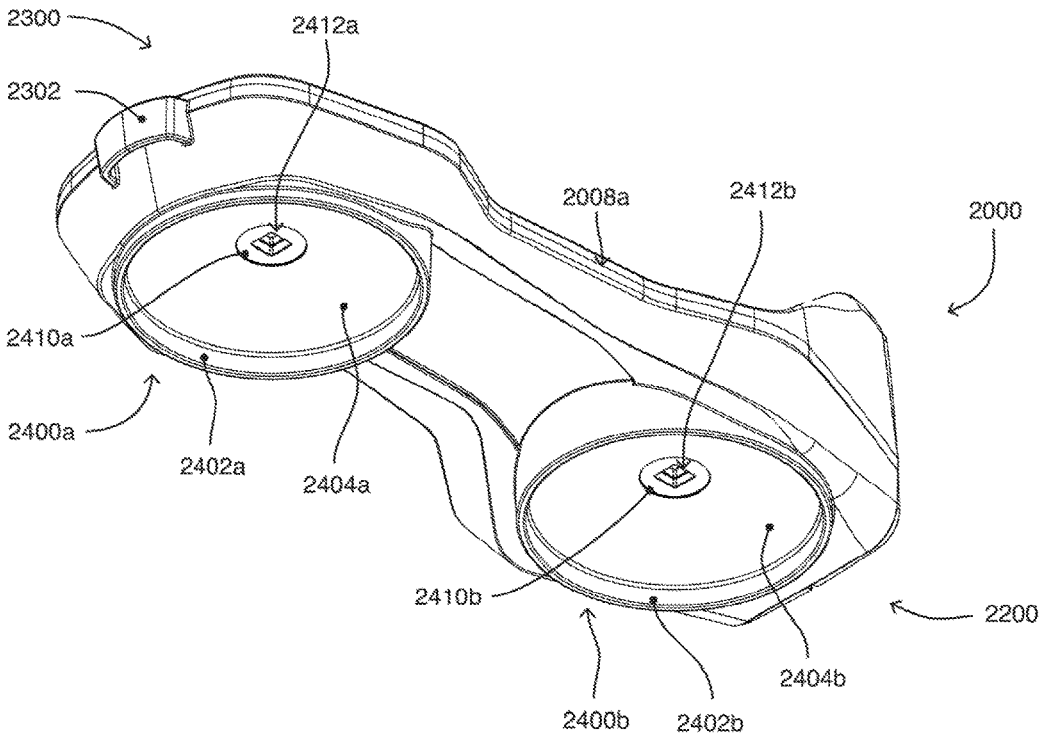
FIG. 13 illustrates a bottom perspective view of a body of a WAKE DIVERTER according to certain embodiments.
Figure 14:
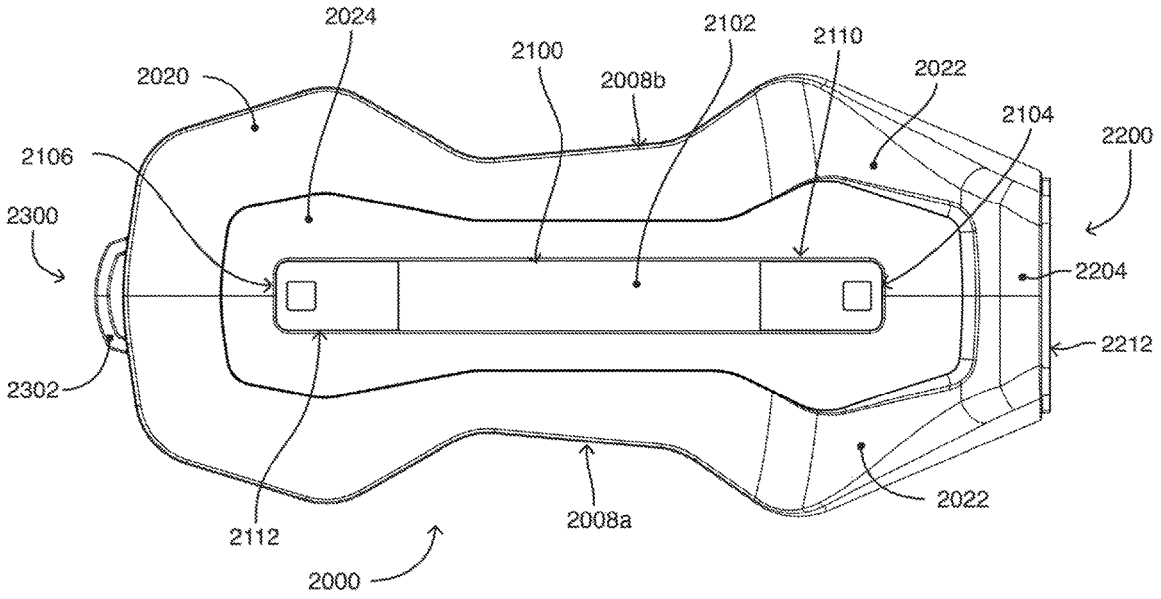
FIG. 14 illustrates a top view of a body of a WAKE DIVERTER according to certain embodiments.
Figure 15:
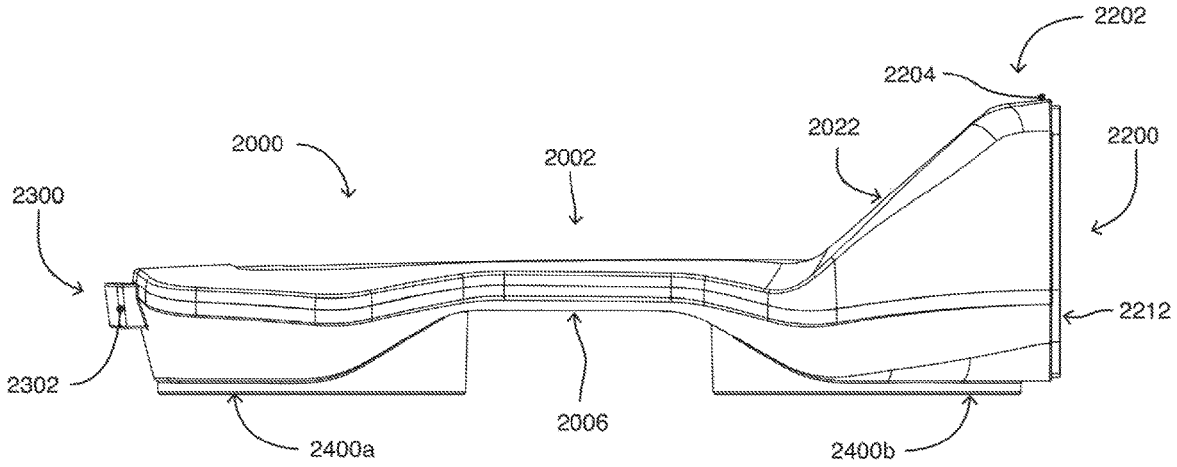
FIG. 15 illustrates a side view of a body of a WAKE DIVERTER according to certain embodiments.
Figure 16:
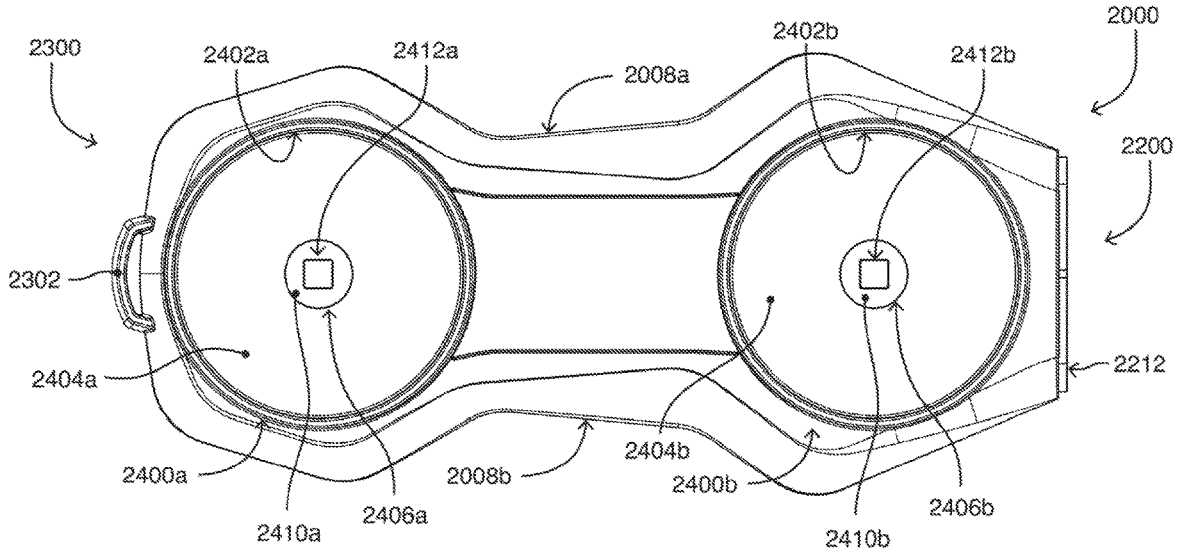
FIG. 16 illustrates a bottom view of a body of a WAKE DIVERTER according to certain embodiments.
Figure 17:
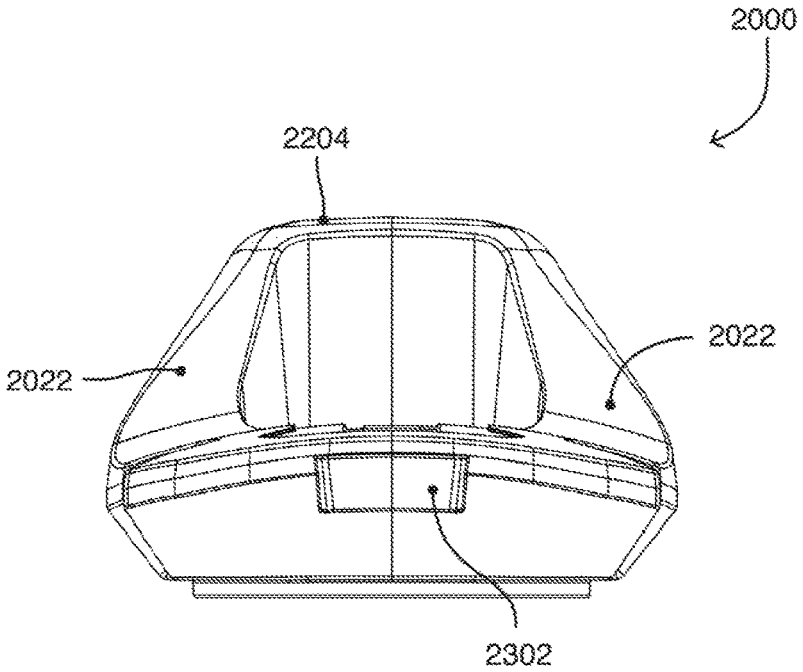
FIG. 17 illustrates a rear view of a body of a WAKE DIVERTER according to certain embodiments.
Figure 18:
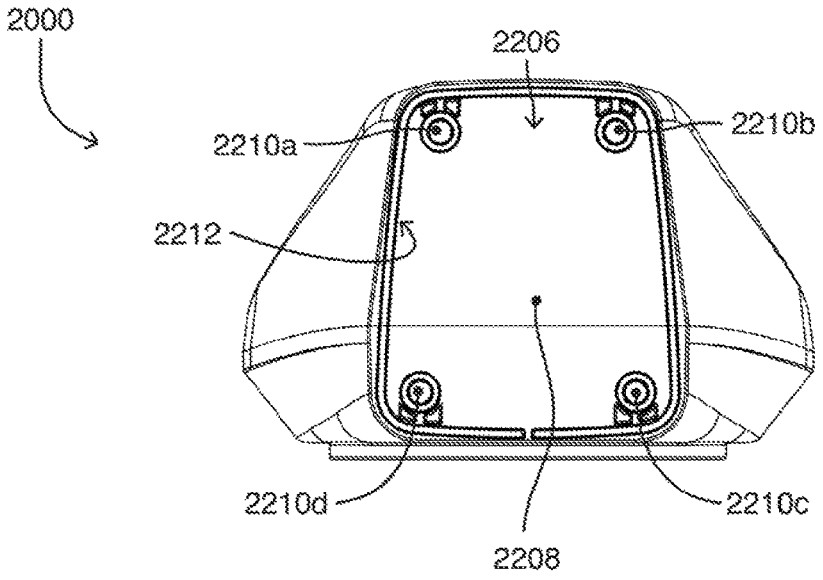
FIG. 18 illustrates a front view of a body of a WAKE DIVERTER according to certain embodiments.

In one embodiment, first end 2200 includes a panel interface portion 2206 that is configured to interface with panel 3000. In one such embodiment, panel interface portion 2206 is generally rectangular. In other embodiments, however, panel interface portion is of any suitable shape and/or size. In certain embodiments panel interface portion 2206 may taper from a lower end to an upper end as illustrated in FIGS. 11, 12, and 18, however, panel interface portion need not taper. In various embodiments, panel interface portion 2206 includes a panel interface surface 2208, and one or more panel retention features 2210, such as panel retention features 2210*a-d*.

In one embodiment, body panel interface surface 2208 is perpendicular or substantially perpendicular to the longitudinal axis of body 2000. In another embodiment, panel interface surface 2208 is angled relative to the longitudinal axis of body 2000 as explained in greater detail below. For example, panel interface surface 2208 is angled between 45 and 135 degrees relative to the longitudinal axis of body 2000.

In one embodiment, panel retention features 2210 are configured to accommodate one or more fasteners (see e.g., fasteners 9100*a-d* in FIGS. 8 and 9) as discussed in greater detail below. In one embodiment, panel retention features 2210 are threaded holes. In another embodiment, panel retention features are configured to accommodate one or more threaded inserts. In other embodiment, panel retention features 2210 are some other suitable mechanical means by which panel 3000 may be secured to body 2000. For example, as discussed below, in various alternative embodiments, a dovetail feature operates to secure panel 3000 to body 2000. In some embodiments, panel interface portion 2206 further includes a locating feature 2212 that operates to align panel 3000 with panel interface portion 2206. For example, in one embodiment, panel interface portion 2206 includes a peripheral rim 2212 that extends at least partially about a periphery of panel interface portion 2206. In one embodiment, peripheral rim 2212 is received by a portion of panel 3000 and thereby operates to properly orient panel 3000 with respect to body 2000. In addition, peripheral rim 2212 operates to secure panel 3000 from moving relative to body 2000 during operation (i.e., when wake diverter 1000 is attached to the side of a hull of a moving watercraft).

In one embodiment, the second end 2300 includes a tether interface feature 2302. In one such embodiment, a tether or lanyard is attachable to tether interface feature 2302 and further attachable to some retention feature on the watercraft, such as a tie-down or lifting eye. In operation, a tether or lanyard secured to tether interface feature 2302 operates to prevent the wake diverter 1000 from being left behind or lost in the event it becomes dislodged from the hull of the watercraft (e.g., by being struck by an object in the water).

In various embodiments, the side portion 2004 of body 2000 includes one or more tapered regions 2008 situated between the first end 2200 and the second end 2300. For example, as illustrated in at least FIGS. 10-14 and 16, tapered regions 2008*a* and 2008*b* are situated between the first end 2200 and the second end 2300. Tapered regions 2008*a* and 2008*b* provide that body 2000 is smaller in lateral width in its central region relative to its end regions. One of skill in the art will appreciate that such a configuration allows users to adequately grasp and control the body of the wake diverter 1000 when attaching or removing the wake diverter 1000 from the side of the hull of a watercraft.

In one embodiment, the lower portion 2006 of body 2000 includes one or more differential pressure attachment housings 2400, such as differential pressure attachment housings 2400*a* and 2400*b*. In one embodiment, differential pressure attachment housings 2400 are protrusions extending from a bottom portion of the body 2000 of wake diverter 1000. In another embodiment, differential pressure attachment housings 2400 are recesses formed in a bottom portion of the body 2000 of wake diverter 1000. In yet another embodiment, differential pressure attachment housings 2400 are designated areas that are configured to accommodate or otherwise operate with one or more differential pressure attachments 4000 or other watercraft attachment mechanisms.

As illustrated in FIGS. 10-18, a plurality of differential pressure attachment housings 2400*a* and 2400*b* are oriented along the lower portion 2006 of the body 2000. In one embodiment, a first one of the plurality of differential pressure attachment housings (e.g., 2400*b*) is situated proximate the first end 2200 and a second one of the plurality of differential pressure attachment housings (e.g., 2400*a*) is situated proximate the second end 2300 of body 2000. In one embodiment, the plurality of differential pressure attachment housings 2400 are aligned along the longitudinal axis of body 2000. For example, as illustrated in FIGS. 10-18, differential pressure attachment housings 2400*a* and 2400*b* are longitudinally aligned with one another.

It should be appreciated that, by longitudinally aligning differential pressure attachment housings 2400 with one another, the width of the body 2000 is minimized, which provides more versatility in watercraft application. Specifically, hull designs vary wildly from one watercraft model to another, and even vary across years of a particular model. Thus, where wake diverter 1000 is located on the side of the hull of one boat may not be a viable option for its placement on the side of the hull of another boat. In addition, placement becomes more of a challenge as the area necessary for attachment increases because watercraft hulls are generally contoured and include ridges, steps, and other features that otherwise make attachment difficult. Thus, minimizing the area necessary for attachment of the wake diverter 1000 provides for a more versatile design in that it is capable of attachment to virtually any hull design of any boat manufacturer. Such versatility in attachment and universal application is unprecedented.

In various embodiments, differential pressure attachment housings 2400 are shaped to correspond to the shape of the differential pressure attachments 4000 (see e.g., FIGS. 8-9). In one embodiment, differential pressure attachment housings 2400 are generally circular in shape of otherwise generally correspond with the shape of differential pressure attachments 4000. It should be appreciated, however, that differential pressure attachment housings 2400 may be of any suitable shape or of no particular shape at all without departing from the spirit and scope of the present application.

In one embodiment, differential pressure attachment housings 2400 include one or more interior recessed surfaces 2404, such as interior recessed surfaces 2404*a* and 2404*b*. In one embodiment, a peripheral rim 2402, such as peripheral rim 2402*a* or 2402*b* is formed about the periphery of the housing 2400. That is, peripheral rim 2402 is formed about the periphery of interior recess surface 2404. In various embodiments, peripheral rims 2402*a* and 2402*b* define a recess accommodating of differential pressure attachments 4000.

In some embodiments, differential pressure attachment 4000 is received by differential pressure attachment housing 2400. In one embodiment, differential pressure attachment housing 2400 is sized such that differential pressure attachment 4000 is received within differential pressure attachment housing 2400. In some such embodiments, peripheral rims 2402 have a height that does not exceed the thickness of the corresponding differential pressure attachment 4000 such that, during installation, the peripheral rim 2402 does not prevent differential pressure attachment 4000 from sufficiently contacting the watercraft's hull. In one such embodiment, the height of the peripheral rims 2402 is generally less than the thickness of the corresponding differential pressure attachment 4000.

In some other embodiments, differential pressure attachment 4000 is larger than differential pressure attachment housing 2400 such that a portion of the differential pressure attachment 4000 is situated between the peripheral rim 2402 and the watercraft's hull. The above-discussed configurations provide that, as wake diverter 1000 is installed on a watercraft's hull, the differential pressure attachments 4000 can maintain contact with and sufficiently seal against the watercraft's hull while differential pressure attachment activation mechanisms 5000 are engaged.

In some embodiments, interior recessed surfaces 2404 are flat and parallel relative to the longitudinal axis of the body 2000. In some other embodiments, interior recessed surfaces 2404 taper toward the top portion 2002 of body 2000 as those interior recessed surfaces 2404 are traversed from their periphery toward their centers. In these embodiments, a more central portion 2406 (e.g., 2406*a* and 2406*b*) of the interior recessed surface is closer in proximity to the upper portion 2002 of the body 2000 than is the periphery of the interior recessed surface 2404. In some such embodiments, the interior recessed surfaces 2404 are concave (See e.g., FIGS. 29-30). In other such embodiments, the interior recessed surfaces 2404 are convex. In other such embodiment, the interior recessed surfaces 2404 are concave in part and convex in part. In yet other such embodiments, the interior recessed surfaces 2404 have minimal curvature or no curvature at all while still tapering toward the top portion 2002 of body 2000. In some embodiments, the interior recessed surface of a first one of the interior recessed surfaces (e.g., 2404*a*) has a curvature different from the curvature of a second one of the interior recessed surfaces (e.g., 2404*b*).

The above-discussed tapering of the interior recessed surface 2404 provides adequate space so as to not interfere with or otherwise prevent the deflection of differential pressure attachments 4000 when wake diverter 1000 is being attached to a watercraft's hull. It should also be appreciated that, by providing a wake diverter 1000 with a plurality of differential pressure attachment housings 2400 (and thus a plurality of differential pressure attachments 4000), the wake diverter 1000 is resistant to unwanted tear-off (or detachment from the side of the hull of a watercraft while in operation) as well as resistant to unwanted relative movement (e.g., sliding and twisting, etc.) between the wake diverter 1000 and the watercraft's hull. It should be appreciated that tear-off resistance and susceptibility to relative movement are functions of surface area, and that surface area is increased by either including more differential pressure attachments or by increasing the contact surface area of each incorporated differential pressure attachments.

In one embodiment, differential pressure attachment housings 2400 include an interior reaction surface 2410 situated near the center of interior recessed surface 2404. In some embodiments, aperture 2412 is positioned in the center of interior recessed surface 2404 and reaction surface 2410. In these embodiments, aperture 2412 extends through body 2000 such that a commissure post of the differential pressure attachment 4000 can extend through the body 2000 and mate with the differential pressure attachment activation mechanism 5000 positioned within the activation mechanism housing 2100 (as discussed below). In one embodiment, aperture 2412 and aperture 2120 are the same. In one embodiment, reaction surface 2410 operates as a reaction surface for a spring (e.g., spring 6000) or other influencing mechanism situated between differential pressure attachment 4000 and body 2000.

In some embodiments, a first one of the differential pressure attachment housings (e.g., 2400*a*) may be of a different shape or of a different size than a second one of the differential pressure attachment housings (e.g., 2400*b*). In short, under different operating conditions, different portions of the wake diverter 1000 may subjected to different forces (in both magnitude and direction). Thus, the size and shape (and material properties, see below) of the wake diverter 1000 are designed based on the anticipated forces.

Referring now to FIGS. 19-26, a panel 3000 of wake diverter 1000 is illustrated. In one embodiment, panel 3000 is generally rectangular in shape and includes a forward side 3002, a rearward side 3004, a top portion 3006, a bottom portion 3008, a plurality of side portions 3010, (e.g., 3010*a* and 3010*b*), and a peripheral edge 3012. In some embodiments, forward side 3002 includes a forward surface 3100. In some embodiments, the panel 3000 includes one or more apertures 3200, such as apertures 3200*a-h*. In some embodiments, rearward side 3004 includes a rearward surface 3300. Additionally, in some embodiments, forward side 3002 includes a body interface portion 3400 that operates to facilitate coupling of the panel 3000 to the body 2000 in a first configuration. Similarly, in some embodiments, rearward side 3004 includes a body interface portion 3500 that operates to facilitate coupling of the panel 3000 to the body 2000 in a second configuration. In some embodiments, peripheral edge 3012 operates to connect forward surface 3300 with reward surface 3500.

In one embodiment, panel 3000 tapers from the bottom portion 3008 to the top portion 3006 such that a distance from a first side portion 3010*a* to a second side portion 3010*b* along the top portion 3006 is less than a distance from the first side portion 3010*a* to the second side portion 3010*b* along the bottom portion 3008. In another embodiment, panel 3000 tapers from the bottom portion 3008 to the top portion 3006 such that a distance from a first side portion 3010*a* to a second side portion 3010*b* along the top portion 3006 is greater than a distance from the first side portion 3010*a* to the second side portion 3010*b* along the bottom portion 3008. In yet another embodiment, panel 3000 does not taper from the bottom portion 3008 to the top portion 3006. In various embodiments, smooth radii operate to transition the peripheral edge 3012 of the side portions 3010 to the peripheral edged 3012 of the top and bottom portions 3006 and 3008.

In one embodiment, as mentioned above, panel 3000 includes a one or more body interface portions. In one embodiment, the rearward side 3004 of panel 3000 includes a body interface portion 3500. In one embodiment, body interface portion 3500 facilitates attachment of panel 3000 to body 2000. In one embodiment, body interface portion 3500 includes a peripheral edge 3502 and an interface surface 3504. In one embodiment, interface surface 3504 is recessed relative to rearward surface 3300 (see e.g., FIG. 25). In another embodiment, interface surface 3504 is a continuation of rearward surface 3300.

In various embodiments, including those discussed above, interface surface 3504 is complimentary of panel interface portion 2206 of body 2000. In various embodiments, body interface portion 3500 is complimentary to panel interface portion 2206 such that body 2000 and panel 3000 may be coupled together. For example, as discussed above, in various embodiments, body 2000 includes a panel interface portion 2206 having a peripheral rim 2212. In some such embodiments, peripheral rim 2212 of body 2000 is received by panel interface portion 3500. For example, peripheral rim 2212 is received within a recess formed by recessed interface surface 3504. In this example, peripheral rim 2212 and peripheral edge 3502 are concentric, and peripheral rim 2212 is situated interior to peripheral edge 3502. In one embodiment, peripheral rim 2212 has a height (e.g., measured from interface surface 2208 of interface portion 2206) that is complementary to the depth by which interface surface 3504 is recessed into rearward surface 3300 of panel 3000. In one embodiment, peripheral rim 2212 and peripheral edge 3502 operate to properly orient panel 3000 with body 2000 when they are coupled. It should be appreciated that such a configuration provides for a secure coupling of panel 3000 to body 2000, which operates to minimize or even eliminate relative movement between body 2000 and panel 3000 during normal operating conditions (e.g., attachment to a watercraft traveling through water).

In one embodiment, interface surface 3504 includes one or more apertures 3506, which extend through panel 3000 from the rearward side 3004 to the forward side 3002. For example, as illustrated, a plurality of apertures 3506*a-d* are formed in interface surface 3504. In some embodiments, apertures 3500 are through-holes configured to accommodate a mechanical fastener. In some embodiments, when panel 3000 is properly aligned with and coupled to body 2000 apertures 3506*a-d* of panel 3000 are axially aligned with apertures 2210*a-d* of body 2000.

In various embodiments, the forward side 3004 of panel 3000 similarly includes a body interface portion 3400. In one embodiment, body interface portion 3400 facilitates attachment of panel 3000 to body 2000. In one embodiment, body interface portion 3400 includes a peripheral edge 3402 and an interface surface 3404. In one embodiment, interface surface 3404 is recessed relative to forward surface 3100 (see e.g., FIG. 25). In another embodiment, interface surface 3404 is a continuation of forward surface 3100.

In various embodiments, including those discussed above, interface surface 3404 is complimentary of panel interface portion 2206 of body 2000. In various embodiments, body interface portion 3400 is complimentary to panel interface portion 2206 such that body 2000 and panel 3000 may be coupled together. For example, as discussed above, in various embodiments, body 2000 includes a panel interface portion 2206 having a peripheral rim 2212. In some such embodiments, peripheral rim 2212 of body 2000 is received by panel interface portion 3400. For example, peripheral rim 2212 is received within a recess formed by recessed interface surface 3404. In this example, peripheral rim 2212 and peripheral edge 3402 are concentric in that peripheral rim 2212 is situated interior to peripheral edge 3402. In one embodiment, peripheral rim 2212 has a height (e.g., measured from interface surface 2208 of interface portion 2206) that is complementary to the depth by which interface surface 3404 is recessed into forward surface 3100 of panel 3000. Thus, in light of the above, peripheral rim 2212 of body may be received by either panel interface portion 3400 or panel interface portion 3500, depending on the desired panel/body configuration. In one embodiment, peripheral rim 2212 and peripheral edge 3402 operate to properly orient panel 3000 with body 2000 when they are coupled. It should be appreciated that such a configuration provides for a secure coupling of panel 3000 to body 2000, which operates to minimize or even eliminate relative movement between body 2000 and panel 3000 during normal operating conditions (e.g., attachment to a watercraft traveling through water).

In one embodiment, interface surface 3404 includes one or more apertures 3406, which extend through panel 3000 from the forward side 3002 to the rearward side 3002. For example, as illustrated, a plurality of apertures 3406*a-d* are formed in interface surface 3404. In some embodiments, apertures 3500 are through-holes configured to accommodate a mechanical fastener. In some embodiments, apertures 3406*a-d* and aperture 3506*a-d* are one-and-the-same. In some embodiments, when panel 3000 is properly aligned with and coupled to body 2000 apertures 3506*a-d* of panel 3000 are axially aligned with apertures 2210*a-d* of body 2000.

In one embodiment, panel 3000 includes one or more apertures 3200. In one embodiment, the one or more apertures 3200 extend through panel 3000 (see e.g., FIG. 25) from the forward side 3002 to the rearward side 3004. For example, as illustrated in FIGS. 19-26 a plurality of apertures 3200*a-h* are formed in panel 3000. In one embodiment, apertures 3200 are generally triangular. In another embodiment, apertures 3200 are circular. In another embodiment, apertures 3200 may be of any shape or of no particular shape without departing from the scope or spirit of the disclosure. In yet other embodiments, the apertures 3200 may be of any combination of circles, squares, rectangles, triangles or any other shapes. In some embodiments, each of the apertures 3200 are of a similar shape and size and are similarly oriented. In other embodiments, one or more of the apertures 3200 differ in shape and/or size and/or orientation relative to each of the other apertures 3200. In yet other embodiments, each aperture 3200 differs in shape and/or size and/or orientation relative to each other aperture 3200.

Figure 19:
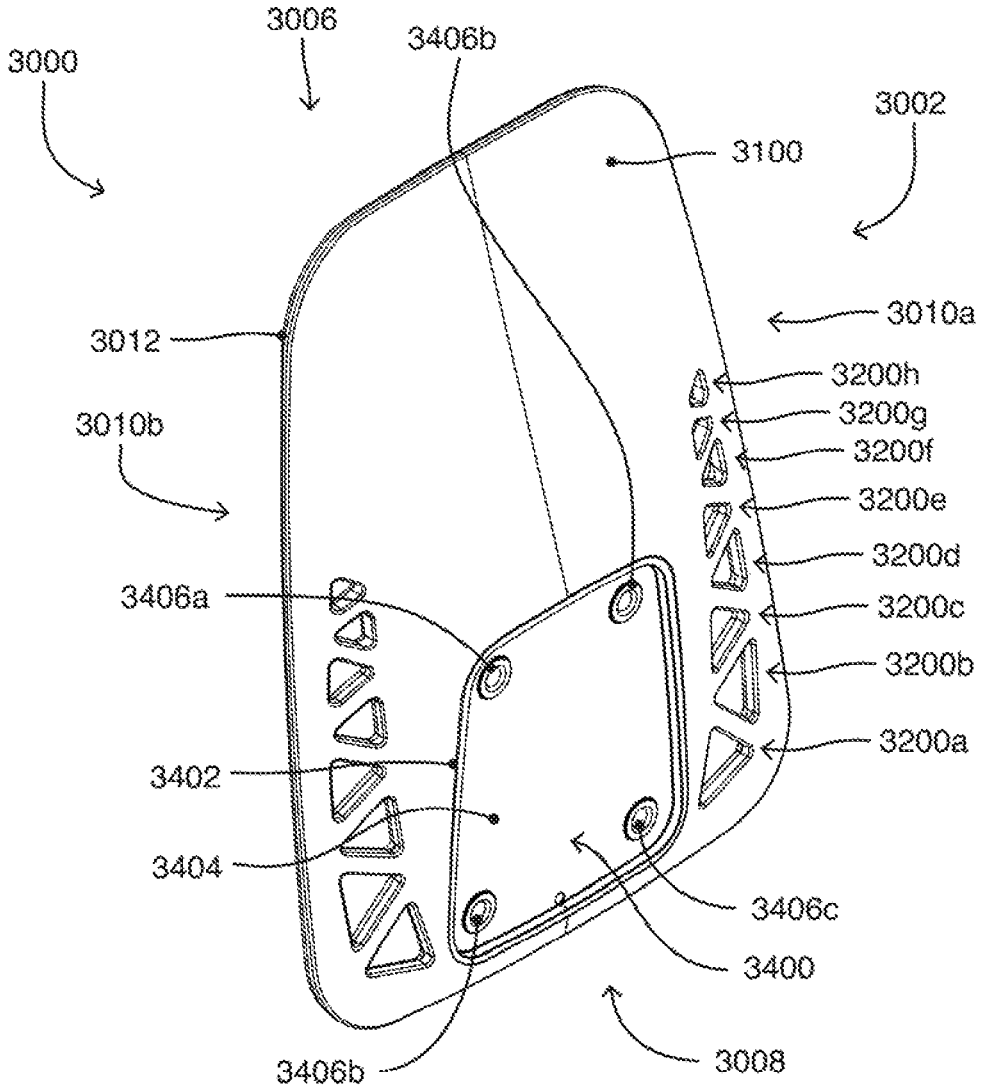
FIG. 19 illustrates a front, perspective view of a panel of a WAKE DIVERTER according to certain embodiments.
Figure 20:
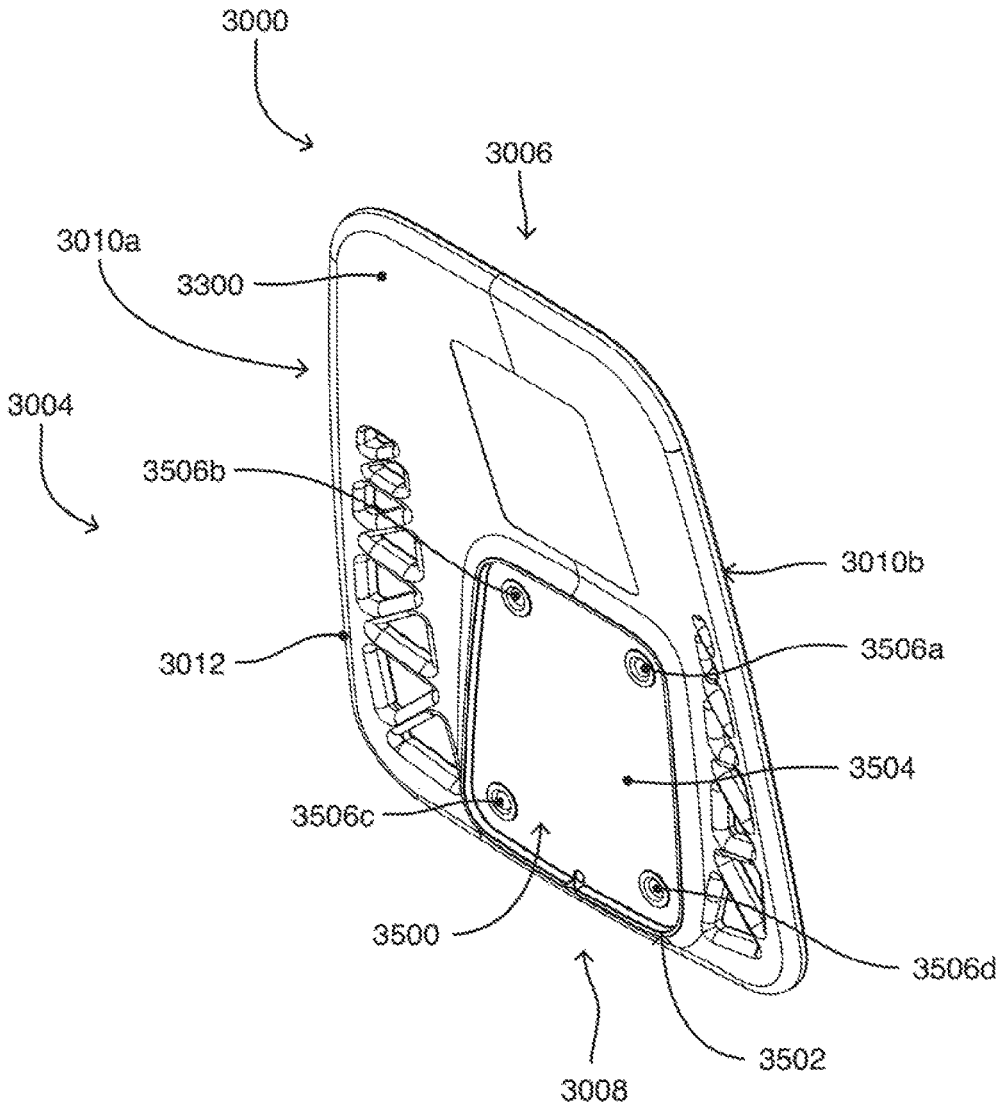
FIG. 20 illustrates a back, perspective view of a panel of a WAKE DIVERTER according to certain embodiments.
Figure 21:
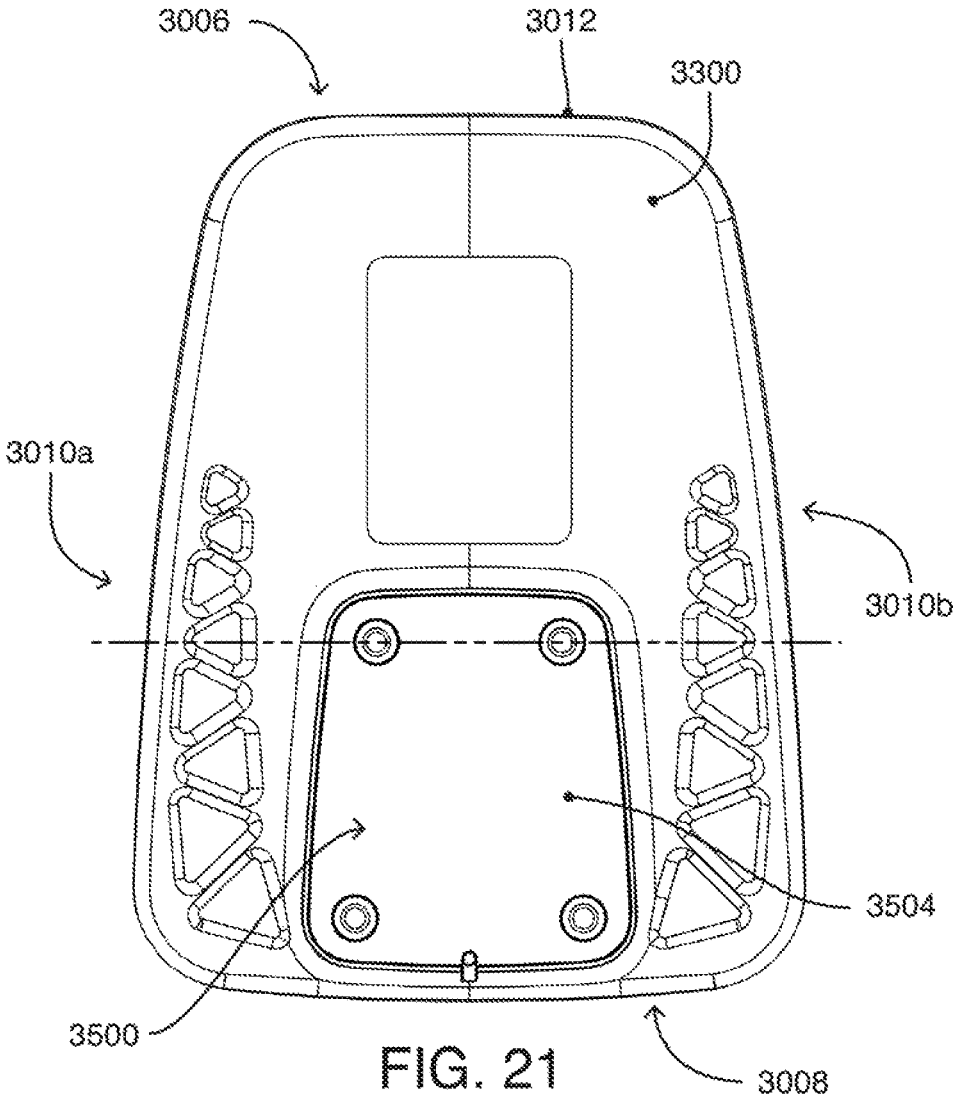
FIG. 21 illustrates a back view of a panel of a WAKE DIVERTER according to certain embodiments.
Figure 25:
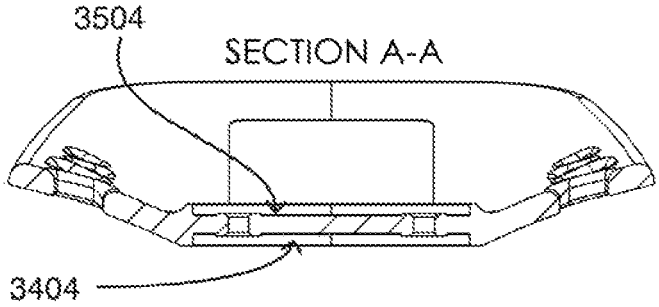
FIG. 25 illustrates a section view A-A of a panel of a WAKE DIVERTER according to certain embodiments.
Figure 22:
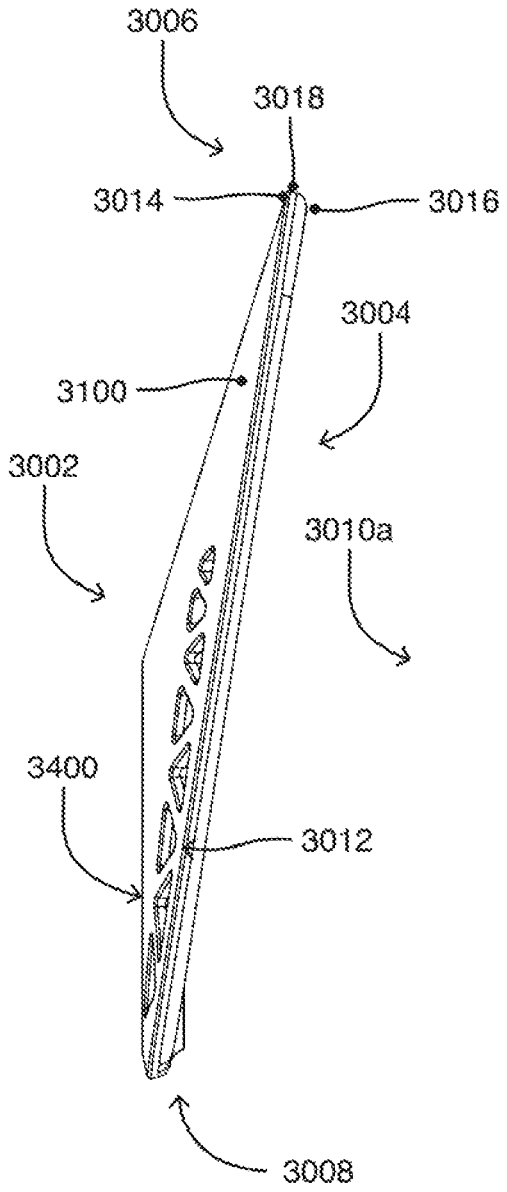
FIG. 22 illustrates a side view of a panel of a WAKE DIVERTER according to certain embodiments.
Figure 23:
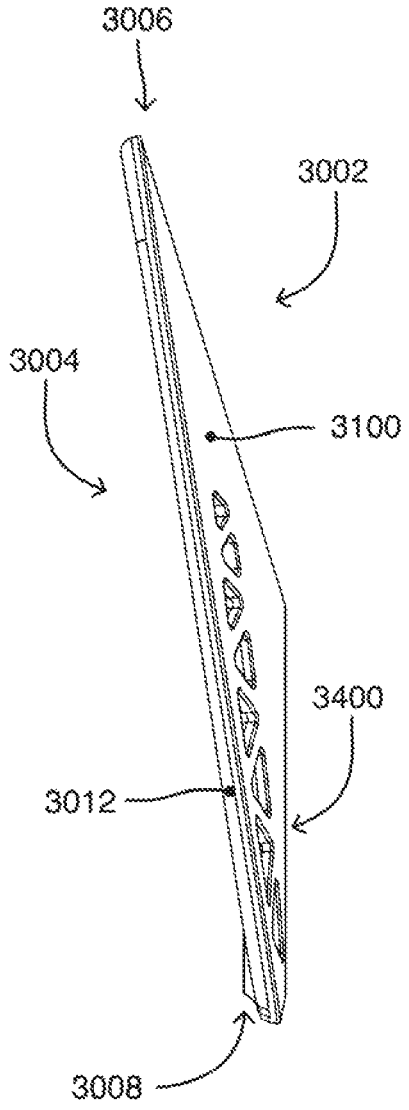
FIG. 23 illustrates a side view of a panel of a WAKE DIVERTER according to certain embodiments.
Figure 24:
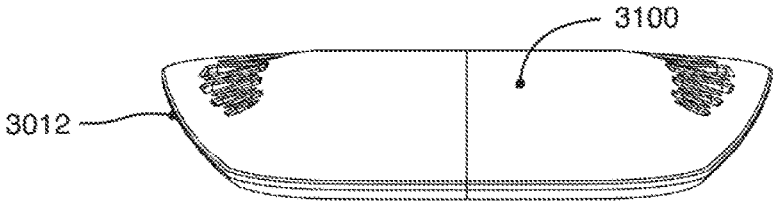
FIG. 24 illustrates a top view of a panel of a WAKE DIVERTER according to certain embodiments.
Figure 26:
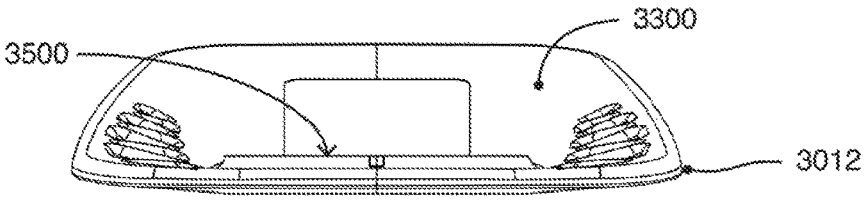
FIG. 26 illustrates a bottom view of a panel of a WAKE DIVERTER according to certain embodiments.
Figure 27A:
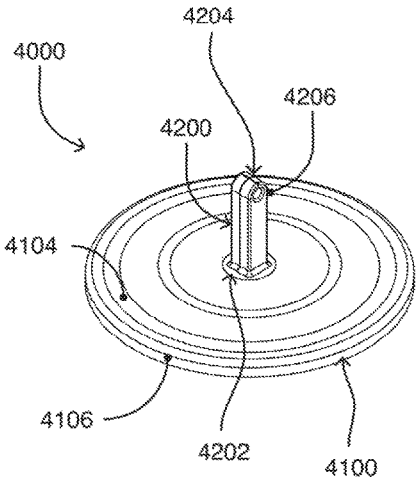
FIGS. 27A-27E illustrate various views of a differential pressure attachment of a WAKE DIVERTER according to certain embodiments.
Figure 27B:
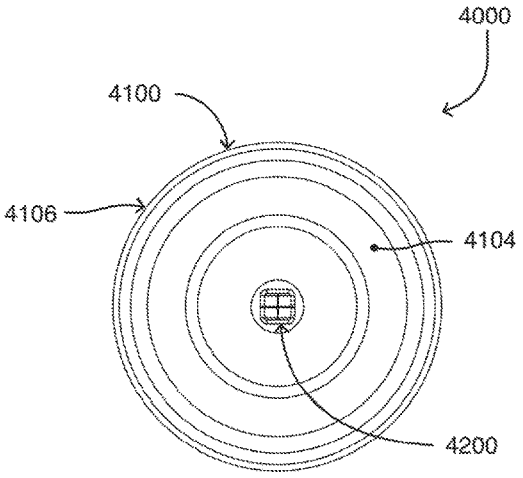
Figure 27C:
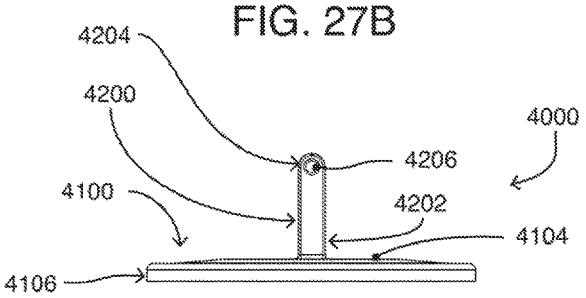
Figure 27D:
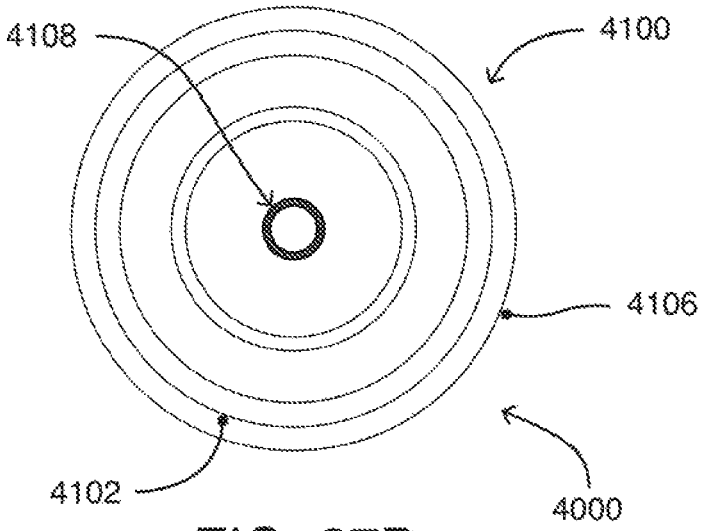
Figure 27E:
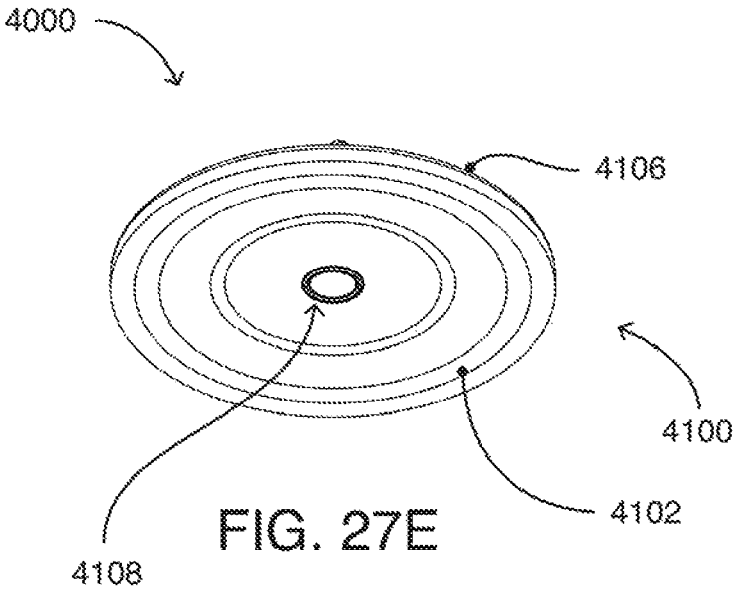

As illustrated in FIG. 19, in one embodiment, apertures 3200 are positioned proximate to and are aligned with the peripheral edge 3012 of the side portions 3010 of panel 3000. For example, as illustrated in at least FIG. 19, apertures 3200*a-h* are positioned proximate a first side portion 3010*a* and bottom portion 3008, and are generally aligned vertically along a portion of the peripheral edge 3012 of side portion 3010*a*. Additionally, as illustrated, while each aperture 3200 is generally triangular, one or more of the apertures 3200 differ in size and orientation. For example, aperture 3200*a* is larger than aperture 3200*h*, and aperture 3200*a* is oriented differently relative to aperture 3200*h*.

In some embodiments, panel 3000 is laterally symmetrical about a centerline of panel 3000 traversing from the bottom portion 3008 to the top portion 3006. In such embodiments, a similar combination of apertures are positioned proximate a second side portion 3010*b* and bottom portion 3008, and are aligned vertically along a portion of the peripheral edge 3012 (see e.g., FIG. 19). In various embodiments, apertures 3200 operate to minimize splashing water as the watercraft travels through the water with the wake diverter 1000 attached to a side of its hull. In addition, while the examples discussed herein illustrate a panel 3000 including one or more apertures 3200, it should be appreciated that, in certain embodiments, panel 3000 is constructed without any apertures 3200 whatsoever. Such a configuration has more surface area and operates to deflect more water.

In some embodiments, rearward side 3004 includes a rearward surface 3300 such that rearward surface 3300 is generally parallel to forward surface 3100. In such embodiments, a thickness of the panel measured between forward surface 3100 and rearward surface 3300 is generally constant. In other embodiments, rearward surface 3300 and forward surface 3100 are not generally parallel, but are instead angled relative to one another. In one such embodiment, rearward surface 3300 and forward surface 3100 are angled relative to one another such that the thickness measured between the rearward surface 3300 and forward surface 3100 generally increases with an increase in distance from the peripheral edge 3012. In one embodiment, the panel 3000 is generally thickest in an area proximate body interface portions 3400 and 3500, and thinnest along peripheral edge 3012.

In the illustrated examples of FIGS. 19-26, because body interface portions 3400 and 3500 are situated more proximate the bottom portion 3008 than the top portion 3006, panel 3000 increases in thickness from top portion 3006 to body interface portions 3400 and 3500 at a more gradual rate than panel 3000 increases in thickness from bottom portion 3008 to interface portions 3400 and 3500. In one embodiment, panel 3000 increases in thickness from the first side portion 3010*a* to interface portions 3400 and 3500 at generally the same rate as panel 3000 increases in thickness from the second side portion 3010*b* to interface portions 3400 and 3500.

In various embodiments, a smooth transition exists between forward surface 3100 and rearward surface 3300 along the peripheral edge 3012 of panel 3000. In one embodiment, one or more transition surfaces, such as transition surfaces 3014, 3016 and 3018 facilitate such a transition. In one embodiment, transition surface 3014 has a radius of curvature. In another embodiment, transition surface 3014 has generally no radius of curvature, but is instead angled relative to forward surface 3100. In one embodiment, transition surface 3016 has a radius of curvature. In another embodiment, transition surface 3016 has generally no radius of curvature, but is instead generally angled relative to surface 3014. In one embodiment, transition surface 3018 has a radius of curvature. In another embodiment, transition surface 3018 has generally no radius of curvature, but is instead angled relative to rearward surface 3100. In one embodiment, the radius of transition surface 3014 is smaller than the radius of transition surface 3016. In another embodiment, the radius of transition surface 3014 is less than the radius of transition surface 3016. In yet another embodiment, the radii of transition surfaces 3014 and 3016 are generally equivalent.

In some embodiments, the width of transition surface 3018 is generally the difference between the cumulative radius of transition surfaces 3014 and 3016 and the thickness of panel 3000 at the peripheral edge. In one embodiment, the radii of transition surfaces 3014 and 3016 remain generally consistent about the peripheral edge 3012 of panel 3000. In another embodiment, the radii of transition surfaces 3014 and 3016 change as the peripheral edge 3012 of panel 3000 is traversed.

In one embodiment, the forward surface 3100 is generally conically shaped or arced or is otherwise non-planar. For example, referring now to FIGS. 21-26, the peripheral edge 3012 of at least the top portion 3006 and the side portions 3010 is longitudinally offset relative to a peripheral edge 3402 of body interface portion 3400. In one embodiment, the forward surface 3100 has general convexity as the forward surface 3100 of panel 3000 is traversed from top portion 3006 to the bottom portion 3008. In some embodiments, forward surface 3100 additionally or alternatively has general convexity as the forward surface 3100 of panel 3000 is traversed from the first side 3010*a* to the second side 3010*b*.

In one embodiment, instead of following an arc, forward surface 3100 is generally angled relative to body interface portions 3400 and 3500. In these embodiments, the peripheral edge 3012 of at least the top portion 3006 and the side portions 3010 is longitudinally offset relative to a peripheral edge 3402 of body interface portion 3400 such that the forward surface 3100 is angled relative to an interface surface 3406 of body interface portion 3400. In one embodiment, forward surface 3100 is angled relative to the interface surface 3406 of body interface portion 3400 between approximately ten to fifteen degrees. In another embodiment, forward surface 3100 is angled relative to the interface surface 3406 of body interface portion 3400 between approximately zero and forty-five degrees. However, in other embodiments, forward surface 3100 is not angled relative to the interface surface 3406 of body interface portion 3400, but is instead planer with the interface surface 3406 of body interface portion 3400.

It should be appreciated that the rearward surface 3300 generally compliments forward surface 3100 as discussed in detail above. Thus, for example, where forward surface 3100 is generally convex, rearward surface 3300 is generally concave. Likewise, where forward surface 3100 is angled relative to the interface surface 3406 of body interface portion 3400, the rearward surface 3300 is also angled relative to the interface surface 3406 of body interface portion 3400. Similarly, where the forward surface 3100 is generally non-curved or linear, the rearward surface 3300 is also generally non-curved or linear. It will be appreciated however, that, in various embodiments, there is no requirement that the forward and rearward surfaces 3100 and 3300 generally complement one another. Indeed, in various embodiment, the forward and rearward surfaces 3100 and 330 may each be concave or convex. Likewise, the forward surface 3100 may be non-curved while the rearward surface 3100 is curved (e.g., concave, convex, or irregular), or vice versa. Additionally, in some embodiments, the forward and rearward surfaces 3100 and 3300 may be angles relative to one another such that they converge proximate the top portion 3006, the bottom portion 3008, and/or the side portions of the panel, or alternatively diverge proximate the top portion 3006, the bottom portion 3008, and/or the side portions of the panel. In some embodiments, one of the forward and rearward surfaces 3100 and 3300 may be curved while the other of the forward and rearward surfaces 3100 and 3300 is non-curved. While certain of the above-referenced embodiments described one or more of the forward and rearward surfaces 3100 and 3300 as being generally concave or convex, it will be appreciated that one or more of the forward and rearward surfaces 3100 and 3300 have compound curvatures in that they are concave along a first portion of that surface and convex along a second portion of that surface.

In some embodiments, panel 3000 is coupled to body 2000 such that forward surface 3100 faces away from body 2000 (i.e., panel interface portion 2006 of body 2000 interfaces with body interface portion 3500 of panel 3000). In one such embodiment, forward surface 3100 generally slopes toward the body 2000 (see FIGS. 1-6). In this configuration, when the wake diverter 1000 is attached to the side of the hull of a watercraft and the watercraft is moving in a forward direction, the flow of water along the side of the watercraft to which the wake diverter 1000 is attached first encounters the forward surface 3100 of panel 3000 before encountering any portion of body 2000.

In some other embodiments, panel 3000 is coupled to body 2000 such that forward surface 3100 faces body 2000 (i.e., panel interface portion 2006 of body 2000 interfaces with body interface portion 3400 of panel 3000). In one such embodiment, forward surface 3100 generally slopes away from the body 2000 (see FIGS. 1-6). In this configuration, when the wake diverter 1000 is attached to the side of the hull of a watercraft and the watercraft is moving in a forward direction, the flow of water along the side of the watercraft to which the wake diverter 1000 is attached first encounters the body 2000 before encountering the forward surface 3100 of panel 3000 (see e.g., FIGS. 31-35).

As explained above, in various embodiments, the panel 3000 is angled relative to the longitudinal axis of the body 2000. In some such embodiment, the panel 3000 is angled relative to the longitudinal axis of the body 2000 such that the relative angle between the forward surface 3100 of the panel 3000 and the longitudinal axis of the body 2000 is between 45 degrees and 135 degrees. However, given that the differential pressure attachments are capable of maintaining a position of the water diverter along the hull of the watercraft while the watercraft is operated at speeds suitable for wake surfing (e.g., between 5 and 15 miles per hour), it will be appreciated that the panel may be angled relative to the body at any angle, including an angle between 0 and 45 degrees and between 135 and 180 degrees. For example, the panel may be angled relative to the body such that the relative angle between the forward surface 3100 of the panel 3000 and the longitudinal axis of the body 2000 is between 15 and 45 degrees. In these and other examples, those of skill in the art should appreciate that changing the angle of the panel (e.g., an attack angle) is generally associated with a corresponding change in surface area (or effective surface area) of the panel causing a disruption to or introducing turbulence to the water. Accordingly, in some examples, lowering the attack angle away from perpendicular requires an increase in panel size (e.g., area) to maintain a common effective surface area. An effective surface area that is too small will fail to introduce a desirable degree of turbulence or disruption to the water to achieve a desirable surf wave.

It will be appreciated that, although the panel 3000 may include some curvature to its forward and/or rearward surfaces 3100 and 3300, the angles referred to herein may be generally considered in such instances to be a measure between the longitudinal axis of the body and some transverse plane of the panel, such as a transverse plane situated between the forward and rearward surfaces 3100 and 3300 that intersects the sides portions 3010*a* and 3010*b* of the panel.

In some embodiments, the angle at which the forward surface 3100 of panel 3000 is angled relative to the longitudinal axis of body 2000 is between 75 degrees and 105 degrees. In some embodiments, the forward surface 3310 may be perpendicular or substantially perpendicular to the longitudinal axis of body 2000 such as by being at or near 90 degrees. For example, forward surface 3310 may be angled relative to the longitudinal axis of body 2000 in the range of between 80 and 100 degrees or 85 and 95 degrees or 80 and 100 degrees. In embodiments in which the body 2000 is parallel or substantially parallel to the portion of the hull to which the diverter 1000 is attached, the relative angle between the forward surface 3100 and the longitudinal axis of the body 2000 is as a result the same or approximately the same as the relative angle between the forward surface 3100 and the portion of the hull to which the diverter 1000 is attached. In other embodiments in which the body 2000 is not parallel or substantially parallel to the portion of the hull to which the diverter 1000 is attached, the diverter 1000 can be configured such that the relative angles discussed herein are between the forward surface 3100 and the portion of the hull to which the diverter 1000 is attached.

In some embodiments, the forward surface 3100 of the panel 3000 is substantially perpendicular to the body 2000 provided that the forward surface 3100 is closer to perpendicular than it is to parallel relative to the longitudinal axis of the body 2000. In some embodiments, the forward surface 3100 of the panel 3000 is substantially perpendicular to the body 2000 provided that the forward surface 3100 is within 30 degrees of being perpendicular (e.g., 90 degrees±30 degrees). In some embodiments, the forward surface 3100 of the panel 3000 is substantially perpendicular to the body 2000 provided that the forward surface 3100 is within 15 degrees of being perpendicular (e.g., 90 degrees±15 degrees). In some embodiments, the forward surface 3100 of the panel 3000 is substantially perpendicular to the body 2000 provided that the forward surface 3100 is within 5 degrees of being perpendicular (e.g., 90 degrees±5 degrees). Thus, in some embodiments, reference to the panel being substantially perpendicular relative to the body 2000 (or even the side of the hull of the watercraft, as highlighted below), is a reference to the forward surface 3100 of the panel 3000 being within a designated degree range relative to perpendicular.

Those of skill in the art will appreciate that the angle at which the panel 3000 extends from the body 2000 has a substantial effect on the forces acting on the differential pressure attachments. The differential pressure attachments counteract such forces in order for the water diverter 1000 to both remain attached to, and maintain its position along, the side of the hull of the boat to which it is attached.

Figure 29:
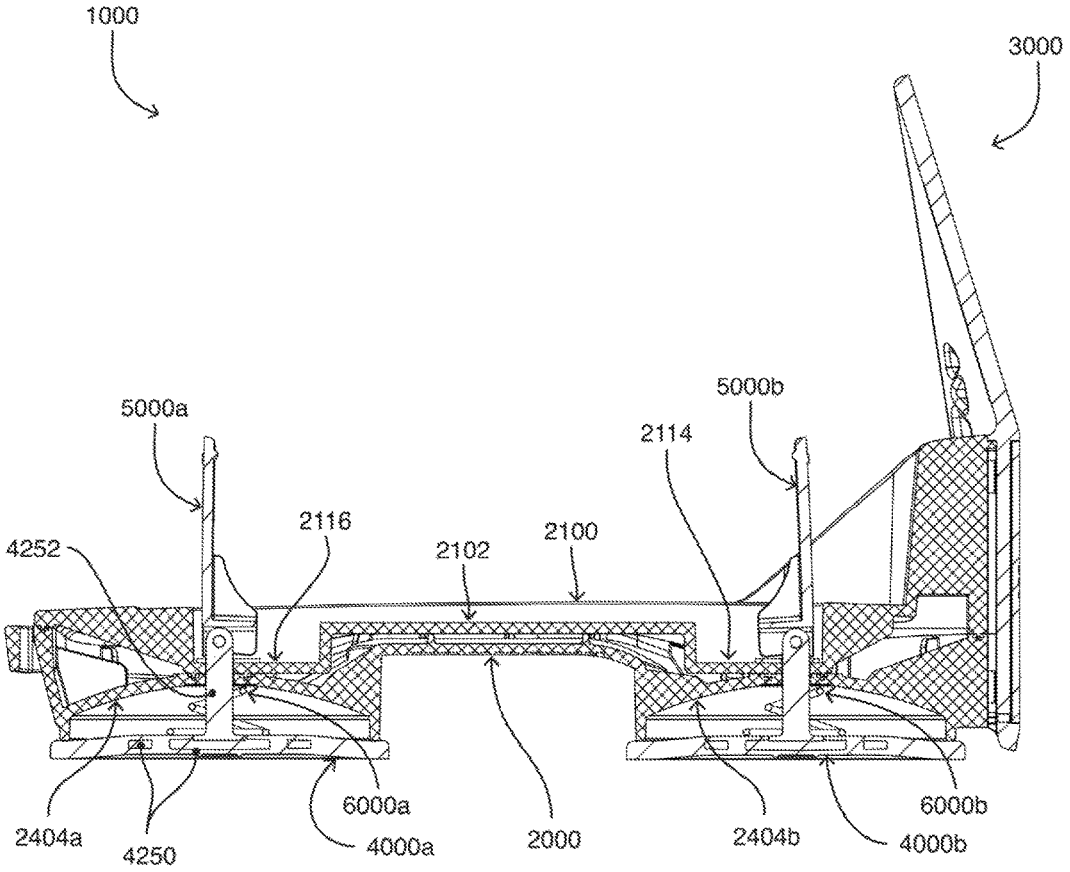
FIG. 29 illustrates a longitudinal cross section view of a WAKE DIVERTER in a disengaged position.
Figure 30:
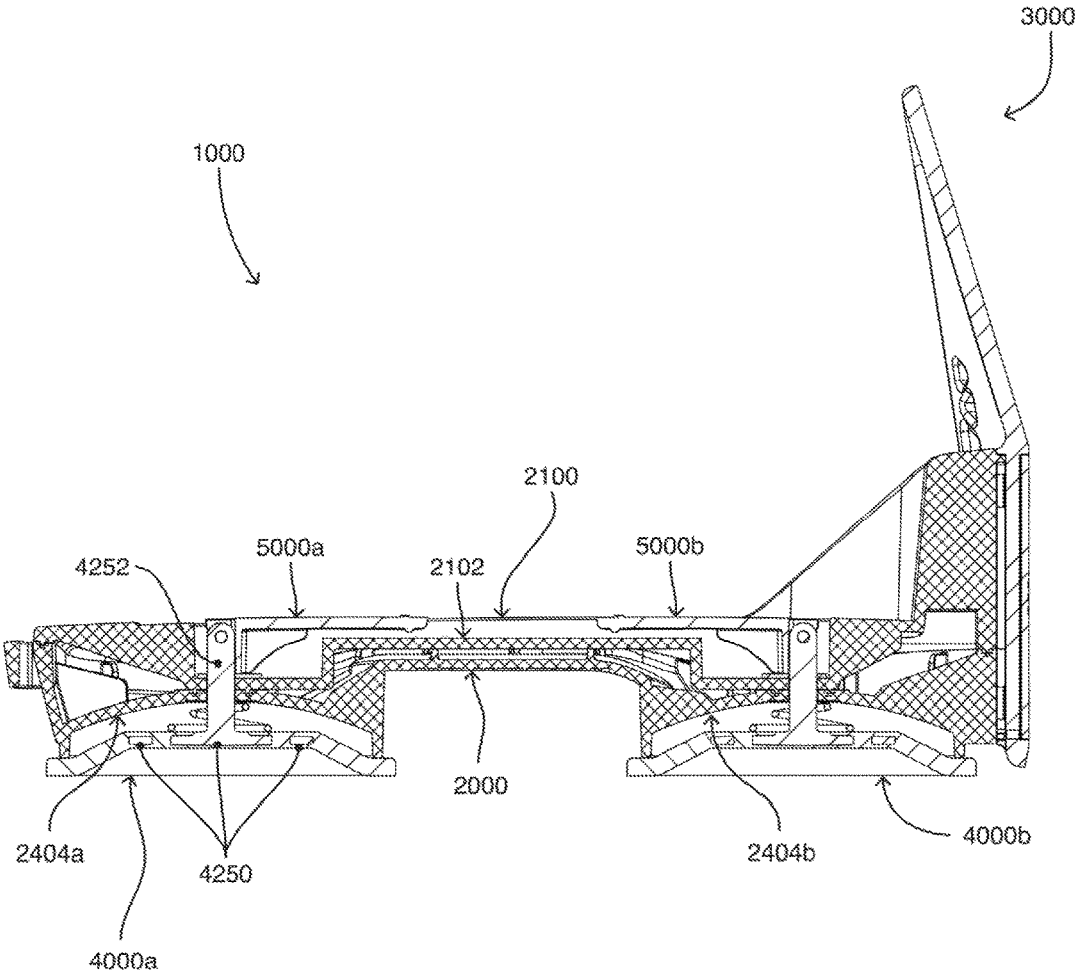
FIG. 30 illustrates a longitudinal cross section view of a WAKE DIVERTER in an engaged position.
Figure 31:
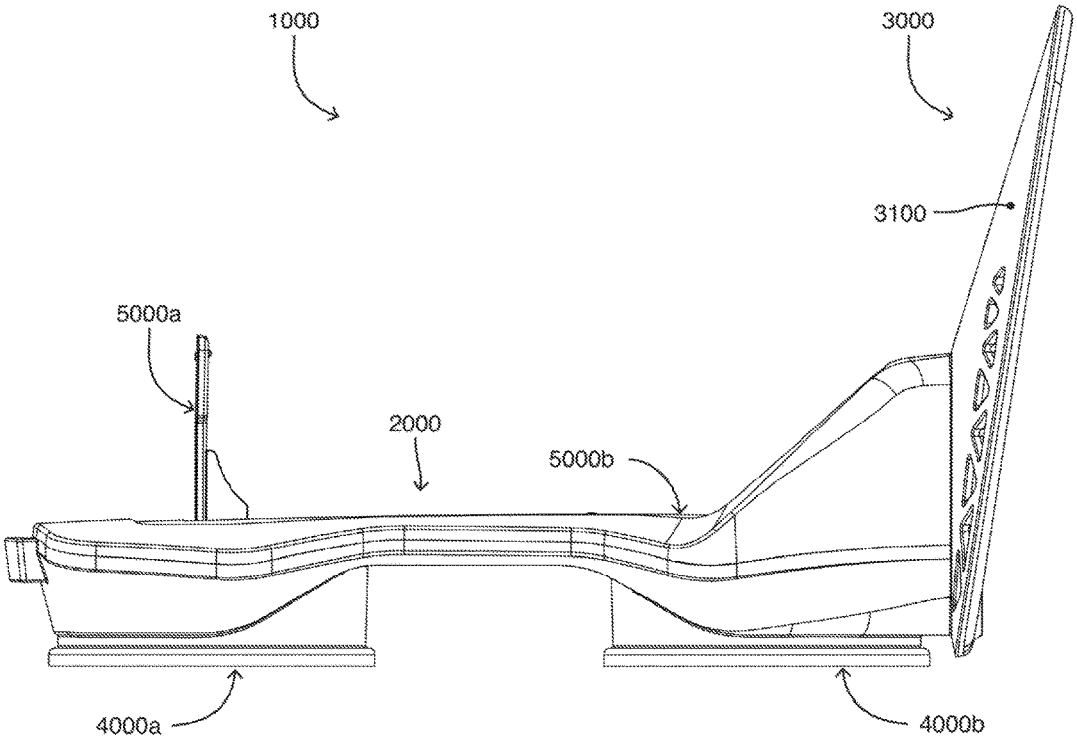
FIG. 31 illustrates a side view of a WAKE DIVERTER according to certain embodiments.
Figure 32:
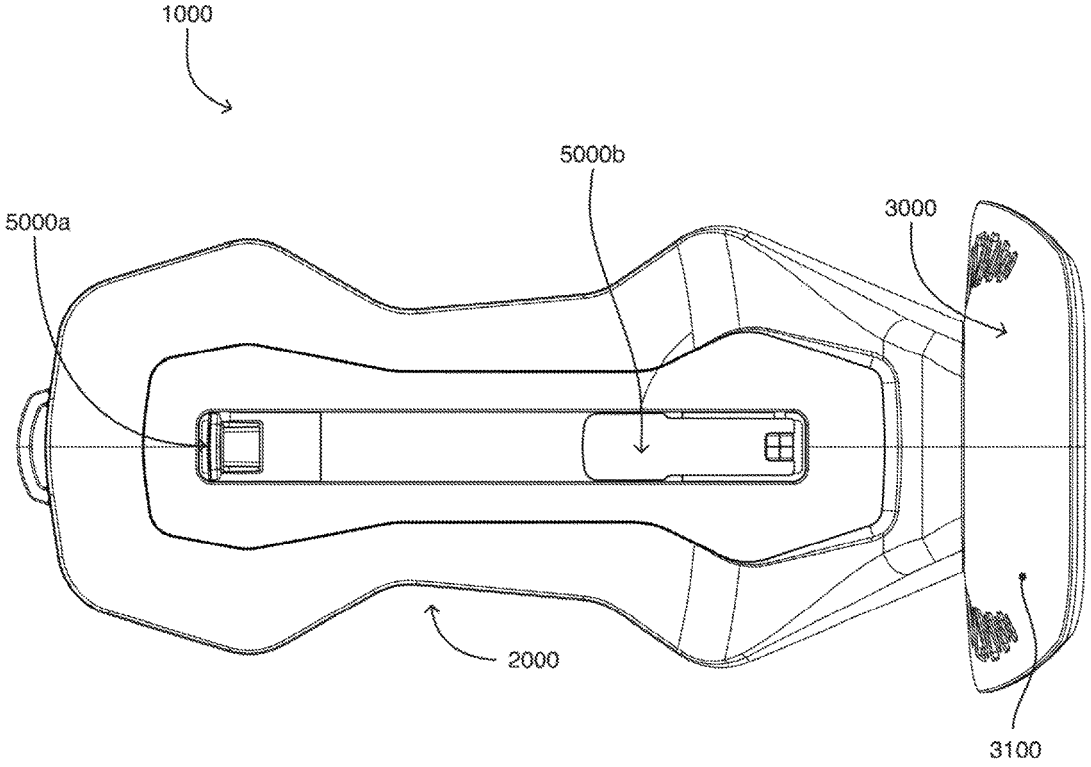
FIG. 32 illustrates a top view of a WAKE DIVERTER according to certain embodiments.
Figure 33:
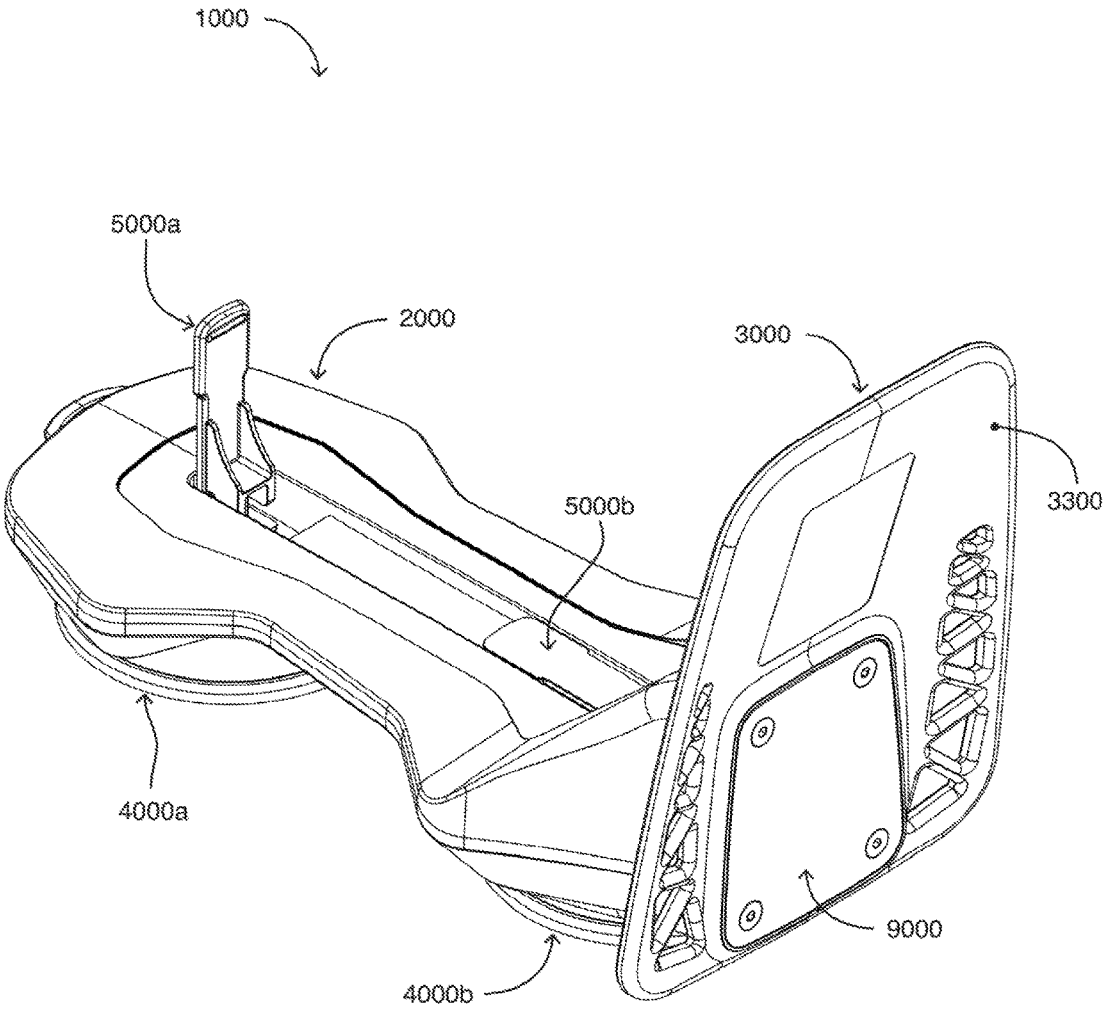
FIG. 33 illustrates a front perspective view of a WAKE DIVERTER according to certain embodiments.
Figure 34:
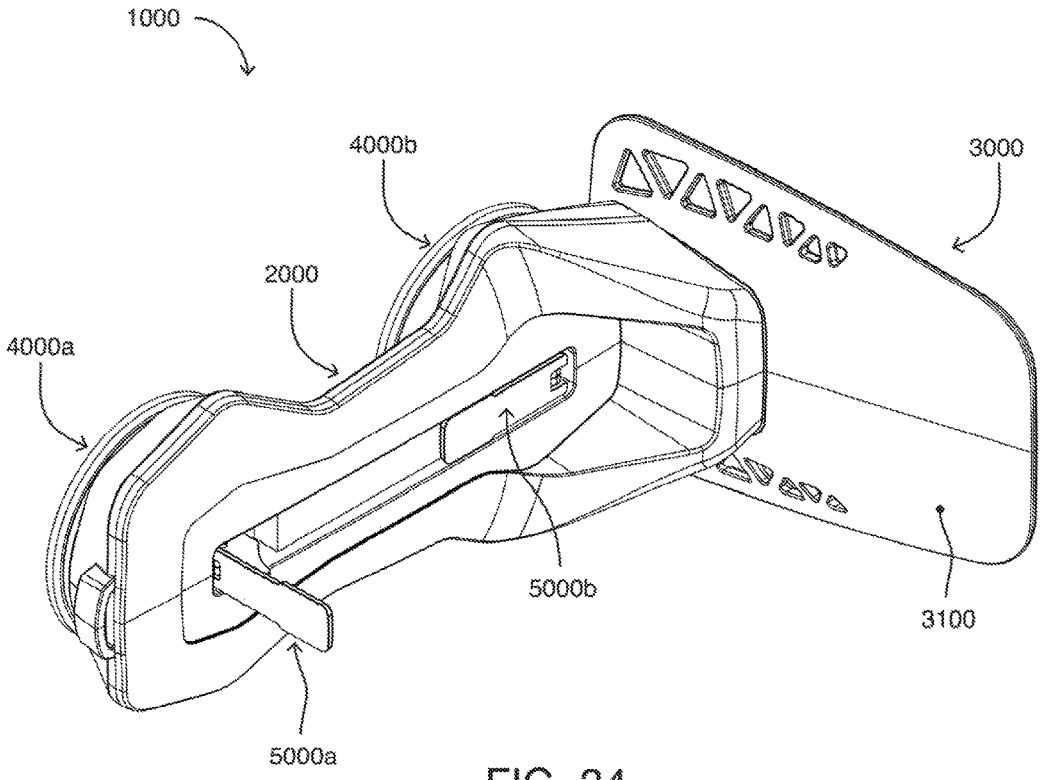
FIG. 34 illustrates a rear perspective view of a WAKE DIVERTER according to certain embodiments.

As shown in at least FIGS. 29 and 30, the relative angle between the forward surface 3100 of panel 3000 and the longitudinal axis of body 2000 is a function of both an angle of forward surface 3100 relative to the surfaces 3400 and 3500 and an angle of the panel interface surface 2208 relative to the longitudinal axis of the body 2000. Thus, those of skill in the art will appreciate that achieving the above-discussed angles between the forward surface 3100 of panel 3000 and the longitudinal axis of body 2000 may be accomplished by forming the body with the appropriate relative angle between the panel interface surface 2208 and the body 2000. In other words, achieving a desired relative angle between the forward surface 3100 of panel 3000 and the longitudinal axis of body 2000, the forward surface 3100 may be angled relative to the surfaces 3400 and 3500, and/or the panel interface surface 2208 may be angled relative to the longitudinal axis of the body 2000.

In various embodiments, body 2000 and panel 3000 are or include a lightweight semi-rigid or rigid synthetic polymeric material such as polyethylene, high-density polyethylene, PVC, polypropylene, polyoxymethylene (or Delrin™), or other polymers or plastics. In one embodiment, the polymeric material is reinforced (e.g., glass filled), to provide improved mechanical properties such as rigidity, strength, durability, and/or surface hardness. For example, in one such embodiment, the polymeric material is 20% glass filled. In one embodiment, the polymeric material is UV stabilized. That is, in some embodiments, the polymeric material is protected against the long-term UV degradation effects from ultraviolet radiation. It should be appreciated that body 2000 and panel 3000 may be of any suitable material. In various embodiments, body 2000 and panel 3000 are made of the same material by the same process. In another embodiment, body 2000 and panel 3000 are made of a different material, such as a metallic material (e.g., aluminum or stainless steel). In yet another embodiment, body 2000 and panel 3000 are additionally made by way of a different process (such as those discussed in greater detail herein).

In some embodiments, with panel 3000 and body 2000 properly aligned, apertures 3506*a-d* are aligned with the corresponding retention features 2210*a-d* such that one or more fasteners 9100 may be utilized to further secure panel 3000 to body 2000. As mentioned above, in various embodiments, panel 3000 is removably attachable to body 2000 in a manner sufficient to securely and rigidly couple the two components together. In one embodiment a faceplate 9000 is used in associated with one or more fasteners 9100 to secure the panel 3000 to the body 2000. In one embodiment, faceplate 9000 is of a complementary shape to that of body interface portion 3400. In one embodiment, faceplate 9000 has a thickness that is complementary to the depth by which interface surface 3404 is recessed into forward surface 3100 of panel 3000. In one such embodiment, faceplate 9000 is received by panel 3000 such that a smooth transition exists between forward surface 3100 and faceplate 9000. In one embodiment, faceplate 9000 includes one or more apertures 9002, such as apertures 9002*a-d*. In one embodiment, each of apertures 9002*a-d*, apertures 3406*a-d*, apertures 3506*a-d*, and apertures 2210*a-d* correspond with one-another (e.g., 9002*a*, 3406*a*, 3506*a*, and 2210*a* each correspond with one-another).

In one embodiment, one or more of the fasteners 9100 are utilized in combination with the faceplate 9000 to secure panel 3000 to the body 2000. In one embodiment, a plurality of fasteners, such as screws 9100*a-d* are inserted through apertures 9002 of face plate 9000, though apertures 3406 and 3506 of panel 3000, and received by panel retention features 2210. In one embodiment, panel 3000 is secured to body 2000 by threading fasteners 9100 (e.g., screws) into panel retention features 2210 (e.g., threaded holes). In such an embodiment, faceplate 9000 operates to distribute the screw head pressure resulting from connecting the panel 3000 to the body 2000 with fasteners 9100 so as to protect panel 3000 from damage or failure due to stress concentrations.

In one embodiment, faceplate 9000 is a lightweight corrosion resistant metal, such as aluminum or stainless steel (though other lightweight corrosion resistant metals are also envisioned). In another embodiment, faceplate 9000 is a lightweight semi-rigid or rigid synthetic polymeric material such as polyethylene, high-density polyethylene, PVC, polypropylene, polyoxymethylene (or Delrin™), or other polymer or plastic. It should be appreciated that faceplate 9000 may be of any suitable material. In various alternative embodiments, the faceplate 9000 may be substituted with a washer or other structural means by which the stress encountered during operation is adequately distribute to avoid structural failure of the panel 3000.

As discussed above, wake diverter 1000 is quickly and easily attachable to the side of the hull of a boat in a non-permanent manner. In various embodiments, one or more mechanisms, such as one or more differential pressure attachments 4000 provide for such an attachment. In one embodiment, the one or more differential pressure attachments 4000 can be selectively engaged and disengaged to couple and decouple the wake diverter 1000 to the side of the hull of the watercraft.

Referring now to FIGS. 27A-27E, a differential pressure attachment 4000 is illustrated. In one embodiment, differential pressure attachment 4000 includes a base (or suction cup) 4100 and a commissure post 4200. In one embodiment, base (or suction cup) 4100 is circular in shape, has a diameter, and has a thickness. In addition, the base 4100 is defined at least in part by a contact surface 4102, an upper surface 4104, and a peripheral edge 4106. In one embodiment, a portion of the contact surface 4102 (e.g., an area about the periphery of contact surface 4102) operates to form a seal with the side of the hull of a watercraft. In one such embodiment, the contact surface 4102 is sufficiently smooth so as to provide for forming a seal between the contact surface 4102 and the side of the hull of a watercraft. In various embodiments, the contact surface 4102 is an annular surface that maintains contact with the side of the hull of the watercraft (shown, for example, in FIGS. 29 and 30).

In one embodiment, the base 4100 is configured to deform so as to create a negative relative pressure in a void or volume situated between the base 4100 and the watercraft's hull. In one embodiment, as the base 4100 is deformed, a portion of the periphery of the contact surface 4100 remains in contact with the watercraft's hull while a central portion of the contact surface 4100 separates from the watercraft's hull. This separation of the central portion of the contact surface 4100 forms a void between the base 4100 and the watercraft's hull, centrally situated relative to where the contact surface 4100 remains in contact with the watercraft's hull.

In one embodiment, the deformability of the base 4100 is based on the thickness, diameter, and material properties of the base 4100. In some embodiments, a structure's ability to form a seal is based, at least in part, on its ability to deform. As discussed below, materials with material properties (e.g., durometer), have different deformation capabilities, and thus different sealing capabilities. For example, a base having a first diameter, a first thickness, and a first material property (e.g., a first durometer) is associated with a first sealing capability. On the other hand, a base having the first diameter, the first thickness, and a second material property (e.g., a second, different durometer) is associated with a second, different sealing capability. Likewise, a base having a second diameter, the first thickness, and the first material property (e.g., the first durometer) is associated with a third sealing capability different from the first. Similarly, a base having the first diameter, a second thickness, and the first material property (e.g., the first durometer) is associated with a fourth sealing capability different from the first.

Accordingly, it would be inaccurate to generally conclude that lower durometers materials are generally more capable of providing for a seal than are higher durometer materials (or vice versa), or that larger diameter bases are generally more capable of providing for a seal than are smaller diameters (or vice versa), or that thicker bases are generally more capable of providing for a seal than are thinner bases (or vice versa). Indeed, one characteristic is not determinative of the ability to seal successfully. Instead, the specifics of the application, the thickness and diameter of the base 4100, the general conditions of the surface to which the contact surface 4102 of the base 4100 will interface, the smoothness of the material of the base, the conditions surrounding operation (e.g., a static or dynamic operating condition), fatigue considerations, and temperature considerations, among others, are all factors that influence the ability of the differential pressure attachment to operate effectively (e.g., seal effectively) under a wide variety of different operating conditions.

As mentioned above, sealing capability is a function of smoothness. Accordingly, in some embodiments, the differential pressure attachments 4000 are coated with a material to enhance their sealing capability. In addition to or alternative to coating the differential pressure attachments 4000, in some embodiments, differential pressure attachments 4000 are treated to remove unwanted coatings that are otherwise applied in conjunction with the manufacturing of the differential pressure attachments 4000 (e.g., silicone may be applied to assist in removal of molded parts from tooling).

In various embodiments, the base 4100 of differential pressure attachment 4000 includes a central portion 4108. In one embodiment, a commissure post 4200 extends from the central portion 4108 of the base 4100 away from the top surface 4104 of base 4100. In one embodiment, commissure post 4200 is a long rectangular extension having a bottom end 4202 and a top end 4204. In some embodiments, the commissure post 4200 extends perpendicular to the top surface 4104 of base 4100, or at least extends along a center axis of base 4100.

In one embodiment, differential pressure attachment 4000 is a single piece construction. For example, in one embodiment, commissure post 4200 and base 4100 are formed of a single material (e.g., in a single shot mold). In another embodiment, Differential pressure attachment 4000 is of a multi-piece construction. In one such embodiment, base 4100 is molded on to commissure post 4200 (see e.g., FIG. 29). In one embodiment, commissure post 4200 is a rigid or semi-rigid polymeric material (as described herein) and base 4100 is a molded thereon. In one such embodiment, commissure post 4200 may include a base section 4250 and a post section 4252 extending from the base section 4250. In this embodiment, base 4100 is molded to base section 4250 such that base 4100 is inseparable from commissure post 4200. Such a two-piece construction provides that commissure post 4200 can be employed in a first rigid or semi-rigid material, while base 4100 can be employed as a second, resilient material suitable for forming deforming to form a seal with a watercraft's hull as discussed herein.

In some embodiments, commissure post 4200 and base 4100 are integrally formed. In some other embodiments, commissure post 4200 is permanently coupled to base 4100. In yet other embodiments, commissure post 4200 is removably coupled to base 4100.

In one embodiment, commissure post 4200 includes an intermediate section 4208, which is situated between the bottom end 4202 and the top end 4204. In various embodiments, one or more apertures 4206 are positioned proximate the top end 4204. As discussed in greater detail below, in some embodiments, the one or more apertures 4206 operate in accordance with one or more activation mechanisms (e.g., activation mechanism 5000) to cause translation and/or deflection of commissure post 4200.

In one embodiment, a deflection or translation of commissure post 4200 operates to cause base 4100 to deform to create the above-discussed seal between the contact surface 4102 of the base 4100 and the watercraft's hull. In one such embodiment, as force is applied to commissure post 4200 in a direction away from base 4100, commissure post 4200 transfers at least a component of that force to the central portion 4108 of the base 4100, which in turn causes the center portion 4108 of base 4100 to deflect away from the peripheral edge 4106 of the base 4100 generally along the central axis of commissure post 4200. As the center portion 4108 deflects away from the peripheral edge 4106 of the base 4100, the above-discussed void or volume is formed between the base 4100 and the watercraft's hull. The creation of this void or volume induces a negative relative (or differential) pressure, which operates to frictionally retain the wake diverter 1000 on the watercraft's hull. One of skill in the art will appreciate that negative relative pressure generally refers to the difference in pressure between the volume or space between the suction cup base 4100 and the hull of the boat and a pressure of a volume different from the volume or space between the suction cup base 4100 and the hull of the boat. In various embodiments, this differential pressure generally refers to atmospheric pressure to the difference in pressure between the volume or space between the suction cup base 4100 and the hull of the boat and the pressure in the environmental surroundings of the watercraft, such as the water pressure and/or atmospheric pressure.

It will also be appreciated that upon actuation of the activation mechanisms 5000, including 5000*a* and 5000*b*, the volume of the void defined between the base 4100 and the hull of the boat is increased from a first volume to a second larger volume (as shown, for example, in FIGS. 29 and 30, and referred to herein), as a result of deforming the base 4100, and specifically as a result of causing a portion of the base 4100 to move away from the hull of the boat while another portion of the base 4100 remains in contact with the hull of the boat. As those of skill will appreciate, while the volume of this void is changing from a first volume to a second larger volume, the amount of fluid, e.g., air, trapped within the void generally remains constant, or does not increase so much as to avoid the creation of a differential pressure between the void and the surrounding environment. Accordingly, because the volume increases and the amount of fluid trapped within the void generally remains constant, the pressure decreases (e.g., Boyle's Law $P_1V_1=P_2V_2$).

In one embodiment, commissure posts 4200 are a lightweight semi-rigid or rigid synthetic polymeric material polyethylene, high-density polyethylene, PVC, polypropylene, polyoxymethylene (or Delrin™), or other suitable polymer or plastic. It should be appreciated, however, that commissure posts 4200 may be of any suitable material.

In one embodiment, one or more mechanical mechanisms are provided for interacting with the commissure post 4200 to cause the deflection of the center portion 4108 of base 4100. For example, turning now to FIGS. 28A-281, an activation mechanism 5000 is illustrated. In one embodiment, the activation mechanism 5000 is a lever that is transitionable from an engaged position to a disengaged position. With activation mechanism 5000 in the disengaged position, the base 4100 is disengaged (i.e., not generally deformed) and provides minimal, if any, attachment capability. With activation mechanism 5000 in the engaged position, the base 4100 is engaged (i.e., deformed) and provides sufficient attachment capability (e.g., remains attached to the watercraft's hull during normal operating conditions, as discussed herein). In one embodiment, activation mechanism 5000 is rotated from the disengaged position to the engaged position (and vice versa).

In one embodiment, activation mechanism (or lever) 5000 includes an arm 5100, a cam feature 5200, and a commissure post housing 5300. In one embodiment, arm 5100 is generally rectangular in shape. In various embodiments, the arm includes a top surface 5102, a bottom surface 5104, a lever end 5106, and a fulcrum end 5108 situated opposite the lever end 5106. The lever end 5106 is configured such that a force can be applied thereto (e.g., via a user's finger, thumb, or hand) to cause activation mechanism 5000 to rotate generally about fulcrum end 5108 to cause engagement or disengagement of a connected differential pressure attachment 4000.

In one embodiment, the cam feature 5200 includes one or more lobes 5202, such as lobes 5202*a* and 5202*b*. In one embodiment, lobes 5202 extend from the bottom surface 5104 of arm 5100. In one such embodiment, lobes 5202 are positioned more proximate the fulcrum end 5108 then the lever end 5106. In various embodiments, each of the one or more lobes 5202 contains a plurality of reaction surfaces. Specifically, in some embodiments, each lobe 5202 includes a disengaged reaction surface 5204 and an engaged reaction surface 5206. In one embodiment, disengaged reaction surface 5204 is generally perpendicular to engaged reaction surface 5206.

In other embodiments, disengaged reaction surface 5204 is angled relative to engaged reaction surface 5206 in the range of between seventy-five (75) and one-hundred-five (105) degrees. In one embodiment, there exists a transition 5210 between disengaged reaction surface 5204 and engaged reaction surface 5206. For example, transition 5210 (such as 5210*a* and 5210*b*) is a radius situated between the disengaged reaction surface 5204 and engaged reaction surface 5206. In another example, transition 5210 is a chamfer situated between the disengaged reaction surface 5204 with engaged reaction surface 5206. In yet another example, transition 5210 is a sharp corner situated between disengaged reaction surface 5204 and engaged reaction surface 5206. It should be appreciated that transition 5210 is configured to allow for a transition of activation mechanism 5000 from the disengaged position to the engaged position (and vice versa), while also generally operating to prevent unwanted or unintended transition of activation mechanism 5000 from the disengaged position to the engaged position (and vice versa) as would be appreciated by one of skill in the art.

Figure 28A:
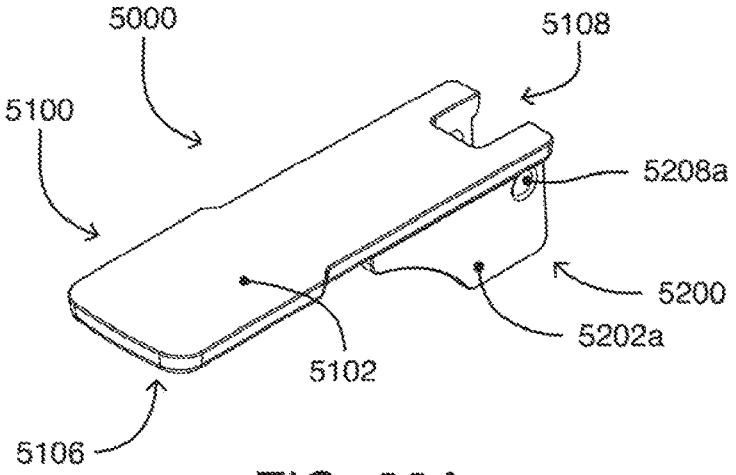
Figure 28B:
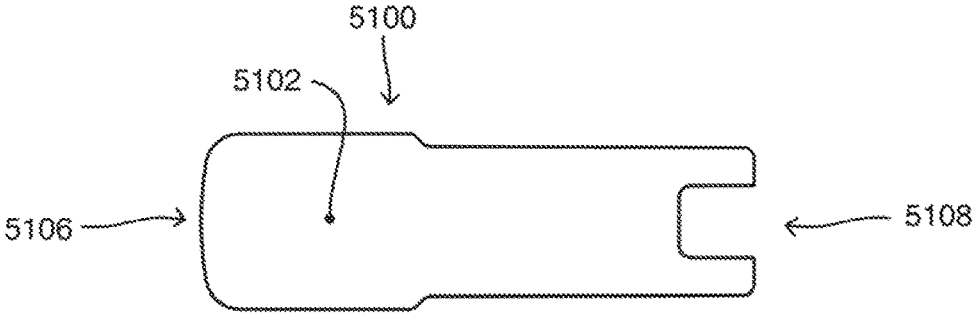
Figure 28C:
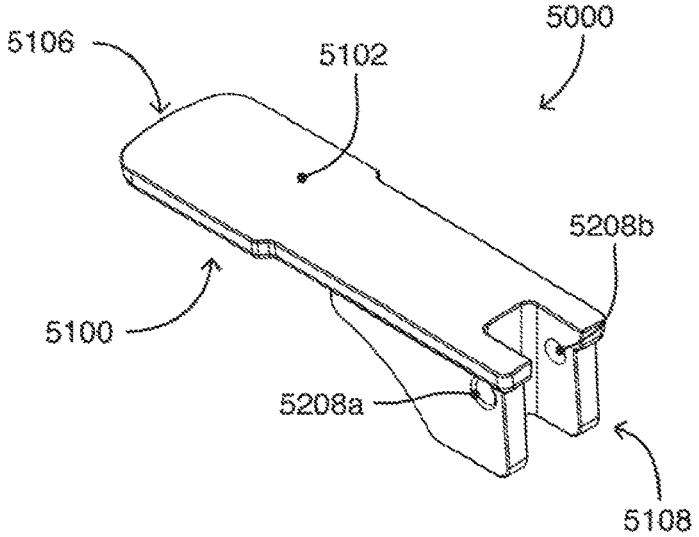
Figure 28D:
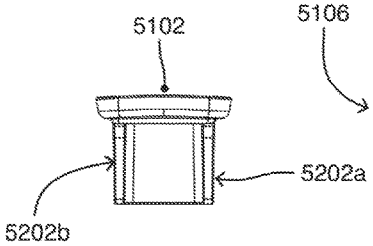
Figure 28E:
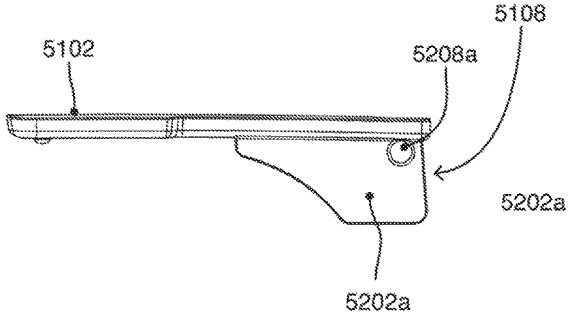
Figure 28F:
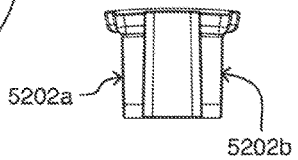
Figure 28G:
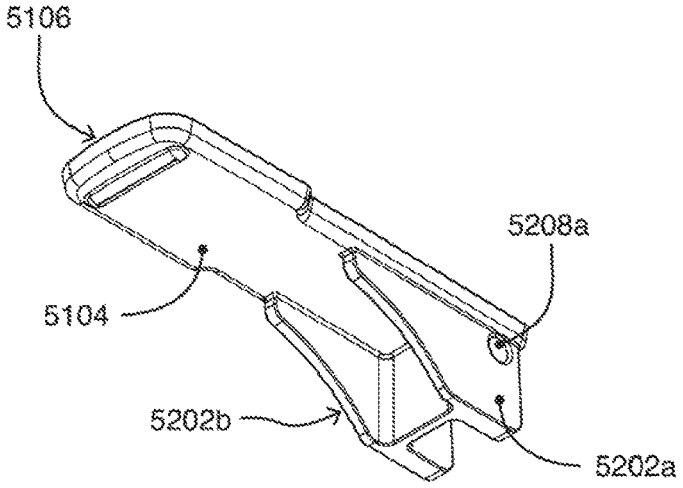
Figure 28H:
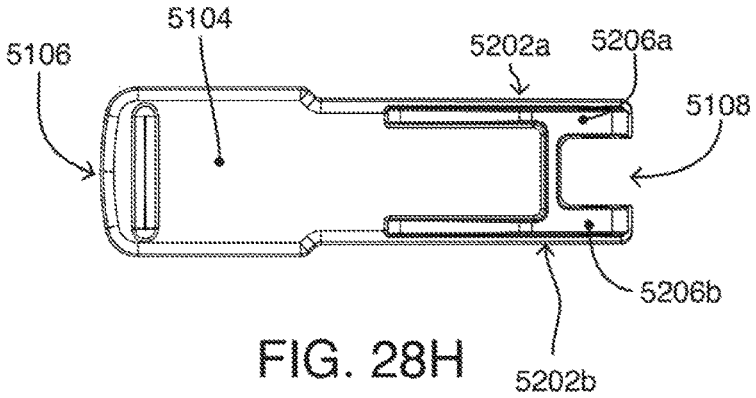
Figure 28I:
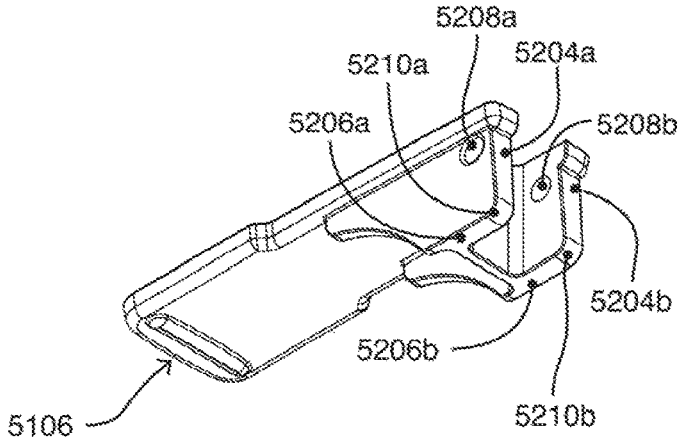

In some embodiments, each lobe 5202 additionally includes an aperture 5208. For example, as illustrated in FIGS. 28A-281, lobe 5202*a* includes aperture 5208*a*, and lobe 5202*b* includes aperture 5208*b*. In these illustrated embodiments, apertures 5208*a* and 5208*b* are axially aligned. In some embodiments, each aperture 5208 (e.g., an axis of each aperture 5208) is generally more proximate the disengaged reaction surface 5204 than the engaged reaction surface 5206. Such an offset provides for deflection of the differential pressure attachment as discussed in greater detail below.

In one embodiment, activation mechanisms 5000 are a lightweight semi-rigid or rigid synthetic polymeric material polyethylene, high-density polyethylene, PVC, polypropylene, polyoxymethylene (or Delrin), or other suitable plastic. It should be appreciated, however, that activation mechanisms 5000 may be of any suitable material.

In one embodiment, activation mechanism 5000 is pivotably coupled to commissure post 4200. In one such embodiment, activation mechanism 5000 is coupled to commissure post 4200 via a pin or dowel 8000 (see e.g., FIGS. 8-9, and FIGS. 29-30). In some embodiments, a pin or dowel 8000 is extends through lobes 5200 of activation mechanism 5000 and through aperture 4206 of differential pressure attachment 4000. For example, pin or dowel 8000 extends through aperture 5208*a* of lobe 5200*a* of activation mechanism 5000*a*, through aperture 4206*a* of commissure post 4200*a* of differential pressure attachment 4000*a*, and through aperture 5208*b* of lobe 5200*b* of activation mechanism 5000*a* (see also FIGS. 8-9). Accordingly, in this example, pin or dowel 8000 operates to pivotably couple the activation mechanism 5000*a* to differential pressure attachment 4000*a*. Thus, in various embodiments, the apertures 4206, including apertures 4206*a* and 4206*b* operate as fulcrums about which the activation mechanisms 5000, including activation mechanisms 5000*a* and 5000*b* rotate (shown, for example, in FIGS. 29 and 30).

Referring now to FIGS. 29 and 30, the engagement and disengagement of differential pressure attachments 4000 is illustrated by way of longitudinal cross-sectioned views of the wake diverter 1000. In various embodiments, in both the disengaged and engaged states, differential pressure attachments 4000 are coupled to activation mechanisms 5000. In some embodiment, differential pressure attachments 4000 are assembled with the body 2000 such that at least a portion of the base 4100 of a differential pressure attachment 4000 interfaces with a differential pressure attachment housing 2400 (see e.g., FIGS. 29-30). In some embodiments, the commissure post 4200 extends through the body 2000 and couples to the activation mechanism 5000. With specific reference to differential pressure attachment 4000*a*, commissure post 4200*a* extends through aperture 2412, through body 2000, and through aperture 2120 such that the top end 4202*a* of commissure post is received within lever housing 2112 of body 2000. In addition, as illustrated, the fulcrum end 5108*a* of activation mechanism 5000*a* is also received within lever housing 2112 of the body 2000 such that activation mechanism 5000*a* is pivotably coupled to commissure post 4200*a* of differential pressure attachment 4000*a* via pin or dowel 8000*a*, as discussed above.

In one embodiment, a resilient member 6000 (e.g., a spring) is positioned between the base 4100 and the interior recessed surface 2404 of each differential pressure attachment 4000 (see e.g., resilient members 6000*a* and 6000*b*). In one such embodiment resilient member 6000 operates to influence the base 4100 away from interior recessed surface 2404. In some embodiments, the resilient member 6000 additionally operates to assist the differential pressure attachment 4000 in its attachment to the hull of the watercraft. In one such embodiment, the resilient member 6000 operates to flatten (or partially flatten, or flatten a portion of) the differential pressure attachment 4000 against the hull of the watercraft when the wake diverter 1000 is being pressed against the hull of the watercraft (as discussed herein). In this embodiment, the force of the resilient member 6000 operates to influence the base 4100 of the differential pressure attachment 4000 to conform (at least in part) to the shape of the portion of the hull of the watercraft to which it is being attached. In one such embodiment, the resilient member 6000 operates to create such conformity prior to the engagement of the associated activation mechanism 5000. Thus, in some embodiments, the resilient member 6000 operates to cause the differential pressure attachment 4000 to create a differential pressure (as described herein) that is less in magnitude (relative to the differential pressure experience during engagement), yet still operates to temporarily assist in attaching the wake diverter 1000 to the hull of the watercraft. In some embodiments, resilient member 6000 is a spring made of any suitable elastic material (e.g., steel, stainless steel). In some embodiments, a coating may be applied to further resist corrosion, although corrosion resistant materials are envisioned.

With reference to FIG. 29 specifically, a longitudinal cross-sectioned view of the wake diverter 1000 is illustrated in a disengaged state. In one embodiment, in the disengaged state, differential pressure attachments 4000 are disengaged (e.g., not generally deformed) and generally do not operate to provide a sufficient attachment of the wake diverter 1000 to the side of the hull of a watercraft under operating conditions (i.e., traveling through the water at a speed sufficient to produce a surfable stern wave).

In one embodiment, as illustrated in FIG. 29, in the disengaged state, activation mechanism 5000*a* is oriented such that arm 5100*a* is generally parallel with the longitudinal axis of commissure post 4200*a* and such that the disengaged reaction surfaces 5204 of lobes 5202 of cam feature 5200 are generally perpendicular to the longitudinal axis of commissure post 4200. In one embodiment, in the disengaged state, the disengaged reaction surfaces 5204 are additionally or alternatively oriented generally parallel with and are in contact with reaction surface 2116 of body 2000.

Turning now to FIG. 30, a longitudinal cross-sectioned view of the wake diverter 1000 is illustrated in an engaged state. In one embodiment, in an engaged state, differential pressure attachments 4000 are deformed and operate to provide a sufficient attachment of the wake diverter 1000 to the side of the hull of a watercraft under operating conditions (i.e., traveling through the water at a speed sufficient to produce a surfable stern wave). In various embodiments, the differential pressure attachments 4000 are coupled to the activation mechanisms 5000 in the same manner discussed above with respect to the disengaged state.

In one embodiment, as illustrated in FIG. 30, in the engaged state, the one or more activation mechanisms 5000 have each been repositioned from the disengaged position to the engaged position. In the engaged position, the activation mechanisms 5000 cause bases 4100 to deform in a manner sufficient to attach the wake diverter 1000 to the watercraft's hull. In one embodiment, as discussed above, activation mechanism 5000 is repositioned from the disengaged position to the engaged position (and vice versa) by rotating activation mechanism 5000 about fulcrum end 5108. In one embodiment, in the engaged position, the activation mechanism 5000 is oriented generally perpendicular to its orientation in the disengaged position. For example, in one embodiment, in the engaged position, arm 5100*a* is generally perpendicular to the longitudinal axis of commissure post 4200*a* and the engaged reaction surfaces 5206 of lobes 5202 are generally perpendicular to in contact with reaction surface 2116.

In some embodiments, as activation mechanism 5000 is rotated from the disengaged position to the engaged position, the reaction surfaces (e.g., 5204 and 5206) of cam feature 5200 slide along the reaction surfaces (e.g., 2114 or 2116) of body 2000. In some embodiment, one or more slide washers 7000 (e.g., 7000*a* and 7000*b*) are positioned between the activation mechanism 5000 and the body 2000. In one such embodiment, the one or more slide washers 7000 operate to minimize wear on the reaction surfaces (e.g., 2114 or 2116) of the body 2000. In one embodiment, slide washers 7000 are made of a lightweight corrosion resistant metal, such as aluminum or stainless steel (though other lightweight corrosion resistant metals are also envisioned). In another embodiment, slide washers 7000 are a lightweight semi-rigid or rigid synthetic polymeric material polyethylene, high-density polyethylene, PVC, polypropylene, polyoxymethylene (or Delrin), or other suitable plastic. It should be appreciated that slide washers 7000 may be of any suitable material.

In some embodiments, the rotation of activation mechanism 5000*a* from the disengaged position to the engaged position causes aperture 5208*a* (which is axially aligned and mechanically coupled with aperture 4206*a*) to translate away from reaction surface 2116 of body 2000, at least in part along the longitudinal axis of the commissure post 4200*a* of differential pressure attachment 4000*a*. Specifically, in the disengaged position (e.g., disengaged reaction surface 5204*a* is parallel to and generally in contact with reaction surface 2116; FIG. 29), aperture 5208 is offset from reaction surface 2116 by generally the same distance it is offset from disengaged reaction surface 5204. Likewise, the rotation of activation mechanism 5000*b* from the disengaged position to the engaged position causes aperture 5208*b* (which is axially aligned and mechanically coupled with aperture 4206*b*) to translate away from reaction surface 2114 of body 2000, at least in part along the longitudinal axis of the commissure post 4200*b* of differential pressure attachment 4000*b*. Specifically, in the disengaged position (e.g., disengaged reaction surface 5204*b* is parallel to and generally in contact with reaction surface 2114; FIG. 29), aperture 5208*b* is offset from reaction surface 2114 by generally the same distance it is offset from disengaged reaction surface 5204.

However, when activation mechanism 5000*a* is transitioned to the engaged position (e.g., engaged reaction surface 5206*a* is parallel to and generally in contact with reaction surface 2116; FIG. 30), aperture 5208*a* is offset from reaction surface 2116 by generally the same distance it is offset from engaged reaction surface 5206*a*. As discussed above, aperture 5208*a* is more proximate disengaged reaction surface 5204*a* than engaged reaction surface 5206*a*. Thus, aperture 5208*a* is thus offset from reaction surface 2116 by a greater distance in the engaged position than it is in the disengaged position. Accordingly, in transitioning the activation mechanism 5000*a* from the disengaged position to the engaged position, aperture 5208*a* translates away from reaction surface 2116. Similarly, when activation mechanism 5000*b* is transitioned to the engaged position (e.g., engaged reaction surface 5206*b* is parallel to and generally in contact with reaction surface 2114; FIG. 30), aperture 5208*b* is offset from reaction surface 2114 by generally the same distance it is offset from engaged reaction surface 5206*b*. Similar to the various features of activation mechanism 5000*a*, aperture 5208*b* is more proximate disengaged reaction surface 5204*b* than engaged reaction surface 5206*b* of activation mechanism 5000*b*. Thus, aperture 5208*b* is thus offset from reaction surface 2114 by a greater distance in the engaged position than it is in the disengaged position. Accordingly, in transitioning the activation mechanism 5000*b* from the disengaged position to the engaged position, aperture 5208*b* translates away from reaction surface 2114.

In some embodiments, each of apertures 5208*a* and 5208*b* translate by an amount generally equivalent to the difference between the distance apertures 5208*a* and 5208*b* are positioned relative to the engaged reaction surfaces 5206*a* and 5206*b* and the disengaged reaction surfaces 5204*a* and 5204*b*, respectively.

As shown in FIGS. 29 and 30, as the apertures 5208*a* and 5208*b* translate away from reaction surfaces 2116 and 2114, respectively, the commissure posts of the differential pressure attachments to which they are attached translate therewith. With specific reference to activation mechanism 5000*a* and differential pressure attachment 4000*a*, as shown in FIGS. 29 and 30, as activation mechanism 5000*a* is transitioned from the disengaged position (FIG. 29) to the engaged position (FIG. 30) aperture 4206*a* translates away from reaction surface 2116 and base section 4250*a* translates toward the body 2000.

It will be appreciated that when a portion of the differential pressure attachment 4000*a* contacts a portion of the side of the hull of a watercraft, as activation mechanism 5000*a* is transitioned from the disengaged position (FIG. 29) to the engaged position (FIG. 30), as base section 4250*a* translates toward the body 2000, base section 4250*a* translates away from the side of the hull of the watercraft. Thus, as one of skill in the art will appreciate, although a portion of the differential pressure attachment 4000*a* remains in contact with a portion of the side of the hull of the watercraft, another portion of the differential pressure attachment 4000*a* moves away from the side of the hull of the watercraft.

Generally, the portion of the differential pressure attachment that remains in contact with the watercraft is an annular portion and the portion of the differential pressure attachment that moves away from the hull of the watercraft is a portion enveloped by or otherwise central to the annular portion.

As shown in FIGS. 29 and 30, as the central portion of the differential pressure attachment 4000*a* moves away from the side of the hull of the watercraft while the annular portion of the differential pressure attachment 4000*a* remains in contact with a portion of the side of the hull of the watercraft a volume situated between the differential pressure attachment and the side of the hull of the watercraft changes from a first volume V1 to a second volume V2, wherein the second volume V2 is greater than the first volume V1. As will be appreciated, this change in volume results in a pressure of the volume V2 being less than a pressure outside of the volume V2 (such as atmospheric pressure).

In various embodiments, activation mechanisms 5000 are transitionable from the engaged position to the disengaged position. In one embodiment, an activation mechanism 5000 is repositioned from the engaged position to the engaged position by rotating activation mechanism 5000 about fulcrum end 5108. In one embodiment, in the engaged position, the activation mechanism 5000 is oriented generally perpendicular to its orientation in the disengaged position. When transitioned to the disengaged position, the activation mechanism 5000 is reoriented such that arm 5100 is generally parallel to the longitudinal axis of commissure post 4200 and the disengaged reaction surfaces 5206 of lobes 5202 are generally parallel and in contact with the reaction surfaces (e.g., 2114 or 2116) or the slide washers 7000 of body 2000.

In some embodiments, as activation mechanism 5000 is rotated from the engaged position to the disengaged position, the reaction surfaces (e.g., 5204 and 5206) of cam feature 5200 slide along the reaction surfaces (e.g., 2114 or 2116) of body 2000. In some embodiment, one or more slide washers 7000 (e.g., 7000*a* and 7000*b*) are positioned between the activation mechanism 5000 and the body 2000. In one such embodiment, the one or more slide washers 7000 operate to minimize wear on the reaction surfaces (e.g., 2114 or 2116) of the body 2000, as discussed above.

In some embodiments, the rotation of activation mechanism 5000 from the engaged position to the disengaged position causes aperture 5208 to translate toward the reaction surface (e.g., 2114 or 2116) of body 2000, at least in part along the longitudinal axis of the commissure post 4200 of differential pressure attachment 4000. For example, as discussed above, aperture 5208 is more proximate disengaged reaction surface 5204 than engaged reaction surface 5206. Thus, aperture 5208 is offset from the reaction surface (e.g., 2114 or 2116) by a greater distance in the engaged position than it is in the disengaged position. Accordingly, in transitioning the activation mechanism 5000*a* from the engaged position to the disengaged position, aperture 5208 translates toward reaction surface 2116.

In one embodiment, activation mechanism recess 2100 operates to accommodate activation mechanism 5000 when positioned in the engaged position (e.g., arm 5100 generally parallel with the longitudinal axis of body 2000). In one embodiment, when positioned in the engaged position, the arm 5100 of activation mechanism 5000 is flush or nearly flush with the upper surface 2024 of body 2000. In one embodiment, when positioned in the engaged position, the bottom surface 5104 of arm 5100 of activation mechanism 5000 is offset from surface 2102 by a distance sufficient to allow a user to place a finger or thumb therebetween to rotate activation mechanism 5000 to a disengaged position. It should also be appreciated that offsetting bottom surface 5104 from surface 2102 operates to create a comfortable and safe area to engage or disengage activation mechanism 5000. For example, offsetting bottom surface 5104 from surface 2102 operates to avoid users from having their fingers or thumbs pinched with rotating the activation mechanisms 5000 from the disengaged position to the engaged position.

As discussed above, panel 3000 and body 2000 are coupled together. In various embodiments, panel 3000 may be coupled to body 2000 such that forward side 3002 of panel 3000 faces away from body 2000 (see FIGS. 1-6). In these embodiments, panel 3000 may alternatively be coupled to body 2000 such that forward side 3002 of panel 3000 faces toward body 2000 (see FIGS. 31-35). That is, panel 3000 may be coupled to body 2000 with the forward side 3002 facing either toward or away from body 2000 (i.e., panel 3000 is reversible). In various embodiments, panel 3000 can be quickly and easily reoriented relative to body 2000.

For example, if the wake diverter 1000 is assembled with the forward side 3002 of panel 3000 facing away from body 2000 (see FIGS. 1-6), it may be desirable to reverse panel 3000 on body 2000 such that the forward side 3002 of panel 3000 is facing toward body 2000 (see FIGS. 31-35). In various embodiments, forward side 3002 of panel 3000 generally faces toward the direction of travel when mounted on a watercraft moving through the water in a manner that would be consistent with and would facilitate the ability to surf or wake surf on a stern wave of the watercraft, regardless of whether the panel is forward of the body 2000 or aft of the body 2000. Similarly, in various embodiments, rearward side 3004 of panel 3000 general faces away from the direction of travel when mounted on a watercraft moving through the water in a manner that would be consistent with and would facilitate the ability to surf or wake surf on a stern wave of the watercraft, regardless of whether the panel is forward of the body 2000 or aft of the body 2000.

With the forward side 3002 of panel 3000 facing toward body 2000, the wake diverter 1000 can be placed with the panel 3000 more proximate the stern of a watercraft, which operates to help produce a different convergence point for the stern waves than will a configuration where the panel 3000 is placed in a more forward position along the watercraft's hull. In essence, because each wake surfer likely has a unique preference for the wave characteristics of wakes they like to surf, it is necessary to have a wake diverter like that described herein whose placement along a watercraft's hull can be very finely tuned and easy and quickly manipulated. The versatility of the wake diverter 1000 provides for a novel design that can be attached at virtually any position along any side of the hull of any watercraft.

It should be appreciated that FIGS. 31-35 additionally illustrate an embodiment, wherein activation mechanism 5000*a* is in an engaged position while activation mechanism 5000*b* is in a disengaged position.

In one embodiment, the body 2000 of the wake diverter 1000 is comprised of an upper portion and a lower portion that are first molded and later joined together. In one embodiment, an upper and a lower section are first separately molded (e.g., by way of injection molding). In one embodiment, the separate upper and lower sections are subsequently joined together through the use of vibration (or friction) welding. In one such embodiment, the use of vibration welding provides for an air-tight seal between the upper and lower sections. The vibration (or friction) welding is done to minimize (or alternatively eliminate) any flashing or the presence of material from the welding process expelling beyond the perimeter of the part. In various embodiments, the upper and lower sections of the body 2000 are constructed with ribs (which become internal ribs after the joining of the upper section to the lower section). In one embodiment, the ribs operate to strength specific portions of the body that experience loading when the wake diverter 1000 is in use (e.g., under operating conditions as discussed herein). In one such embodiment, loading (and corresponding stress concentration) exists adjacent to the various apertures discussed herein that facilitate coupling of the panel 3000 to the body 2000. In some embodiments, loading exists in the apertures of the body 2000 through which the commissure posts 4200 pass. In some embodiments, such a construction provides a particular benefit in that the internal air cavities provide buoyancy to the wake diverter 1000 such that the diverter 1000 floats in water.

In one alternative embodiment, the body 2000 of the wake diverter 1000 is a single shot injection mold. In one such embodiment, high pressure gas assist injection molding utilizes high pressure nitrogen (or another suitable gas) injected at a specific time during the injection molding process, which allows for a hollow cavity to form in body 2000, while forcing the mold material (e.g., resin) into the mold configuration (or tooling). In some embodiments, such an injection molding process additionally operates to produce one or more sealed air cavities within the body 2000 that operate to provide buoyancy to the wake diverter 1000 (see discussion above).

In yet another alternative embodiment, a foaming agent is utilized during one or more of the above-discussed molding processes of the body 2000. In one such embodiment, the use of such a foaming agent provides for air bubble entrapment in the molding material as it is forming in the mold. In one such embodiment, the trapped air bubbles provide for a lighter weight mold material, which in-turn operates to produce buoyancy of the body 2000 and thus the wake diverter 1000. It should be appreciated that any of the above-discussed molding processes (or alternatively a single shot injection mold process) may be utilized in the forming of the panel 3000. It will also be appreciated that in various embodiments, a converted foam member may additionally or alternative be attached or otherwise incorporated into the body 2000 (or panel 3000) or any other member of the wake diverter 1000.

While the embodiments discussed above illustrate face plate 9000 interfacing with body interface portion 3400, it should be appreciated that face plate 9000 is configured to additionally interface with body interface portion 3500 in a similar manner. Specifically, face plate 9000 is configured to interface with body interface portion 3400 when panel 3000 is coupled to body 2000 with the forward side 3002 of panel 3000 facing away from the body 2000 (FIGS. 1-6). Under such a configuration, as discussed above, face plate 9000 and fasteners 9100 operate to further secure panel 3000 to body 2000 while distributing stress to avoid potential damage to panel 3000 caused by undesirable stress concentrations.

In a similar manner, face plate 9000 is configured to interface with body interface portion 3500. For example, face plate 9000 is configured to interface with body interface portion 3500 when panel 3000 is coupled to body 2000 with the forward side 3002 of panel 3000 facing toward the body 2000 (FIGS. 31-35). Under such a configuration, face plate 9000 and fasteners 9100 couple to body 2000 and panel 3000 in a similar manner to that described above. In addition, face plate 9000 and fasteners 9100 operate in a manner similar to that described above to further secure panel 3000 to body 2000 while distributing stress to avoid potential damage to panel 3000 caused by undesirable stress concentrations.

Accordingly, the versatility of the wake diverter 1000 provides that it may be attachable to a watercraft's hull with the panel 3000 in a position forward of the body 2000, or alternatively with the panel in a position aft of the body 2000.

As discussed above, panel 3000 is coupled to the body 2000 by way of aligning body interface portion (e.g., 3400 or 3500) of panel 3000 with panel interface portion 2206 of body 2000 and further securing the panel 3000 to the body 2000 by way of a face plate (or alternatively a washer) and one or more fasteners. In one alternative embodiment, panel 3000 and body 2000 are coupled together by way of a locking dovetail, which operates alone or alternatively in combination with one or more of the above-discussed methods of further securement.

Figure 36:
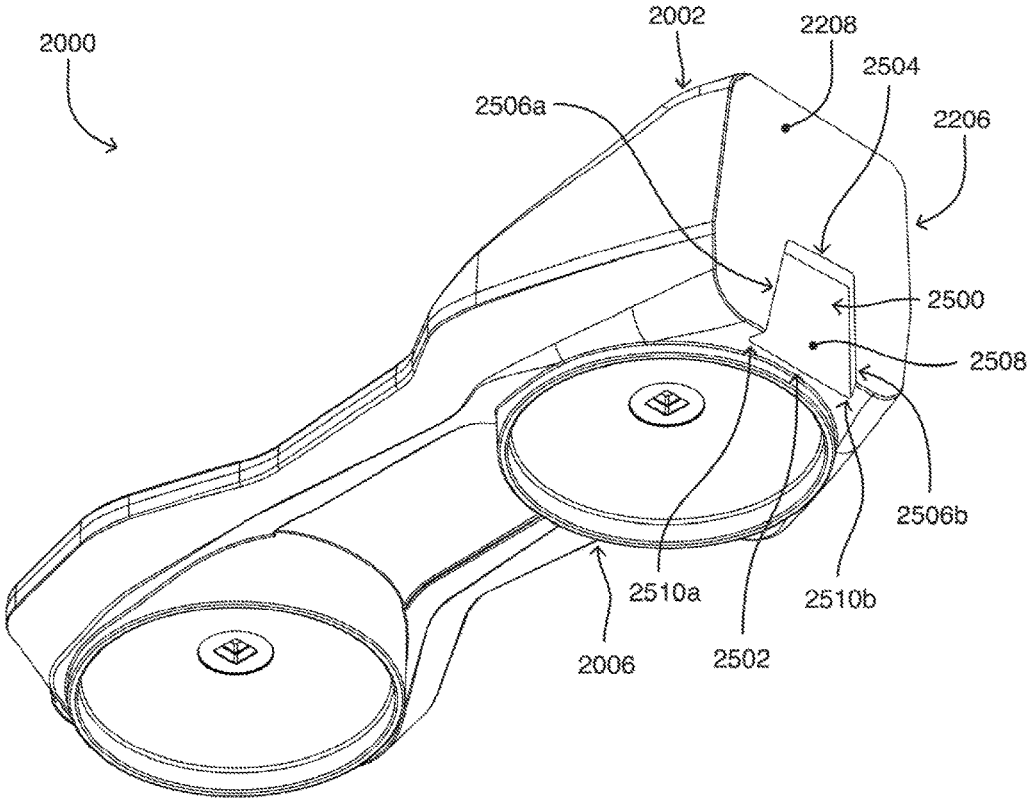
FIG. 36 illustrates a bottom, perspective view of a WAKE DIVERTER according to certain embodiments.
Figure 37:
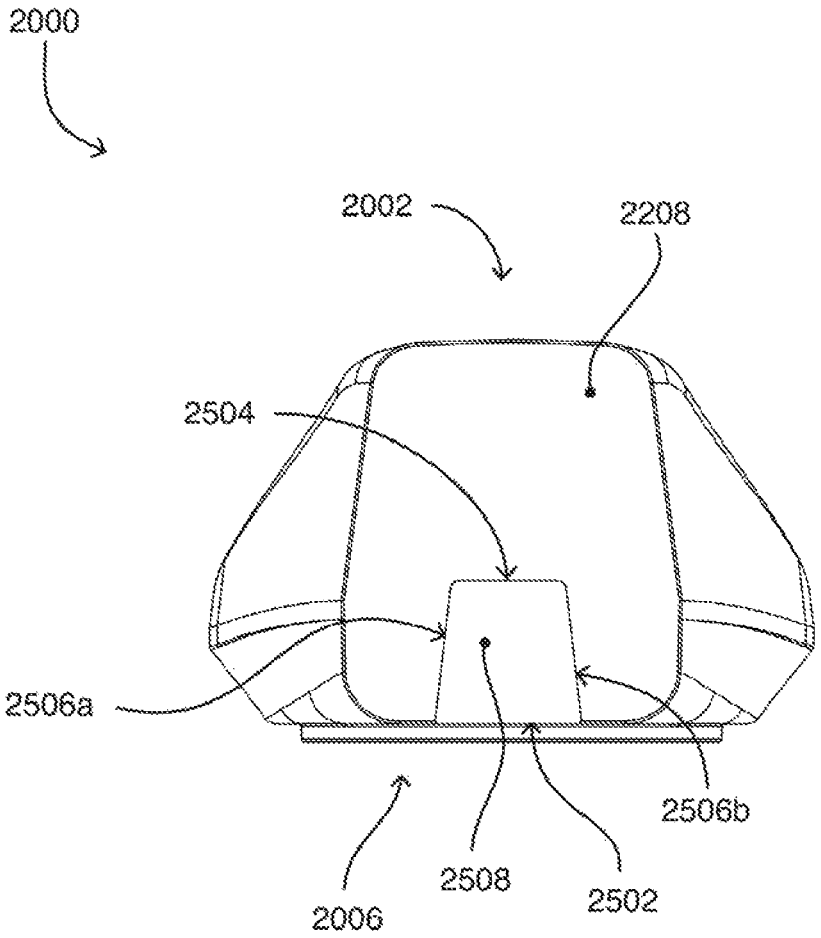
FIG. 37 illustrates a front view of a WAKE DIVERTER according to certain embodiments.
Figure 38:
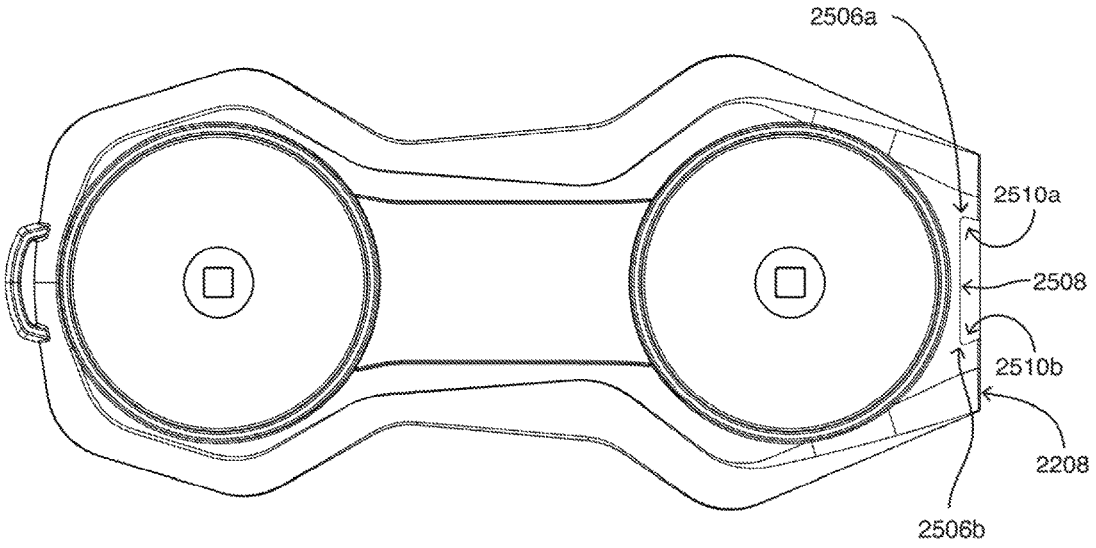
FIG. 38 illustrates a bottom view of a WAKE DIVERTER according to certain embodiments.

Referring how to FIGS. 36-38, panel interface portion 2206 of body 2000 includes a tapered recess 2500. In one embodiment, tapered recess 2500 is formed as a recess in panel interface surface 2208. In one embodiment, the formation of tapered recess in panel interface surface 2208 forms a void in panel interface surface 2208. In one embodiment, tapered recess 2500 includes a bottom portion 2502, a top portion 2504, and a plurality of side portions 2506, such as side portions 2506*a* and 2506*b*. In one embodiment, tapered recess 2500 includes a recessed surface 2508. In one embodiment, tapered recess 2500 is positioned more proximate the bottom portion 2006 of body 2000 than it is the top portion 2002 of body 2000. However, tapered recess 2500 may alternatively be positioned more proximate the top portion 2002 than the bottom portion 2006. In some embodiments, the bottom portion 2502 of the tapered recess 2500 is exposed to the bottom portion 2006 of body 2000. In one such embodiment, the top portion 2504 of the tapered recess 2500 is concealed to the top portion 2002 of body 2000. As discussed in greater detail below, such a configuration provides that panel 3000 is coupled to body 2000 by inserting a corresponding projection of panel 3000 into the bottom 2502 of tapered recess 2500 and thereafter sliding panel toward the top 2002 of body 2000.

In one embodiment, tapered recess 2500 is tapered from bottom to top. For example, a distance from the first side portion 2506*a* to the second side portion 2506*b* at the bottom portion 2502 of the tapered recess 2500 is greater than is the distance from the first side portion 2506*a* to the second side portion 2506*b* at the top portion 2504 of the tapered recess 2500. Such a configuration provides for a secure fit of the corresponding projection of panel 3000 within tapered recess 2500 as discussed below.

In one embodiment, the side portions 2506 are angled relative to panel interface surface 2208 and the recessed surface 2508 to create a groove or furrow 2510 (e.g., 2510*a* and 2510*b*), which extends along the side portions 2506 of the tapered recess 2500. In one embodiment, the groove or furrow 2510 extends partially between or entirely from the bottom portion 2502 to the top portion 2506. In one embodiment, the groove or furrow 2510 is formed in the side portions 2506 such that the surface area of the recessed surface 2508 exceeds the surface area of the void formed in the panel interface surface 2208. As discussed below, such a configuration operates to longitudinally secure the panel 3000 to the body 2000. In one embodiment, the groove or furrow 2510 minimizes or substantially eliminates relative movement between the panel 3000 and the body 2000 during normal operating conditions as discussed herein. While the above-discussed embodiment illustrates the groove or furrow 2510 as being formed by angling side portions 2506 relative to panel interface surface 2208 and the recessed surface 2508, it should be appreciated that the groove or furrow 2510 may be of any suitable shape and may be formed in side portions in any suitable manner. For example, groove or furrow 2510 may be a channel formed in the side portions 2506, which extends partially between or entirely from the bottom portion 2502 to the top portion 2506. In various embodiments, the groove or furrow 2510 may additionally extend along the top portion 2504 as a continuation of the groove or furrow extending along the side portions 2506.

Figure 39:
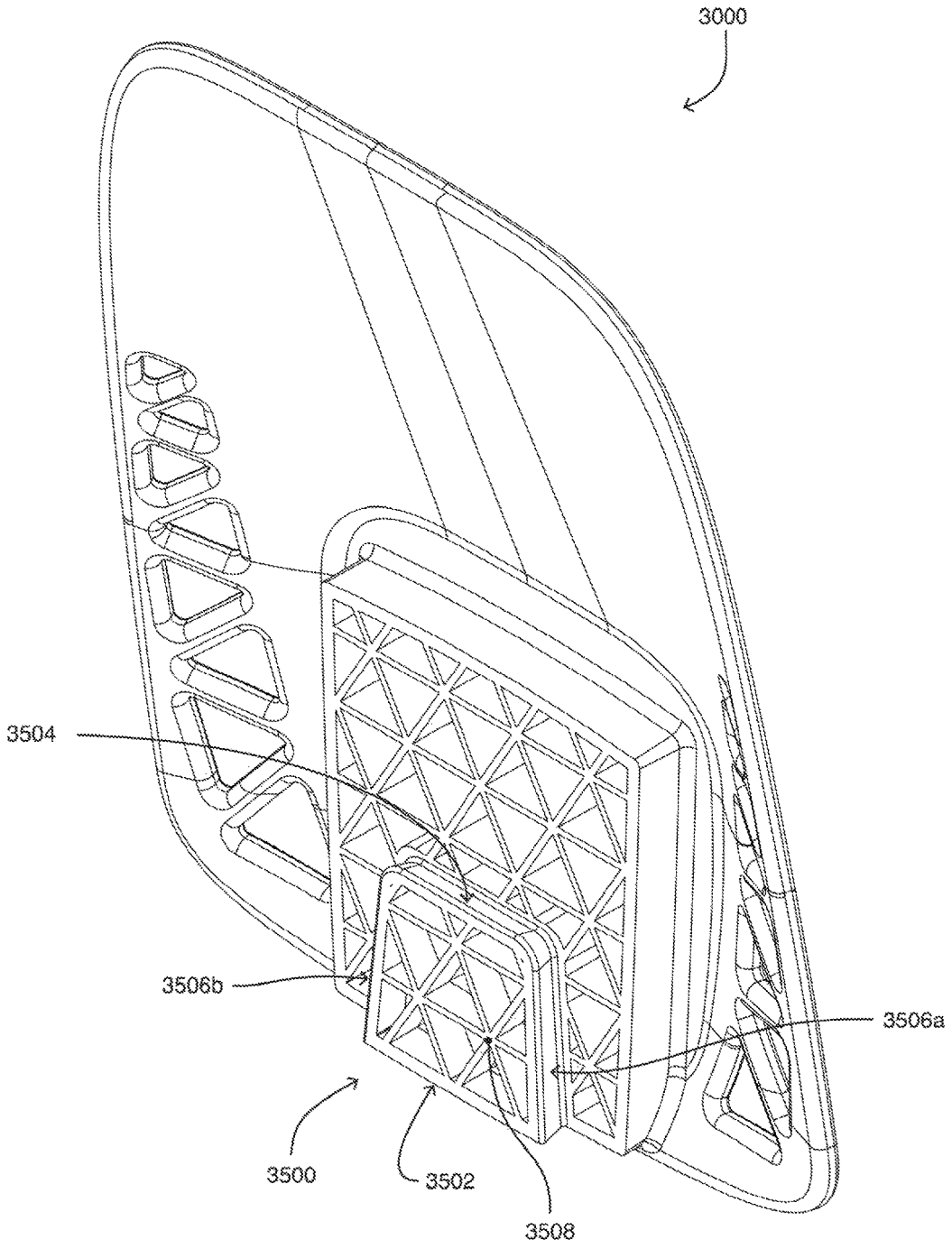
FIG. 39 illustrates a back, perspective view of a panel of a WAKE DIVERTER according to certain embodiments.

In one embodiment, the tapered recess 2500 of the locking dovetail feature is configured to accommodate a corresponding tapered projection formed on the panel 3000. Referring now to FIG. 39, a panel 3000 with a tapered projection 3500 is illustrated. In one embodiment, tapered projection 3500 is formed as a projection extending from the rearward side 3004 of panel 3000. In one embodiment, the tapered projection 3500 extends from rearward surface 3300 of panel 3000. In another embodiment, the tapered projection 3500 extends from the body interface portion 3500 of panel 3000. In one embodiment, tapered projection 35000 includes a bottom portion 3502, a top portion 3504, and a plurality of side portions 3506, such as side portions 3506*a* and 3506*b*. In one embodiment, tapered projection 3500 includes projection surface 3508. In one embodiment, tapered projection 3500 is positioned more proximate a bottom portion 3008 of the panel 3000 than it is the top portion 3006 of panel 3000. However, tapered projection 3500 may alternatively be positioned more proximate the top portion 3006 than the bottom portion 3008.

In some embodiments, the tapered projection 3500 is complementary to tapered recess 2500. For example, in one embodiment, tapered projection 3500 is tapered from bottom to top. For example, a distance from the first side portion 3506*a* to the second side portion 3506*b* at the bottom portion 3502 of the tapered projection 3500 is greater than is the distance from the first side portion 3506*a* to the second side portion 3506*b* at the top portion 3504 of the tapered projection 3500. Such a configuration provides for a secure fit of the tapered projection 3500 of panel 3000 within tapered recess 2500.

In one embodiment, the side portions 3506 of tapered projection 3500 are angled relative to body interface surface 3508 to create a groove or furrow 3510 (e.g., 3510*a* and 3510*b*), that compliments the groove or furrow 2510 of tapered recess 2500. In one embodiment, groove or furrow 3510 extends along the side portions 3506 of the tapered projection 3500. In one embodiment, the groove or furrow 3510 extends partially between or entirely from the bottom portion 3502 to the top portion 3506. In various embodiments, the groove or furrow 2510 may additionally extend along the top portion 3504 as a continuation of the groove or furrow extending along the side portions 3506. Such a configuration operates to longitudinally secure the panel 3000 to the body 2000.

While the above-discussed embodiment illustrates a tapered recess 2500 formed in the body 2000 and a tapered projection 3500 formed on the panel 3000, it should be appreciated that the tapered recess may alternatively be formed in the panel and the tapered projection formed on the body.

In one embodiment, the above-discussed dovetail feature is formed such that movement of the panel 3000 relative to the body 2000 is constrained to a designed direction or directions. For example, the configuration illustrated in FIGS. 36-39 provides that the panel 3000 is coupled to the body 2000 by aligning the top portion 3504 of the tapered projection 3500 of panel 3000 with the bottom portion 2502 of the tapered recess 2500 of body 2000 and sliding the panel 3000 toward the top portion 2504 of the tapered recess 2500 of body 2000. In this example, because the top portion 2504 of tapered recess 2500 is concealed from the top portion 2002 of body 2000, panel 3000 is prevented from being decoupled from body 2000 by sliding panel 3000 toward the top portion 2002 of body 2000. It should also be appreciated that the tapering of tapered recess also operates to prevent panel 3000 from being decoupled from body 2000 by sliding panel 3000 toward the top portion 2002 of body 2000.

Instead, in this example, panel 3000 is decoupled from body 2000 by sliding panel 3000 toward the bottom portion 2502 of the tapered recess 2500. It should be appreciated that such a configuration provides that unwanted or unintended decoupling of panel 3000 from body 2000 during normal operating condition can be avoided. For example, when attached to a watercraft's hull, the hull operates as an obstruction to panel 3000 sliding toward the bottom portion 2502 of tapered recess 2500. Under such a configuration, the panel 3000 is removed from the body 2000 by first detaching the wake diverter 1000 from the watercraft's hull and thereafter sliding the panel 3000 toward the bottom portion 2502 of the tapered recess 2500.

It should be appreciated that the dovetail feature discussed herein may be implemented in accordance with one or more of the other retaining features discussed herein (e.g., face plate 9000 and fasteners 9100). In various other embodiments, a dowel pin or any other mechanical interference connection may be used in addition to, or as an alternative to, those retention features discussed herein. Accordingly, any suitable means or method of coupling the panel 3000 with the body 2000 may be implemented without departing from the spirit and scope of the disclosure.

In one alternative embodiment, activation mechanism 5000 is pivotably coupled to differential pressure attachment 4000 absent an independent pin or dowel (e.g., 8000). For example, in one alternative embodiment, one or more protrusions extend from commissure post 4200 and operate to interface with aperture 5208.

In various embodiments, an activation mechanism operates to cause a plurality of differential pressure attachments to become engaged and/or disengaged. In one such embodiment, a single activation mechanism is operable to engage and disengage two or more suction cup. In some embodiments, the activation mechanism is transitionable from the engaged position to the disengaged position, wherein when the activation mechanism is transitioned from the disengaged position to the engaged position, each of the plurality of differential pressure attachments are transitioned to an engaged position wherein, for each differential pressure attachment, a volume formed between the differential pressure attachment and a surface to which the differential pressure attachment is in contract and wherein a pressure of that volume is less than a pressure outside of that volume. For example, a pressure of that volume is less than an atmospheric pressure. In some such embodiments, for each differential pressure attachment, when the activation mechanism is transitioned from the disengaged position to the engaged position, the volume formed between the differential pressure attachment and a surface to which the differential pressure attachment is in contract changes from a first volume to a second volume that is larger than the first volume. In some such embodiments, as discussed above, that the volume increases while an amount of fluid trapped within the volume generally remains constant.

In another alternative embodiment, differential pressure attachment 4000 is engaged (e.g., operates to attach to a watercraft's hull) free from any influence by a separate activation mechanism, or at minimum, any separate activation mechanism fails to add substantially to the function of differential pressure attachment 4000. In this embodiment, differential pressure attachment 4000 is formed in a conical shape or otherwise have a naturally lofted shape with a hollow interior having a first volume. In these embodiments, the differential pressure attachment is predisposed to resiliently return to said conical shape in response to any deformation. In one embodiment, differential pressure attachment 4000 has a top portion and a bottom portion, wherein the bottom portion includes a peripheral edge and is open to the hollow interior. In one embodiment, the top portion of differential pressure attachment 4000 is coupled to the bottom portion of the body 2000. In one embodiment, wake diverter 1000 is attached to a watercraft's hull by orienting the wake diverter 1000 such that the bottom portion and peripheral edge of the differential pressure attachment contact the watercraft's hull. Once properly oriented, a force is applied to the top portion 2002 of the body of the wake diverter 1000 in a direction toward the watercraft's hull. This force operates to deform the differential pressure attachment such that the peripheral edge of the differential pressure attachment forms a seal with the watercraft's hull and such that the first volume of the hollow interior is decreased to a second, smaller volume. This decrease in volume, in combination with the resiliency of the differential pressure attachment operates to create a negative relative (or differential) pressure, which operates with friction such that the wake diverter 1000 is sufficiently retained on the watercraft's hull during normal operating conditions as described herein.

In this alternative embodiment, the differential pressure attachment includes a separation tab or mechanism. In one embodiment, when a force is applied to the separation tab, the peripheral edge of the differential pressure attachment is deflected away from the watercraft's hull such that the seal previously formed between the peripheral edge of the differential pressure attachment and the watercraft's hull is broken such that the hollow interior is permitted to increase from the second volume to the first volume. The wake diverter 1000 is then removable from the watercraft's hull.

EXPERIMENTAL DATA

Testing included a broad number of different configurations including but not limited to the number of cups, configuration of cups, material, durometer, thickness, and diameter of the cups.

A single cup was tested to attach a diverter panel to a watercraft surface. Separately, as many as 4 cups were tested to attach a diverter panel of various shapes and sizes. In some experiments, the suction cup(s) were attached in a manner rigid to one another. In other experiments, the suction cup(s) were flexible in position relative to one another. In yet another experiment, pairs of suction cups were rigid relative to one another and flexible in position relative to other pairs.

Cups made of natural rubber compounds were tested to attach a diverter panel to a watercraft surface. Additionally, cups made of TPE (ThermoPlastic Elastomer) were tested to attach a diverter panel to a watercraft surface.

A range of material durometers were tested to attach a diverter panel to a watercraft. In one experiment, the durometer of the suction cup material was ShoreA 15. In another experiment, the durometer of the suction cup material was ShoreA 70. In other experiments, other durometers within the range of ShoreA 15 to ShoreA 70 were tested.

Suction cups with a material thickness of 0.1 inches were tested to attach a diverter panel to a watercraft surface. In another experiment, suction cups with a material thickness of 0.312 inches were tested to attach a diverter panel to a watercraft surface. In other experiments, suction cups with a material thickness between 0.1 and 0.312 inches were tested to attach a diverter panel to a watercraft surface.

Suction cups of diameter 2 inches were tested to attach a diverter panel to a watercraft surface. In another experiment, suction cups of diameter of 4.5 inches were tested to attach a diverter panel to a watercraft surface. In other experiments, suction cup/s having diameters between 2 inches to 4.5 inches were tested to attach a diverter panel to a watercraft surface.

A number of the above considerations in various combinations were tested in order to determine the appropriate combination of material properties and dimensions to result in the necessary strength, ease of attachment, and geometry suitable to boat surfaces and proposed placement on the boat. The wake diverter 1000 is configured such that the panel 3000 can be reversed relative to the body 2000 and/or to the boat (e.g., the orientation of the body is additionally or alternatively reversible relative to the boat). Because the panel 3000 is pitched or angled in some example, such a change in configurations operates to change an angle of the side of the panel 3000 facing the front of the boat relative to the body. Accordingly, as discussed above, the wake diverter 1000 is operable in a first configuration wherein the panel 3000 is angled relative to the body at a first angle, and is operable in a second configuration wherein the panel 3000 is angled relative to the body at a second angle. In some examples, because the panel may have a pitch, the first and second angle may be different. Put differently, in various examples, the wake diverter 1000 includes a body 2000 and a panel 3000 wherein the panel 3000 is configurable in a plurality of different configurations, including a first configuration and a second configuration wherein an angle of the panel 3000 relative to the body 2000 is different in the first configuration than in the second configuration.

Panels of a variety of shapes and sizes were also tested. In general, panels having a minimum of fifty-five (55) square inches with slight curvature performed adequately. In addition, based on the shape, the performance of the wake diverter (in terms of its ability to modify the characteristics of the stern waves) plateaued in certain cases. For example, for a given panel shape (e.g., curvature and aperture presence), no appreciable increase in performance was realized for an increase in panel size above approximately seventy (70) square inches. Likewise, larger panels bear with them an increased susceptibility of tear-off or detachment (differential pressure attachment failure) due to the forces resulting from the drag created by the panel obstructing the flow of water, and cause greater load on the watercraft which may decrease steering and/or engine performance. For example, during testing, it was observed that larger panels required greater throttle and had the effect of decreasing steering performance in specific directions. In one example, it was observed that larger panels on the starboard side of the hull were associated with decreased port steering performance (and vice versa). It should be appreciated that performance is largely based on both the shape of the panel and the size of the panel. Accordingly, the above-discussed size and shape should not be interpreted as limiting, but are instead offered as a means of reference for those of skill in the art.

In another embodiment, panel 3000 has a body-connecting portion that is slidable into and slidable out-of a complementary or mating panel-receiving portion of the body 2000 such that screws and other fasteners are not required to hold the panel to the body. Similarly, such portions could be reversed such that a portion of the panel 3000 is slidable around or over the complementary or mating portion of the body 2000. Examples of such structures (e.g., complimentary structure) include a dovetail-like arrangement with one or more dovetails, a key-lock arrangement, or the like as those of skill will appreciate. Accordingly, differing panel designs (e.g., size, shape, material, color, etc.) are interchangeable with the body 2000 provided they have a body-connecting portion that is complimentary to the panel-receiving portion of the body 2000. In other words, a first panel having a first body-connecting portion is coupleable to a body 2000 having a first panel-receiving portion, and a second panel different from the first panel (e.g., size, shape, material, color, etc.) and having the first body-connecting portion is also coupleable to the body 2000. Such a second panel is thus interchangeable with the first panel in that the second panel can likewise be coupled to the body 2000 by way of the panel-receiving portion.

Aspects of disclosure have been described by way of example only and it should be appreciated that modifications and additions may be made thereto without departing from the scope thereof. No embodiment or aspect of an embodiment is intended to be essential or absolute with respect to any other embodiment or aspect. No reference to components or structures being coupled or otherwise connected is intended to limited to direct coupling unless expressly stated as such.

Various modifications and additions can be made to the exemplary embodiments discussed without departing from the scope of this disclosure. For example, while the embodiments described above refer to particular features, the scope of this disclosure also includes embodiments having different combinations of features and embodiments that do not include all of the described features. Accordingly, the scope of this disclosure is intended to embrace all such alternatives, modifications, combinations, and variations as fall within the scope of the claims, together with all equivalents thereof.

What is claimed is:

1. An apparatus configured to be coupled to a port or a starboard side of a hull of a watercraft forward of a stern of the watercraft, the apparatus comprising:

a body having a longitudinal axis, a differential pressure attachment assembly coupled to the body and operable to couple the body to one of the port and starboard sides of the hull of the watercraft such that a portion of the apparatus is submerged while the watercraft travels through a body of water at speeds suitable for wake surfing, the differential pressure attachment assembly comprising:

a cup having a hull attachment surface, at least a portion of the hull attachment surface being configured to contact a portion of the hull of the watercraft, and an actuator transitionable between a disengaged state and an engaged state, the actuator coupled to the cup such that as the actuator transitions from the disengaged state to the engaged state, a force is exerted on the cup that causes a portion of the hull attachment surface of the cup to move away from the hull of the watercraft such that a volume defined between the hull attachment surface of the cup and the hull of the watercraft changes from a first volume to a second volume, the second volume being larger than the first volume, and a pressure of the second volume being less than an atmospheric pressure, and a panel including a forward surface the panel extending from the body such that an angle defined between the body and the forward surface of the panel is greater than forty five degrees and less than one hundred thirty five degrees, and the panel being configured to extend away from one of the port and starboard sides of the hull of the watercraft at least partially below a waterline of the body of water and forward of the stern of the watercraft such that the forward surface of the panel extends into the water and disrupts the water such that a first wake is produced by the watercraft as the watercraft travels through the body of water at a first speed suitable for wake surfing and in a first direction with the apparatus coupled to the port side of the hull of the watercraft, the first wake being different than a second wake that is produced by the watercraft as the watercraft travels through the body of water at the first speed and in the first direction with the apparatus coupled to the starboard side of the hull of the watercraft at least partially below the waterline of the body of water and forward of the stern of the watercraft.

2. The apparatus of claim 1, wherein the differential pressure attachment assembly does not require the use of a pump to evacuate a fluid trapped within the volume defined between the hull attachment surface of the cup and the hull of the watercraft to cause the volume to change from the first volume to the second volume.

3. The apparatus of claim 1, wherein the actuator is a mechanical lever having a fulcrum and the mechanical lever is transitionable between the disengaged state and the engaged state by rotating the lever about the fulcrum, wherein rotating the mechanical lever about the fulcrum causes the fulcrum to translate from a first position to a second position.

4. The apparatus of claim 3, the differential pressure attachment assembly further comprising a post extending from an upper surface of the cup and mechanically coupling the cup to the lever, the lever being rotatably coupled to the post such that as the fulcrum translates from the first position to the second position the post translates with the fulcrum, the translation of the post resulting in the force that is exerted on the cup that causes the portion of the hull attachment surface of the cup to move away from the hull of the watercraft.

5. The apparatus of claim 1, wherein a resilient member is positioned between the cup and the body, the resilient member exerting a force on the body and the cup that influences the body and the cup to move away from one another.

6. The apparatus of claim 1, wherein the portion of the hull attachment surface of the cup that contacts the hull of the watercraft is an annular portion of the hull attachment surface of the cup, and wherein the portion of the hull attachment surface of the cup that moves away from the hull of the watercraft as the actuator transitions from the disengaged state to the engaged state is a central portion of the hull attachment surface of the cup that is enveloped by the annular portion.

7. The apparatus of claim 6, wherein as the actuator transitions from the disengaged state to the engaged state, at least a portion of the annular portion of the hull attachment surface of the cup is configured to maintain contact with the hull of the watercraft while the central portion is moved away from the hull of the watercraft.

8. The apparatus of claim 1, wherein the apparatus is coupleable directly to the hull of the watercraft while the assembly is at least partially below the waterline of the body of water.

9. The apparatus of claim 1, wherein in a first configuration the panel is angled relative to the longitudinal axis of the body at a first angle and wherein in a second configuration the panel is angled relative to the longitudinal axis of the body at a second angle different from the first angle.

10. The apparatus of claim 9, wherein the body has a forward end and an aft end opposite the forward end, and wherein the panel includes a forward side and a rearward side, the forward side including the forward surface, and the panel being removably coupleable to the body such that the panel is reversible relative to the body.

11. The apparatus of claim 1, wherein the hull attachment surface of the cup has a loft such that in an undeformed state, a first portion of the hull attachment surface lies in a first plane and a second portion of the hull attachment surface lies in a second plane, the first and second planes not being coplanar.

12. The apparatus of claim 1, wherein the panel extends substantially perpendicular to the longitudinal axis of the body.

13. The apparatus of claim 1, wherein the panel is removably coupleable to the body via a dovetail coupling.

14. The apparatus of claim 1, wherein the forward surface of the panel is curved.

15. The apparatus of claim 1, wherein the panel includes the forward surface and a rearward surface, and wherein a thickness of the panel between forward and rearward surfaces nonuniform across a surface area of the panel.

16. The apparatus of claim 1, wherein the panel includes a forward side including the forward surface, a rearward side opposite the forward side, a top, a bottom opposite the top, a first side and a second side opposite the first side, and wherein a thickness of the panel between the forward and rearward sides is less than a width of the panel between the first and second sides, and wherein the thickness of the panel is less than a height of the panel between the top and bottom, and wherein the width is considered in a lateral direction transverse to a longitudinal axis of the body, and wherein the height is considered in a direction transverse to the width and transverse to the longitudinal axis of the body.

17. The apparatus of claim 1, wherein the differential pressure attachment assembly is a first differential pressure attachment assembly, the cup is a first cup, and the actuator is a first actuator, and wherein the apparatus further comprises:

a second differential pressure attachment assembly coupled to the body and operable to couple the apparatus to one of the port and starboard sides of the hull of the watercraft such that a portion of the apparatus is submerged while the watercraft travels through a body of water at speeds suitable for wake surfing, the assembly comprising:

a second cup having a hull attachment surface, at least a portion of the hull attachment surface being configured to contact a portion of the hull of the watercraft, and a second actuator transitionable between a disengaged state and an engaged state, the second actuator coupled to the second cup such that as the second actuator transitions from the disengaged state to the engaged state, a force is exerted on the second cup that causes a portion of the hull attachment surface of the second cup to move away from the hull of the watercraft such that a volume defined between the hull attachment surface of the second cup and the hull of the watercraft changes from a first volume to a second volume, the second volume being larger than the first volume, and a pressure of the second volume being less than an atmospheric pressure.

18. The apparatus of claim 1, wherein the body has a forward end and an aft end opposite the forward end, and wherein the panel is removably coupleable to one of the forward and aft ends of the body.

* * * * *